US012290724B2

(12) United States Patent
Parsons et al.

(10) Patent No.: US 12,290,724 B2
(45) **Date of Patent: *May 6, 2025**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Michael R. Nicolette, Scottsdale, AZ (US); Bradley D. Schweigert, Cave Creek, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 526 days.

This patent is subject to a terminal disclaimer.

(21) Appl. No.: 17/732,292

(22) Filed: Apr. 28, 2022

(65) Prior Publication Data

US 2022/0249926 A1 Aug. 11, 2022

Related U.S. Application Data

(63) Continuation of application No. 17/205,778, filed on Mar. 18, 2021, now Pat. No. 11,344,775, and a (Continued)

(51) Int. Cl.
*A63B 53/04* (2015.01)
*A63B 60/02* (2015.01)
*A63B 60/54* (2015.01)

(52) U.S. Cl.
CPC ..... *A63B 53/0466* (2013.01); *A63B 53/04* (2013.01); *A63B 60/02* (2015.10); (Continued)

(58) Field of Classification Search
CPC ..... A63B 53/0466; A63B 53/04; A63B 60/02; A63B 2053/0491; A63B 60/54; (Continued)

(56) References Cited

U.S. PATENT DOCUMENTS 723,258 A 3/1903 Felton
1,133,129 A 3/1915 Govan
(Continued)

FOREIGN PATENT DOCUMENTS

CN 1572343 A 2/2005
CN 1608696 A 4/2005
(Continued)

OTHER PUBLICATIONS

"3M Scotch-Weld Structural Adhesives, Bonding Composite Parts to Multiple Materials", 3M Company, retrived from the Internet at www.3M.com/compositebonding (Year: 2016).
(Continued)

*Primary Examiner* — Sebastiano Passaniti

(57) ABSTRACT

Embodiments of golf club heads and methods to manufacture golf club heads are generally described herein. In one example, a golf club head may include a body portion with an interior cavity, an upper back wall portion, a lower back wall portion, a ledge portion extending from the upper back wall portion to the lower back wall portion, an upper back wall portion thickness, and a lower back wall portion thickness. The golf club head may further include a first mass portion below the ledge portion, a second mass portion above the ledge portion, a polymer material in the interior cavity, a first width of the interior cavity above the ledge portion, a second width of the interior cavity below the ledge portion and above the lower back wall portion thickness, and a third width of the interior cavity below the second width. The third width may be greater than the first width, the second width may be greater than the third width, and the lower back wall portion thickness may be greater than the upper back wall portion thickness at three spaced apart cross sections of the body portion defined by associated planes that intersect a horizontal midplane of the body portion. (Continued)

Other examples and embodiments may be described and claimed.

20 Claims, 29 Drawing Sheets

Related U.S. Application Data continuation-in-part of application No. 17/155,486, filed on Jan. 22, 2021, now Pat. No. 11,745,061, which is a continuation of application No. 16/774,449, filed on Jan. 28, 2020, now Pat. No. 10,926,142, which is a continuation of application No. 16/179,406, filed on Nov. 2, 2018, now Pat. No. 10,583,336, application No. 17/732,292, filed on Apr. 28, 2022 is a continuation-in-part of application No. 17/505,795, filed on Oct. 20, 2021, now abandoned, which is a continuation of application No. 17/038,195, filed on Sep. 30, 2020, now Pat. No. 11,173,359, which is a continuation of application No. 16/365,343, filed on Mar. 26, 2019, now Pat. No. 10,821,340, which is a continuation of application No. 15/841,022, filed on Dec. 13, 2017, now Pat. No. 10,265,590, which is a continuation of application No. 15/701,131, filed on Sep. 11, 2017, now abandoned, which is a continuation-in-part of application No. 15/685,986, filed on Aug. 24, 2017, now Pat. No. 10,279,233, which is a continuation of application No. 15/628,251, filed on Jun. 20, 2017, now abandoned, which is a continuation of application No. 15/209,364, filed on Jul. 13, 2016, now Pat. No. 10,293,229, which is a continuation of application No. PCT/US2015/016666, filed on Feb. 19, 2015, said application No. 15/209,364 is a continuation of application No. 14/618,501, filed on Feb. 10, 2015, now Pat. No. 9,427,634, which is a continuation of application No. 14/589,277, filed on Jan. 5, 2015, now Pat. No. 9,421,437, which is a continuation of application No. 14/513,073, filed on Oct. 13, 2014, now Pat. No. 8,961,336, which is a continuation of application No. 14/498,603, filed on Sep. 26, 2014, now Pat. No. 9,199,143, application No. 17/732,292, filed on Apr. 28, 2022 is a continuation-in-part of application No. 17/458,825, filed on Aug. 27, 2021, now Pat. No. 11,691,056, which is a continuation of application No. 16/929,552, filed on Jul. 15, 2020, now Pat. No. 11,117,030, which is a continuation of application No. 15/683,564, filed on Aug. 22, 2017, now Pat. No. 10,716,978, which is a continuation of application No. 15/598,949, filed on May 18, 2017, now Pat. No. 10,159,876, which is a continuation of application No. 14/711,596, filed on May 13, 2015, now Pat. No. 9,675,853, said application No. 17/205,778 is a continuation-in-part of application No. 16/376,863, filed on Apr. 5, 2019, now abandoned, which is a continuation of application No. 15/958,288, filed on Apr. 20, 2018, now abandoned, which is a continuation of application No. 15/947,383, filed on Apr. 6, 2018, now abandoned, which is a continuation of application No. 15/842,632, filed on Dec. 14, 2017, now Pat. No. 10,029,159, which is a continuation of application No. 15/263,018, filed on Sep. 12, 2016, now Pat. No. 9,878,220, which is a continuation of application No. 15/043,090, filed on Feb. 12, 2016, now Pat. No. 9,468,821, said application No. 17/205,778 is a continuation-in-part of application No. 17/038,155, filed on Sep. 30, 2020, now Pat. No. 11,141,633, which is a continuation of application No. 16/351,143, filed on Mar. 12, 2019, now Pat. No. 10,821,339, which is a continuation of application No. 15/842,583, filed on Dec. 14, 2017, now Pat. No. 10,232,235, which is a continuation of application No. 15/631,610, filed on Jun. 23, 2017, now abandoned, which is a continuation of application No. 15/360,707, filed on Nov. 23, 2016, now Pat. No. 10,029,158, which is a continuation of application No. 15/043,106, filed on Feb. 12, 2016, now Pat. No. 9,533,201, said application No. 17/205,778 is a continuation-in-part of application No. 16/785,336, filed on Feb. 7, 2020, now abandoned, which is a continuation of application No. 15/703,639, filed on Sep. 13, 2017, now Pat. No. 10,596,424, which is a continuation-in-part of application No. 15/484,794, filed on Apr. 11, 2017, now Pat. No. 9,814,952, application No. 17/732,292, filed on Apr. 28, 2022 is a continuation-in-part of application No. 17/557,242, filed on Dec. 21, 2021, now Pat. No. 11,794,081, which is a continuation of application No. 16/388,619, filed on Apr. 18, 2019, now Pat. No. 11,235,211, which is a continuation of application No. 15/842,591, filed on Dec. 14, 2017, now abandoned, which is a continuation of application No. PCT/US2016/042072, filed on Jul. 13, 2016, which is a continuation of application No. 15/188,718, filed on Jun. 21, 2016, now Pat. No. 9,610,481, application No. 17/732,292, filed on Apr. 28, 2022 is a continuation-in-part of application No. 17/682,476, filed on Feb. 28, 2022, now Pat. No. 12,194,349, which is a continuation of application No. 17/099,362, filed on Nov. 16, 2020, now Pat. No. 11,291,890, which is a continuation of application No. 16/820,136, filed on Mar. 16, 2020, now Pat. No. 10,874,919, which is a continuation of application No. 16/590,105, filed on Oct. 1, 2019, now Pat. No. 10,632,349, application No. 17/732,292, filed on Apr. 28, 2022 is a continuation-in-part of application No. 17/178,989, filed on Feb. 18, 2021, now Pat. No. 11,623,124, which is a continuation of application No. 16/789,167, filed on Feb. 12, 2020, now Pat. No. 10,933,286, application No. 17/732,292, filed on Apr. 28, 2022 is a continuation-in-part of application No. 17/505,813, filed on Oct. 20, 2021, now Pat. No. 11,731,013, which is a continuation of application No. 17/161,987, filed on Jan. 29, 2021, now Pat. No. 11,167,187.

(60) Provisional application No. 62/581,456, filed on Nov. 3, 2017, provisional application No. 61/942,515, filed on Feb. 20, 2014, provisional application No. 61/945,560, filed on Feb. 24, 2014, provisional application No. 61/948,839, filed on Mar. 6, 2014, provisional application No. 61/952,470, filed on Mar. 13, 2014, provisional application No. 61/992,555, filed on May 13, 2014, provisional application No. 62/010,836, filed on Jun. 11, 2014, provisional application No. 62/011,859, filed on Jun. 13, 2014, provisional application No. 62/032,770, filed on Aug. 4, 2014, provisional application No. 62/041,538, filed on Aug. 25, 2014, provisional application No. 62/118,403, filed on Feb. 19, 2015, provisional application No. 62/159,856, filed on May 11, 2015, provisional application No. 62/209,780, filed on Aug. 25, 2015, provisional application No. 62/277,636, filed on Jan. 12, 2016, provisional application No. 62/275,443, filed on Jan. 6, 2016, provisional application No. 62/276,358, filed on Jan. 8, 2016, provisional application No. 62/321,652, filed on Apr. 12, 2016, provisional application No. 62/343,739, filed on May 31, 2016, provisional application No. 62/908,467, filed on Sep. 30, 2019, provisional application No. 62/903,467, filed on Sep. 20, 2019, provisional application No. 62/877,934, filed on Jul. 24, 2019, provisional application No. 62/877,915, filed on Jul. 24, 2019, provisional application No. 62/865,532, filed on Jun. 24, 2019, provisional application No. 62/826,310, filed on Mar. 29, 2019, provisional application No. 62/814,959, filed on Mar. 7, 2019.

(52) U.S. Cl.
CPC ..... *A63B 53/0408* (2020.08); *A63B 53/0412* (2020.08); *A63B 53/0433* (2020.08); *A63B 53/0475* (2013.01); *A63B 2053/0491* (2013.01); *A63B 60/54* (2015.10)

(58) Field of Classification Search
CPC ..... A63B 53/0412; A63B 53/0433; A63B 53/0475; A63B 53/0408
USPC ..... 473/324–350, 287–292
See application file for complete search history.

(56) References Cited

U.S. PATENT DOCUMENTS 1,306,029 A 6/1919 Robertson
1,534,600 A 4/1925 Mattern
1,538,312 A 5/1925 Neish
3,020,048 A 2/1962 Carroll
3,266,805 A 8/1966 Bulla
3,419,275 A 12/1968 Winkleman
3,466,047 A 9/1969 Rodia et al.
3,556,533 A 1/1971 Hollis
3,843,122 A 10/1974 Florian
3,845,960 A 11/1974 Thompson
3,970,236 A 7/1976 Rogers
3,979,122 A 9/1976 Belmont
3,985,363 A 10/1976 Jepson et al.
3,995,865 A 12/1976 Cochran et al.
4,043,563 A 8/1977 Churchward
4,085,934 A 4/1978 Churchward
4,145,052 A 3/1979 Janssen et al.
4,313,607 A 2/1982 Thompson
4,319,752 A 3/1982 Thompson
4,340,230 A 7/1982 Churchward
4,489,945 A 12/1984 Kobayashi
4,502,687 A 3/1985 Kochevar
4,511,145 A 4/1985 Schmidt
4,523,759 A 6/1985 Igarashi
4,545,580 A 10/1985 Tomita et al.
4,553,755 A 11/1985 Yamada
4,591,160 A 5/1986 Piragino
4,607,846 A 8/1986 Perkins
4,614,627 A 9/1986 Curtis et al.
D294,617 S 3/1988 Perkins
4,754,977 A 7/1988 Sahm
4,803,023 A 2/1989 Enomoto et al.
4,824,116 A 4/1989 Nagamoto et al.
4,867,458 A 9/1989 Sumikawa et al.
4,869,507 A 9/1989 Sahm
4,928,972 A 5/1990 Nakanishi et al.
4,962,932 A 10/1990 Anderson
4,988,104 A 1/1991 Shiotani et al.
5,028,049 A 7/1991 McKeighen
5,050,879 A 9/1991 Sun et al.
5,090,702 A 2/1992 Viste
5,094,383 A 3/1992 Anderson et al.
5,106,094 A 4/1992 Desbiolles et al.
5,158,296 A 10/1992 Lee
5,176,384 A 1/1993 Sata et al.
5,178,392 A 1/1993 Santioni
5,184,823 A 2/1993 Desboilles et al.
5,209,473 A 5/1993 Fisher
5,213,328 A 5/1993 Long et al.
5,219,408 A 6/1993 Sun
5,244,211 A 9/1993 Lukasiewicz
5,255,918 A 10/1993 Anderson et al.
5,282,624 A 2/1994 Viste
5,282,625 A 2/1994 Schmidt et al.
5,290,036 A 3/1994 Fenton et al.
5,306,450 A 4/1994 Okumoto et al.
5,348,302 A 9/1994 Sasamoto et al.
5,351,958 A 10/1994 Helmstetter
5,385,348 A 1/1995 Wargo
5,419,559 A 5/1995 Melanson et al.
5,419,560 A 5/1995 Bamber
5,421,577 A 6/1995 Kobayashi
5,425,535 A 6/1995 Gee
D361,358 S 8/1995 Simmons
5,447,309 A 9/1995 Vincent
5,447,311 A 9/1995 Viollaz et al.
5,451,056 A 9/1995 Manning
D362,885 S 10/1995 Blough et al.
5,467,983 A 11/1995 Chen
5,485,998 A 1/1996 Kobayashi
5,499,819 A 3/1996 Nagamoto
5,505,453 A 4/1996 Mack
5,509,659 A 4/1996 Igarashi
5,518,243 A 5/1996 Redman
5,518,423 A 5/1996 Green et al.
5,533,729 A 7/1996 Leu
5,540,437 A 7/1996 Bamber
5,582,553 A 12/1996 Ashcraft et al.
5,595,548 A 1/1997 Beck
D378,111 S 2/1997 Parente et al.
5,607,363 A 3/1997 Chou
5,637,045 A 6/1997 Igarashi
5,647,808 A 7/1997 Hosokawa
5,649,873 A 7/1997 Fuller
5,669,830 A 9/1997 Bamber
5,711,722 A 1/1998 Miyajima et al.
5,718,641 A 2/1998 Lin
5,766,091 A 6/1998 Humphrey et al.
5,766,092 A 6/1998 Mimeur et al.
5,769,735 A 6/1998 Hosokawa
5,772,527 A 6/1998 Liu
5,788,584 A 8/1998 Parente et al.
5,797,807 A 8/1998 Moore
5,827,132 A 10/1998 Bamber
D408,485 S 4/1999 Takahashi et al.
5,899,821 A 5/1999 Hsu et al.
5,908,357 A 6/1999 Hsieh
5,913,735 A 6/1999 Kenmi
5,935,016 A 8/1999 Antonious
6,012,990 A 1/2000 Nishizawa
6,015,354 A 1/2000 Ahn et al.
D421,080 S 2/2000 Chen
6,064,568 A 5/2000 Schmitt
D426,276 S 6/2000 Besnard et al.
6,077,171 A 6/2000 Yoneyama
6,093,116 A 7/2000 Hettinger et al.
6,162,133 A 12/2000 Peterson
6,165,081 A 12/2000 Chou
6,203,449 B1 3/2001 Kenmi
6,231,458 B1 5/2001 Cameron et al.
6,238,302 B1 5/2001 Helmstetter et al.
D445,862 S 7/2001 Ford
6,290,607 B1 9/2001 Gilbert et al.
6,290,609 B1 9/2001 Takeda
6,306,048 B1 10/2001 McCabe et al.
6,379,262 B1 4/2002 Boone
6,386,990 B1 5/2002 Reyes et al.
6,443,857 B1 9/2002 Chuang
6,458,045 B1 10/2002 Chen
6,475,427 B1 11/2002 Deshmukh et al.
6,506,129 B2 1/2003 Chen

(56) References Cited

U.S. PATENT DOCUMENTS

| | | | |
|---|---|---|---|
| D469,833 | S | 2/2003 | Roberts et al. |
| 6,533,679 | B1 | 3/2003 | McCabe et al. |
| D478,140 | S | 8/2003 | Burrows |
| 6,604,568 | B2 | 8/2003 | Bliss et al. |
| 6,607,451 | B2 | 8/2003 | Kosmatka et al. |
| 6,616,547 | B2 | 9/2003 | Vincent et al. |
| 6,638,182 | B2 | 10/2003 | Kosmatka |
| 6,638,183 | B2 | 10/2003 | Takeda |
| 6,695,714 | B1 | 2/2004 | Bliss et al. |
| 6,702,693 | B2 | 3/2004 | Bamber |
| 6,780,123 | B2 | 8/2004 | Hasebe |
| 6,811,496 | B2 | 11/2004 | Wahl et al. |
| 6,830,519 | B2 | 12/2004 | Reed et al. |
| 6,855,067 | B2 | 2/2005 | Solheim et al. |
| D502,975 | S | 3/2005 | Schweigert et al. |
| 6,916,253 | B2 | 7/2005 | Takeda |
| D508,545 | S | 8/2005 | Roberts et al. |
| D508,969 | S | 8/2005 | Hasebe |
| 6,923,733 | B2 | 8/2005 | Chen |
| 6,949,031 | B2 | 9/2005 | Imamoto et al. |
| 6,971,961 | B2 | 12/2005 | Chen |
| D514,183 | S | 1/2006 | Schweigert et al. |
| 6,984,180 | B2 | 1/2006 | Hasebe |
| 7,029,403 | B2 | 4/2006 | Rice et al. |
| 7,037,213 | B2 | 5/2006 | Otoguro |
| 7,048,647 | B2 | 5/2006 | Burrows |
| 7,121,956 | B2 | 10/2006 | Lo |
| 7,121,958 | B2 | 10/2006 | Cheng et al. |
| 7,128,663 | B2 | 10/2006 | Bamber |
| 7,153,222 | B2 | 12/2006 | Gilbert et al. |
| D534,595 | S | 1/2007 | Hasebe |
| 7,156,751 | B2 | 1/2007 | Wahl et al. |
| 7,169,057 | B2 | 1/2007 | Wood et al. |
| 7,182,698 | B2 | 2/2007 | Tseng |
| 7,207,900 | B2 | 4/2007 | Nicolette et al. |
| D543,601 | S | 5/2007 | Kawami |
| 7,232,380 | B2 | 6/2007 | Nakahara |
| 7,281,991 | B2 | 10/2007 | Gilbert et al. |
| D555,219 | S | 11/2007 | Lin |
| 7,303,485 | B2 | 12/2007 | Tseng |
| 7,303,486 | B2 | 12/2007 | Imamoto |
| 7,309,297 | B1 | 12/2007 | Solari |
| 7,326,127 | B2 | 2/2008 | Hou et al. |
| 7,351,164 | B2 | 4/2008 | Schweigert et al. |
| 7,396,299 | B2 | 7/2008 | Nicolette et al. |
| 7,448,961 | B2 | 11/2008 | Lin |
| 7,553,241 | B2 | 6/2009 | Park et al. |
| 7,559,854 | B2 | 7/2009 | Harvell et al. |
| 7,575,523 | B2 | 8/2009 | Yokota |
| 7,582,024 | B2 | 9/2009 | Shear |
| 7,588,502 | B2 | 9/2009 | Nishino |
| 7,594,862 | B2 | 9/2009 | Gilbert |
| 7,611,424 | B2 | 11/2009 | Nagai et al. |
| 7,658,686 | B2 | 2/2010 | Soracco |
| D618,293 | S | 6/2010 | Foster et al. |
| 7,744,484 | B1 | 6/2010 | Chao |
| 7,744,486 | B2 | 6/2010 | Hou et al. |
| 7,744,487 | B2 | 6/2010 | Tavares et al. |
| 7,749,100 | B2 | 7/2010 | Tavares et al. |
| 7,749,101 | B2 | 7/2010 | Imamoto et al. |
| 7,785,212 | B2 | 8/2010 | Lukasiewicz et al. |
| 7,794,333 | B2 | 9/2010 | Wallans et al. |
| 7,798,917 | B2 | 9/2010 | Nguyen et al. |
| 7,803,068 | B2 | 9/2010 | Clausen et al. |
| 7,815,521 | B2 | 10/2010 | Ban et al. |
| 7,846,040 | B2 | 12/2010 | Ban |
| 7,938,736 | B2 | 5/2011 | Park et al. |
| 7,938,738 | B2 | 5/2011 | Roach |
| 8,012,040 | B2 | 9/2011 | Takechi |
| 8,062,150 | B2 | 11/2011 | Gilbert et al. |
| 8,088,025 | B2 | 1/2012 | Wahl et al. |
| 8,092,319 | B1 | 1/2012 | Cackett et al. |
| 8,105,180 | B1 | 1/2012 | Cackett et al. |
| 8,147,353 | B2 | 4/2012 | Gilbert et al. |
| 8,187,116 | B2 | 5/2012 | Boyd et al. |
| 8,192,303 | B2 | 6/2012 | Ban |
| 8,221,262 | B1 | 7/2012 | Cackett et al. |
| 8,246,487 | B1 | 8/2012 | Cackett et al. |
| 8,257,196 | B1 | 9/2012 | Abbott et al. |
| 8,262,495 | B2 | 9/2012 | Stites |
| 8,262,506 | B2 | 9/2012 | Watson et al. |
| 8,277,337 | B2 | 10/2012 | Shimazaki |
| 8,328,662 | B2 | 12/2012 | Nakamura et al. |
| 8,328,663 | B2 | 12/2012 | Wahl et al. |
| 8,342,985 | B2 | 1/2013 | Hirano |
| 8,376,878 | B2 | 2/2013 | Bennett et al. |
| 8,393,976 | B2 | 3/2013 | Soracco et al. |
| D681,142 | S | 4/2013 | Fossum et al. |
| 8,414,422 | B2 | 4/2013 | Peralta et al. |
| 8,449,406 | B1 | 5/2013 | Frame et al. |
| 8,475,293 | B2 | 7/2013 | Morin et al. |
| 8,506,420 | B2 | 8/2013 | Hocknell et al. |
| 8,535,176 | B2 | 9/2013 | Bazzel et al. |
| 8,545,343 | B2 | 10/2013 | Boyd et al. |
| 8,574,094 | B2 | 11/2013 | Nicolette et al. |
| 8,657,700 | B2 | 2/2014 | Nicolette et al. |
| 8,663,026 | B2 | 3/2014 | Blowers et al. |
| 8,690,710 | B2 | 4/2014 | Nicolette et al. |
| 8,753,230 | B2 | 6/2014 | Stokke et al. |
| 8,790,196 | B2 | 7/2014 | Solheim et al. |
| 8,827,832 | B2 | 9/2014 | Breier et al. |
| 8,827,833 | B2 | 9/2014 | Amano et al. |
| 8,845,455 | B2 | 9/2014 | Ban et al. |
| 8,858,362 | B1 | 10/2014 | Leposky et al. |
| 8,936,518 | B2 | 1/2015 | Takechi |
| D722,352 | S | 2/2015 | Nicolette et al. |
| D723,120 | S | 2/2015 | Nicolette |
| 8,961,336 | B1 | 2/2015 | Parsons et al. |
| D724,164 | S | 3/2015 | Schweigert et al. |
| D726,265 | S | 4/2015 | Nicolette |
| D726,846 | S | 4/2015 | Schweigert |
| 9,005,056 | B2 | 4/2015 | Pegnatori |
| D729,892 | S | 5/2015 | Nicolette et al. |
| D733,234 | S | 6/2015 | Nicolette |
| 9,044,653 | B2 | 6/2015 | Wahl et al. |
| 9,061,186 | B2 | 6/2015 | Larson |
| 9,079,081 | B2 | 7/2015 | Shimazaki |
| 9,079,082 | B2 | 7/2015 | Hatton et al. |
| D738,449 | S | 9/2015 | Schweigert |
| D739,487 | S | 9/2015 | Schweigert |
| 9,155,945 | B2 | 10/2015 | Demkowski et al. |
| 9,192,830 | B2 | 11/2015 | Parsons et al. |
| 9,192,832 | B2 | 11/2015 | Parsons et al. |
| 9,199,143 | B1 | 12/2015 | Parsons et al. |
| D746,927 | S | 1/2016 | Parsons et al. |
| D748,214 | S | 1/2016 | Nicolette et al. |
| D748,215 | S | 1/2016 | Parsons et al. |
| D748,749 | S | 2/2016 | Nicolette et al. |
| D753,251 | S | 4/2016 | Schweigert et al. |
| D753,252 | S | 4/2016 | Schweigert |
| D755,319 | S | 5/2016 | Nicolette et al. |
| D756,471 | S | 5/2016 | Nicolette et al. |
| 9,345,938 | B2 | 5/2016 | Parsons et al. |
| 9,346,203 | B2 | 5/2016 | Parsons et al. |
| 9,352,197 | B2 | 5/2016 | Parsons et al. |
| D759,178 | S | 6/2016 | Nicolette |
| D760,334 | S | 6/2016 | Schweigert et al. |
| 9,364,727 | B2 | 6/2016 | Parsons et al. |
| 9,399,158 | B2 | 7/2016 | Parsons et al. |
| 9,421,437 | B2 | 8/2016 | Parsons et al. |
| 9,427,634 | B2 | 8/2016 | Parsons et al. |
| 9,440,124 | B2 | 9/2016 | Parsons et al. |
| 9,468,821 | B2 | 10/2016 | Parsons et al. |
| 9,517,393 | B2 | 12/2016 | Cardani et al. |
| 9,533,201 | B2 | 1/2017 | Parsons et al. |
| 9,550,096 | B2 | 1/2017 | Parsons et al. |
| 9,573,027 | B2 | 2/2017 | Nivanh et al. |
| 9,610,481 | B2 | 4/2017 | Parsons et al. |
| 9,630,070 | B2 | 4/2017 | Parsons et al. |
| 9,636,554 | B2 | 5/2017 | Parsons et al. |
| 9,649,540 | B2 | 5/2017 | Parsons et al. |
| 9,649,542 | B2 | 5/2017 | Nicolette |
| 9,662,547 | B2 | 5/2017 | Parsons et al. |
| 9,662,549 | B2 | 5/2017 | Vrska, Jr. et al. |

(56) References Cited

U.S. PATENT DOCUMENTS 9,675,853 B2 6/2017 Parsons et al.
9,750,993 B2 9/2017 Ritchie et al.
9,764,194 B2 9/2017 Parsons et al.
9,764,208 B1 9/2017 Parsons et al.
9,782,643 B2 10/2017 Parsons et al.
9,795,842 B1 10/2017 Parsons et al.
9,795,843 B2 10/2017 Parsons et al.
9,796,131 B2 10/2017 Parsons et al.
9,814,952 B2 11/2017 Parsons et al.
9,878,218 B2 1/2018 Parsons et al.
9,878,220 B2 1/2018 Parsons et al.
10,029,158 B2 7/2018 Parsons et al.
10,029,159 B2 7/2018 Parsons et al.
10,159,876 B2 12/2018 Parsons et al.
10,232,235 B2 3/2019 Parsons et al.
10,265,590 B2 4/2019 Parsons et al.
10,279,233 B2 5/2019 Parsons et al.
10,286,267 B2 5/2019 Nicolette
10,293,221 B2 5/2019 Parsons et al.
10,293,229 B2 5/2019 Parsons et al.
10,376,754 B2 8/2019 Parsons et al.
D863,478 S 10/2019 Parsons et al.
10,449,428 B2 10/2019 Parsons et al.
10,478,684 B2 11/2019 Parsons et al.
10,512,829 B2 12/2019 Parsons et al.
10,596,424 B2 3/2020 Parsons et al.
10,596,425 B2 3/2020 Parsons et al.
10,632,349 B2 4/2020 Parsons et al.
10,716,978 B2 7/2020 Parsons et al.
10,729,948 B2 8/2020 Parsons et al.
10,729,949 B2 8/2020 Parsons et al.
10,814,193 B2 10/2020 Parsons et al.
10,821,339 B2 11/2020 Parsons et al.
10,821,340 B2 11/2020 Parsons et al.
10,828,538 B2 11/2020 Parsons et al.
10,864,414 B2 12/2020 Parsons et al.
10,874,919 B2 12/2020 Parsons et al.
10,874,921 B2 12/2020 Parsons et al.
11,344,775 B2 * 5/2022 Parsons ..... A63B 60/02
2001/0055996 A1 12/2001 Iwata et al.
2002/0004427 A1 1/2002 Cheng et al.
2002/0037775 A1 3/2002 Keelan
2002/0042307 A1 4/2002 Deshmukh
2002/0094884 A1 7/2002 Hocknell et al.
2002/0107087 A1 8/2002 Fagot
2003/0087709 A1 5/2003 Mccabe
2003/0139226 A1 7/2003 Cheng et al.
2003/0194548 A1 10/2003 McLeod et al.
2004/0043830 A1 3/2004 Imamoto
2004/0082401 A1 4/2004 Takeda
2004/0092331 A1 5/2004 Best
2004/0110575 A1 6/2004 Stites et al.
2004/0204263 A1 10/2004 Fagot et al.
2004/0209704 A1 10/2004 Mahaffey
2004/0224785 A1 11/2004 Hasebe
2004/0242339 A1 12/2004 Gilbert et al.
2004/0266550 A1 12/2004 Gilbert et al.
2005/0009632 A1 1/2005 Schweigert et al.
2005/0014573 A1 1/2005 Lee
2005/0026716 A1 2/2005 Wahl et al.
2005/0043117 A1 2/2005 Gilbert et al.
2005/0054462 A1 3/2005 Breier et al.
2005/0107183 A1 5/2005 Takeda et al.
2005/0119066 A1 6/2005 Stites et al.
2005/0197208 A1 9/2005 Imamoto
2005/0215349 A1 9/2005 Huang et al.
2005/0239569 A1 10/2005 Best et al.
2005/0239570 A1 10/2005 Best et al.
2005/0255936 A1 11/2005 Huang
2005/0277485 A1 12/2005 Hou et al.
2005/0278931 A1 12/2005 Deshmukh et al.
2006/0052185 A1 3/2006 Kawaguchi et al.
2006/0105856 A1 5/2006 Lo
2006/0111200 A1 5/2006 Poynor
2006/0122004 A1 6/2006 Chen et al.
2006/0199666 A1 9/2006 De La
2006/0229141 A1 10/2006 Galloway
2006/0240909 A1 10/2006 Breier et al.
2006/0258482 A1 11/2006 Cackett et al.
2007/0032308 A1 2/2007 Fagot et al.
2007/0129166 A1 6/2007 Shimazaki et al.
2007/0225084 A1 9/2007 Schweigert et al.
2007/0249431 A1 10/2007 Lin
2008/0022502 A1 1/2008 Tseng
2008/0058113 A1 3/2008 Nicolette et al.
2008/0188322 A1 8/2008 Anderson et al.
2008/0194355 A1 8/2008 Liu
2008/0300065 A1 12/2008 Schweigert
2008/0305888 A1 12/2008 Tseng
2008/0308212 A1 12/2008 Sheasley et al.
2008/0318705 A1 12/2008 Clausen et al.
2009/0011858 A1 1/2009 Binette et al.
2009/0029790 A1 1/2009 Nicolette et al.
2009/0042665 A1 2/2009 Morales et al.
2009/0048370 A1 2/2009 Lutz et al.
2009/0069908 A1 3/2009 Butler, Jr. et al.
2009/0163295 A1 6/2009 Tseng
2009/0280923 A1 11/2009 Park et al.
2010/0130306 A1 5/2010 Schweigert
2010/0178999 A1 7/2010 Nicolette et al.
2011/0070970 A1 3/2011 Wan
2011/0111883 A1 5/2011 Cackett
2011/0165963 A1 7/2011 Cackett et al.
2011/0207551 A1 8/2011 Breier et al.
2011/0269567 A1 11/2011 Ban et al.
2011/0281665 A1 11/2011 Kawaguchi et al.
2011/0294596 A1 12/2011 Ban
2012/0020615 A1 1/2012 Zhang et al.
2012/0071270 A1 3/2012 Nakano
2012/0211161 A1 8/2012 Lutz et al.
2012/0277027 A1 11/2012 Rice et al.
2013/0137532 A1 5/2013 Deshmukh et al.
2013/0225319 A1 8/2013 Kato
2013/0266813 A1 10/2013 Faulkner
2013/0281226 A1 10/2013 Ban
2013/0288823 A1 10/2013 Hebreo
2013/0303303 A1 11/2013 Ban
2013/0310192 A1 11/2013 Wahl et al.
2013/0324294 A1 12/2013 Oldknow et al.
2013/0331201 A1 12/2013 Wahl et al.
2013/0344976 A1 12/2013 Stites
2014/0038737 A1 2/2014 Roach et al.
2014/0045605 A1 2/2014 Fujiwara et al.
2014/0080621 A1 3/2014 Nicolette et al.
2014/0113983 A1 4/2014 Czaplicki et al.
2014/0128175 A1 5/2014 Jertson et al.
2014/0274441 A1 9/2014 Greer
2014/0274442 A1 9/2014 Honea et al.
2014/0274451 A1 9/2014 Knight et al.
2014/0274454 A1 9/2014 Snyder
2014/0364248 A1 12/2014 Wahl et al.
2015/0045141 A1 2/2015 Myrhum et al.
2015/0126305 A1 5/2015 Stokke et al.
2015/0192116 A1 7/2015 Haug et al.
2016/0038799 A1 2/2016 De La et al.
2016/0045793 A1 2/2016 Cardani et al.
2016/0160092 A1 6/2016 Awkal et al.
2017/0239533 A1 8/2017 Cole et al.
2017/0282026 A1 10/2017 Parsons et al.
2017/0282027 A1 10/2017 Parsons et al.
2017/0368429 A1 12/2017 Parsons et al.
2018/0028882 A1 2/2018 Hebreo et al.
2018/0028883 A1 2/2018 Morin et al.
2018/0050243 A1 2/2018 Parsons et al.
2018/0050244 A1 2/2018 Parsons et al.
2018/0133567 A1 5/2018 Parsons et al.
2018/0140910 A1 5/2018 Parsons et al.
2018/0169488 A1 6/2018 Parsons et al.
2018/0221727 A1 8/2018 Parsons et al.
2018/0236325 A1 8/2018 Parsons et al.
2018/0296885 A1 10/2018 Nakamura et al.
2018/0296887 A1 10/2018 Motokawa
2019/0232125 A1 8/2019 Parsons et al.
2019/0232126 A1 8/2019 Nicolette

(56) References Cited

U.S. PATENT DOCUMENTS

| | | | |
|---|---|---|---|
| 2019/0240549 | A1 | 8/2019 | Parsons et al. |
| 2019/0247727 | A1 | 8/2019 | Parsons et al. |
| 2020/0171360 | A1 | 6/2020 | Parsons et al. |
| 2020/0171363 | A1 | 6/2020 | Parsons et al. |
| 2020/0179773 | A1 | 6/2020 | Parsons et al. |
| 2020/0246666 | A1 | 8/2020 | Parsons et al. |
| 2020/0346082 | A1 | 11/2020 | Parsons et al. |
| 2020/0353326 | A1 | 11/2020 | Parsons et al. |
| 2021/0008420 | A1 | 1/2021 | Parsons et al. |

FOREIGN PATENT DOCUMENTS

| | | | |
|---|---|---|---|
| CN | 1762514 | A | 4/2006 |
| CN | 1302216 | C | 2/2007 |
| CN | 101031342 | A | 9/2007 |
| CN | 101754786 | A | 6/2010 |
| CN | 201658798 | U | 12/2010 |
| CN | 102143783 | A | 8/2011 |
| CN | 202087021 | U | 12/2011 |
| CN | 203108126 | U | 8/2013 |
| DE | 29715997 | U1 | 2/1998 |
| EP | 1955740 | A1 | 8/2008 |
| GB | 2249031 | A | 4/1992 |
| JP | S51140374 | A | 12/1976 |
| JP | H0241003 | U | 3/1990 |
| JP | H0284972 | U | 7/1990 |
| JP | H08257181 | A | 10/1996 |
| JP | H10127832 | A | 5/1998 |
| JP | H10277187 | A | 10/1998 |
| JP | H119742 | A | 1/1999 |
| JP | 2001346924 | A | 12/2001 |
| JP | 2002143356 | A | 5/2002 |
| JP | 2002535056 | A | 10/2002 |
| JP | 2004313777 | A | 11/2004 |
| JP | 2005218510 | A | 8/2005 |
| JP | 2005287679 | A | 10/2005 |
| JP | 2006223331 | A | 8/2006 |
| JP | 2007044445 | A | 2/2007 |
| JP | 2007136068 | A | 6/2007 |
| JP | 2008173314 | A | 7/2008 |
| JP | 3158662 | U | 4/2010 |
| JP | 2010069106 | A | 4/2010 |
| JP | 2010530782 | A | 9/2010 |
| JP | 2013027587 | A | 2/2013 |
| JP | 2013043091 | A | 3/2013 |
| WO | 9215374 | A1 | 9/1992 |

OTHER PUBLICATIONS

Calsac Corporation—Thermoplastic Polyurethane (Year: 2019).

International Search Report and Written Opinion Issued in Connection with Corresponding Application No. PCT/US2019/026099, dated May 7, 2019 (7 pages).

International Search Report and Written Opinion received in connection with corresponding application No. PCT/US16/16626, dated Oct. 23, 2016 (12 pages).

International Search Report and Written Opinion received in connection with corresponding application No. PCT/US2015/016666, dated May 14, 2015 (8 pages).

International Search Report and Written Opinion Received in Connection With Corresponding Application No. PCT/US2020/021869, dated May 14, 2020 (12 Pages).

International Search Report and Written Opinion Received in Connection With Corresponding PCT Application Serial No. PCT/US16/42075 dated Sep. 22, 2016 (13 Pages).

International Search Report and Written Opinion Received in Connection With Corresponding PCT Application Serial No. PCT/US18/23617 dated May 31, 2018 (19 Pages).

International Search Report and Written Opinion Received in Connection With Corresponding PCT Application Serial No. PCT/US19/54104 dated Dec. 30, 2019 (10 Pages).

International Search Report and Written Opinion Received in Connection With Corresponding PCT Application Serial No. PCT/US2019/017464 dated Apr. 29, 2019 (9 Pages).

International Search Report and Written Opinion Received in Connection With the Corresponding Application No. PCT/US14/71250, dated Mar. 12, 2015 (6 Pages).

Kozuchowski, Zak, "Callaway Mack Daddy 2 PM Grind Wedges" (http://www.golfwrz.com/276203/callaway-mack-daddy-2-pm-grind-wedges/),www.golfwrx.com, GolfWRX Holdings, LLC, published Jan. 21, 2015.

Rocketbladez Press Release, "Golfballed", http://golfballed.com/index.php?option=com_content&view=article&id=724:taylormade- . . . Oct. 13, 2017, Published Jan. 3, 2013.

Taylor Made Golf Company, Inc., https://taylormadegolf.com/on/demandware.static/-/sites-tmag-library/default/v1459859109590/docs/productspecs/tm_s2013_catalog18.pdf., Published Jan. 2013.

U.S. Appl. No. 29/512,313, Nicolette, "Golf Club Head," filed Dec. 18, 2014.

Wall, Jonathan, "Details: Phil's Prototype Mack Daddy PM-Grind Wedge," (http:/www.pgatour.com/equipmentreport/2015/01/21/callaway-wedge.html), www.pgatour.com, PGA Tour, Inc., Published Jan. 21, 2015.

* cited by examiner

GOLF CLUB HEADS AND METHODS TO MANUFACTURE GOLF CLUB HEADS

CROSS REFERENCE

This application is a continuation of application Ser. No. 17/205,778, filed Mar. 18, 2021.

This application is a continuation-in-part of application Ser. No. 17/155,486, filed Jan. 22, 2021, which is a continuation of application Ser. No. 16/774,449, filed Jan. 28, 2020, now U.S. Pat. No. 10,926,142, which is a continuation of application Ser. No. 16/179,406, filed Nov. 2, 2018, now U.S. Pat. No. 10,583,336, which claims the benefit of U.S. Provisional Application No. 62/581,456, filed Nov. 3, 2017.

This application is a continuation-in-part of application Ser. No. 17/505,795, filed Oct. 20, 2021, which is a continuation of application Ser. No. 17/038,195 filed Sep. 30, 2020, now U.S. Pat. No. 11,173,359, which is a continuation of application Ser. No. 16/365,343, filed Mar. 26, 2019, now U.S. Pat. No. 10,821,340, which is a continuation of application Ser. No. 15/841,022, filed Dec. 13, 2017, now U.S. Pat. No. 10,265,590, which is a continuation of application Ser. No. 15/701,131, filed Sep. 11, 2017, now abandoned, which is a continuation-in-part of application Ser. No. 15/685,986, filed Aug. 24, 2017, now U.S. Pat. No. 10,279,233, which is a continuation of application Ser. No. 15/628,251, filed Jun. 20, 2017, now abandoned, which is a continuation of application Ser. No. 15/209,364, filed on Jul. 13, 2016, now U.S. Pat. No. 10,293,229, which is a continuation of International Application No. PCT/US15/16666, filed Feb. 19, 2015, which claims the benefit of U.S. Provisional Application No. 61/942,515, filed Feb. 20, 2014, U.S. Provisional Application No. 61/945,560, filed Feb. 27, 2014, U.S. Provisional Application No. 61/948,839, filed Mar. 6, 2014, U.S. Provisional Application No. 61/952,470, filed Mar. 13, 2014, U.S. Provisional Application No. 61/992,555, filed May 13, 2014, U.S. Provisional Application No. 62/010,836, filed Jun. 11, 2014, U.S. Provisional Application No. 62/011,859, filed Jun. 13, 2014, and U.S. Provisional Application No. 62/032,770, filed Aug. 4, 2014.

U.S. application Ser. No. 15/209,364, filed on Jul. 13, 2016, now U.S. Pat. No. 10,293,229, is also a continuation of application Ser. No. 14/618,501, filed Feb. 10, 2015, now U.S. Pat. No. 9,427,634, which is a continuation of application Ser. No. 14/589,277, filed Jan. 5, 2015, now U.S. Pat. No. 9,421,437, which is a continuation of application Ser. No. 14/513,073, filed Oct. 13, 2014, now U.S. Pat. No. 8,961,336, which is a continuation of application Ser. No. 14/498,603, filed Sep. 26, 2014, now U.S. Pat. No. 9,199,143, which claims the benefits of U.S. Provisional Application No. 62/041,538, filed Aug. 25, 2014.

This application is a continuation-in-part of application Ser. No. 17/458,825, filed Aug. 27, 2021, which is a continuation of application Ser. No. 16/929,552, filed Jul. 15, 2020, now U.S. Pat. No. 11,117,030, which is a continuation of application Ser. No. 15/683,564, filed Aug. 22, 2017, now U.S. Pat. No. 10,716,978, which is a continuation of application Ser. No. 15/598,949, filed May 18, 2017, now U.S. Pat. No. 10,159,876, which is a continuation of application Ser. No. 14/711,596, filed May 13, 2015, now U.S. Pat. No. 9,675,853, which claims the benefit of U.S. Provisional Application No. 62/118,403, filed Feb. 19, 2015, U.S. Provisional Application No. 62/159,856, filed May 11, 2015, U.S. Provisional Application No. 61/992,555, filed May 13, 2014, U.S. Provisional Application No. 62/010,836, filed Jun. 11, 2014, U.S. Provisional Application No. 62/011,859, filed Jun. 13, 2014, U.S. Provisional Application No. 62/032,770, filed Aug. 4, 2014, and U.S. Provisional Application No. 62/041,538, filed Aug. 25, 2014.

U.S. application Ser. No. 17/205,778, filed Mar. 18, 2021, is a continuation-in-part of application Ser. No. 16/376,863, filed Apr. 5, 2019, now abandoned, which is a continuation of application Ser. No. 15/958,288, filed Apr. 20, 2018, now abandoned, which is a continuation of application Ser. No. 15/947,383, filed Apr. 6, 2018, now abandoned, which is a continuation of application Ser. No. 15/842,632, filed Dec. 14, 2017, now U.S. Pat. No. 10,029,159, which is a continuation of application Ser. No. 15/263,018, filed Sep. 12, 2016, now U.S. Pat. No. 9,878,220, which is a continuation of application Ser. No. 15/043,090, filed Feb. 12, 2016, now U.S. Pat. No. 9,468,821, which claims the benefit of U.S. Provisional Application No. 62/209,780, filed Aug. 25, 2015, and U.S. Provisional Application No. 62/277,636, filed Jan. 12, 2016.

U.S. application Ser. No. 17/205,778, filed Mar. 18, 2021, is a continuation-in-part of application Ser. No. 17/038,155, filed Sep. 30, 2020, now U.S. Pat. No. 11,141,633, which is a continuation of application Ser. No. 16/351,143, filed Mar. 12, 2019, now U.S. Pat. No. 10,821,339, which is a continuation of Ser. No. 15/842,583, filed Dec. 14, 2017, now U.S. Pat. No. 10,232,235, which is a continuation of application Ser. No. 15/631,610, filed Jun. 23, 2017, now abandoned, which is a continuation of application Ser. No. 15/360,707, filed Nov. 23, 2016, now U.S. Pat. No. 10,029,158, which is a continuation of application Ser. No. 15/043,106, filed Feb. 12, 2016, now U.S. Pat. No. 9,533,201, which claims the benefit of U.S. Provisional Application No. 62/275,443, filed Jan. 6, 2016, and U.S. Provisional Application No. 62/276,358, filed Jan. 8, 2016.

U.S. application Ser. No. 17/205,778, filed Mar. 18, 2021, is a continuation-in-part of application Ser. No. 16/785,336, filed Feb. 7, 2020, now abandoned, which is a continuation of application Ser. No. 15/703,639, filed Sep. 13, 2017, now U.S. Pat. No. 10,596,424, which is a continuation-in-part of application Ser. No. 15/484,794, filed Apr. 11, 2017, now U.S. Pat. No. 9,814,952, which claims the benefit of U.S. Provisional Application No. 62/321,652, filed Apr. 12, 2016.

This application is a continuation-in-part of application Ser. No. 17/557,242, filed Dec. 21, 20201, which is a continuation of application Ser. No. 16/388,619, filed Apr. 18, 2019, now U.S. Pat. No. 11,235,211, which is a continuation of application Ser. No. 15/842,591, filed Dec. 14, 2017, now abandoned, which is a continuation of International Application No. PCT/US16/42075, filed Jul. 13, 2016, which is a continuation of application Ser. No. 15/188,718, filed Jun. 21, 2016, now U.S. Pat. No. 9,610,481, and U.S. Provisional Application No. 62/343,739, filed May 31, 2016.

This application is a continuation-in-part of application Ser. No. 17/682,476, which is a continuation of application Ser. No. 17/099,362, filed Nov. 16, 2020, now U.S. Pat. No. 11,291,890, which is a continuation of application Ser. No. 16/820,136, filed Mar. 16, 2020, now U.S. Pat. No. 10,874,919, which is a continuation of application Ser. No. 16/590,105, filed Oct. 1, 2019, now U.S. Pat. No. 10,632,349, which claims the benefit of U.S. Provisional Application No. 62/908,467, filed Sep. 30, 2019, U.S. Provisional Application No. 62/903,467, filed Sep. 20, 2019, U.S. Provisional Application No. 62/877,934, filed Jul. 24, 2019, U.S. Provisional Application No. 62/877,915, filed Jul. 24, 2019, U.S. Provisional Application No. 62/865,532, filed Jun. 24, 2019, U.S. Provisional Application No. 62/826,310, filed Mar. 29, 2019, and U.S. Provisional Application No. 62/814,959, filed Mar. 7, 2019.

This application is a continuation-in-part of application Ser. No. 17/178,989, filed Feb. 18, 2021, which is a continuation of application Ser. No. 16/789,167, filed Feb. 12, 2020, now U.S. Pat. No. 10,933,286.

This application is a continuation-in-part of application Ser. No. 17/505,813, filed Oct. 20, 2021, which is a continuation of application Ser. No. 17/161,987, filed Jan. 29, 2021, now U.S. Pat. No. 11,167,187.

The disclosures of the above listed applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG) and/or the moment of inertia (MOI) of the golf club heads may be optimized to produce certain trajectory and spin rate of a golf ball.

Figure 1:
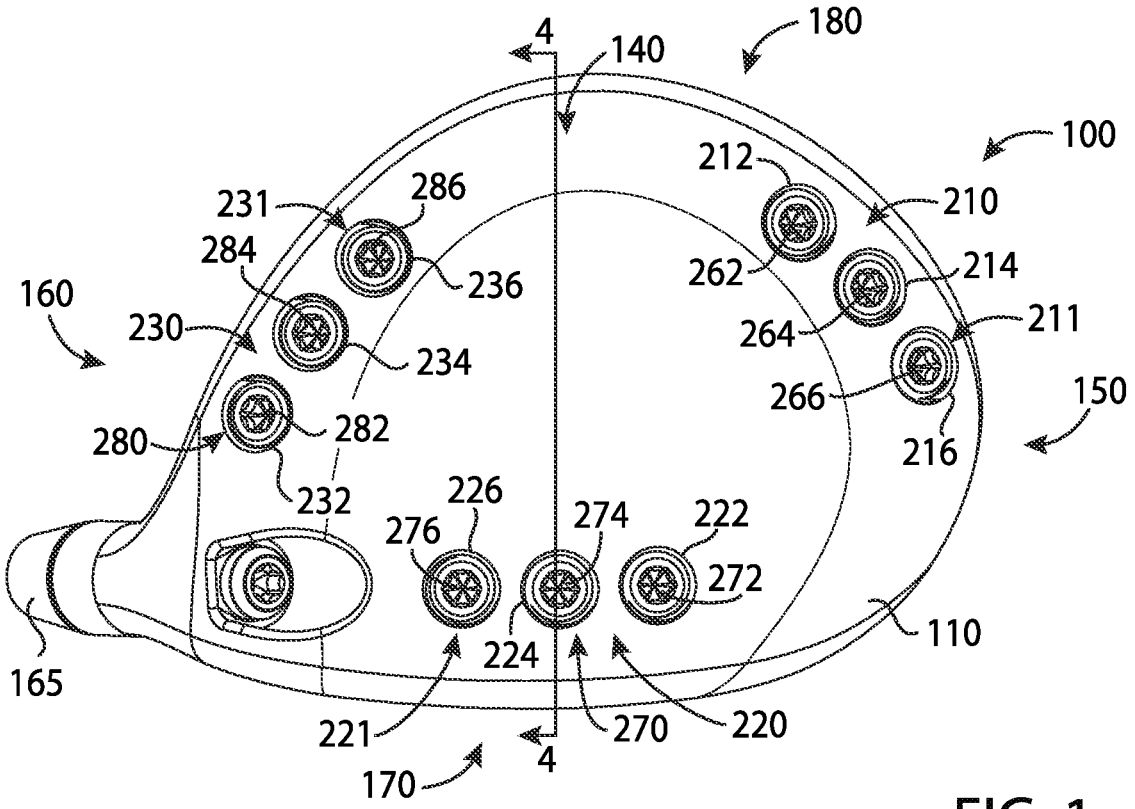
FIGS. 1, 2, 3, and 4 depict a bottom perspective view, a toe-side perspective view, a heel-side perspective view, and a cross-sectional perspective view (along line 4-4 of FIG. 1), respectively, of a golf club head according to an embodiment of the apparatus, methods, and articles of manufacture described herein.
Figure 2:
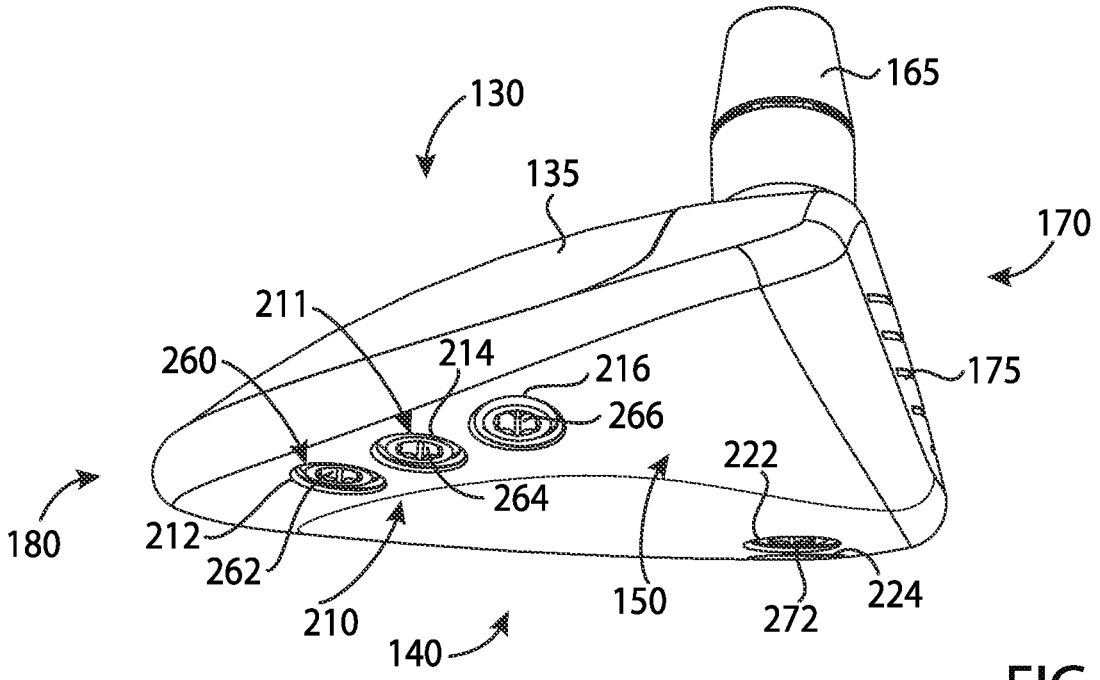
Figure 3:
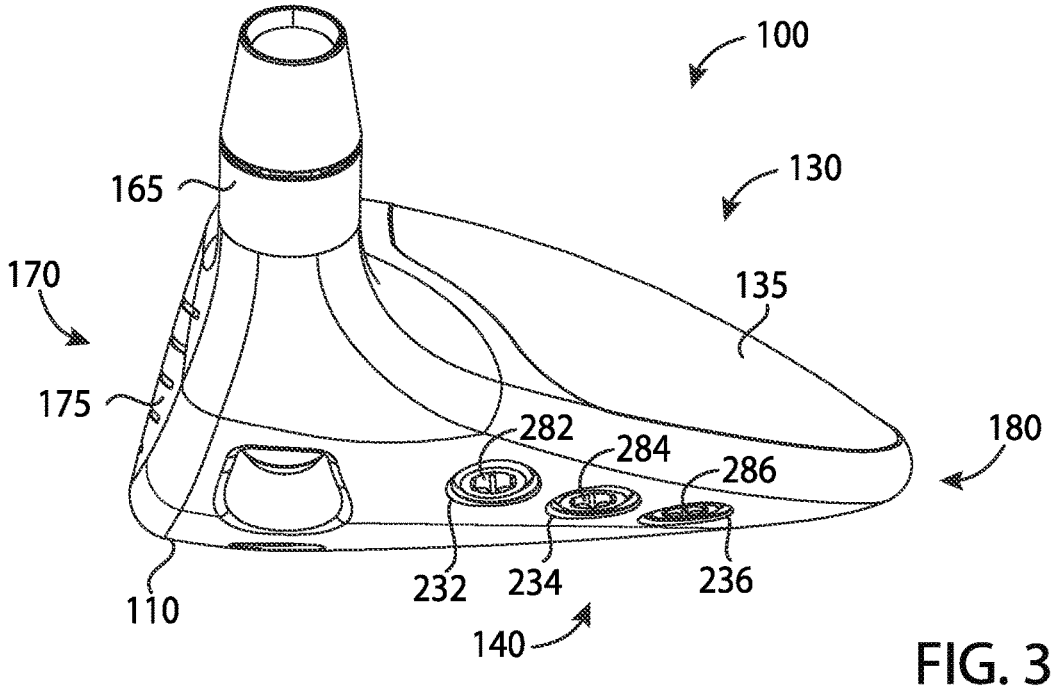

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

In the example of FIGS. 1-4, a golf club head 100 may include a body portion 110 with a top portion 130 having a crown portion 135, a bottom portion 140 with an outer surface 142 and an inner surface 144, a toe portion 150, a heel portion 160, a front portion 170, and a rear portion 180. The crown portion 135 may be a separate piece that may be attached to the top portion 130 and constructed from a composite material. The bottom portion 140 may include a skirt portion (not shown) defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The front portion 170 may include a face portion 175 to engage a golf ball (not shown). The golf club head 100 may have a neutral axis 401. The neutral axis 401 may be perpendicular to the face portion 175 and may intersect a center of the face portion 175. The body portion 110 may also include a hosel portion 165 for receiving a shaft (not shown). Alternatively, the body portion 110 may include a bore instead of the hosel portion 165. The body portion 110 may be made from any one or a combination of materials described herein or described in any of the incorporated by reference applications. A maximum front-to-rear distance of the golf club head 100 may be greater than a maximum heel-to-toe distance of the golf club head 100. Although FIGS. 1-4 may depict a particular type of golf club head (e.g., driver-type club head), the apparatus methods, and articles of manufacture described herein may be applicable to other types of club heads (e.g., a fairway wood-type club head, a hybrid-type club head, an iron-type club head, a putter-type club head). The apparatus, methods, and articles of manufacture described herein are not limited in this regard.

The bottom portion 140 may include a plurality of port regions, which are shown for example as a first port region 210 with a first set of ports 211 (generally shown as ports 212, 214, and 216) near the toe portion 150, a second port region 220 with a second set of ports 221 (generally shown as ports 222, 224, and 226) near the front portion 170, and a third port region 230 with a third set of ports 231 (generally shown as ports 232, 234, and 236) near the heel portion 160. Although FIGS. 1-4 show a certain configuration of port regions and ports, the number of port regions, the number and configuration of ports in each region, and the location of the ports may be similar to any of the golf club heads described herein on in any of the incorporated by reference applications. The body portion 110 may also include a plurality of mass portions, shown as a first set of mass portions 260 (generally shown as mass portions 262, 264, and 266), a second set of mass portions 270 (generally shown as mass portions 272, 274, and 276), and a third set of mass portions 280 (generally shown as mass portions 282, 284 and 286). Each port may interchangeably receive any of the mass portions. The masses of the first set of mass portion 260, the second set of mass portions 270 and/or the third set of mass portions 280 may be similar or different. Accordingly, by using mass portions having similar or different masses in each of the ports of the port regions 210, 220 and/or 230, the overall mass in each port region and/or the mass distribution in each port region may be adjusted as described herein and in any of the incorporated by reference applications to generally optimize and/or adjust the swing weight, center of gravity, moment of inertia, and/or an overall feel of the golf club head for an individual using the golf club head 100. The apparatus, methods, and articles of manufacture described herein are not limited in this regard.

Figure 4:
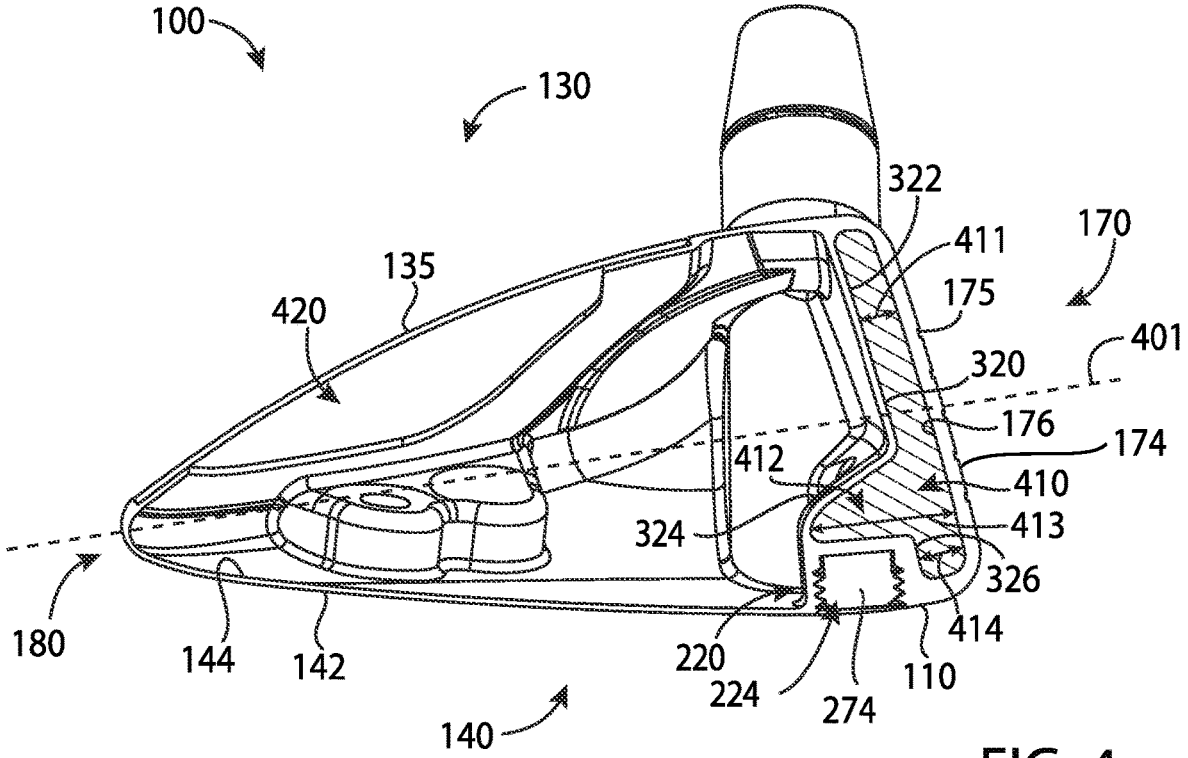

Certain regions of the interior of the body portion 110 may include a polymer material, which may also be referred to herein as the filler material, similar to any of the polymer materials described herein or described in any of the incorporated by reference applications. The filler material may dampen vibration, dampen noise, lower the center of gravity and/or provide a better feel and sound for the golf club head 100 when striking a golf ball (not shown). The golf club head 100, may have one or more interior regions and/or cavities that may include a filler material similar to any of the golf club heads described herein or described in any of the incorporated by reference applications. In one example, as shown in FIG. 4, the body portion 110 may include a cavity wall portion 320. The cavity wall portion 320 may form a first interior cavity portion 410 and a second interior cavity portion 420 within the body portion 110. The first interior cavity portion 410 and the second interior cavity portion 420 may be separated by the cavity wall portion 320. Alternatively, the first interior cavity portion 410 and the second interior cavity portion 420 may be connected through one or more openings in the cavity wall portion 320. The apparatus, methods, and articles of manufacture described herein are not limited in this regard.

As illustrated in FIG. 4, the cavity wall portion 320 may include a first wall portion 322 extending from a location at or proximate to the top portion 130 toward the bottom portion 140. The first wall portion 322 may extend toward the bottom portion 140 at a certain angle or orientation relative to the face portion 175. In one example, the first wall portion 322 may extend toward the bottom portion 140 and away from the face portion 175. Accordingly, a first width 411 ($W_{C1}$) of the first interior cavity portion 410 may increase in a direction from the top portion 130 to the bottom portion 140. In another example, the first wall portion 322 may extend toward the bottom portion 140 and toward the face portion 175. Accordingly, the first width 411 of the first interior cavity portion 410 may decrease in a direction from the top portion 130 to the bottom portion 140. In the illustrated example of FIG. 4, the first wall portion 322 of the of the cavity wall portion 320 may extend from a location at or proximate to the top portion 130 generally parallel or substantially parallel with the face portion 175. Accordingly, the first width 411 of the first interior cavity portion 410 may be constant or substantially constant. The apparatus, methods, and articles of manufacture described herein are not limited in this regard.

The first interior cavity portion 410 may include an enlarged cavity portion 412 between the top portion 130 and the bottom portion 140. As shown in the illustrated example of FIG. 4, the enlarged cavity portion 412 extends partially or fully over the second port region 220. Accordingly, the enlarged cavity portion 412 may have a second width 413 ($W_{C2}$) of the first interior cavity portion 410 that may be greater than the first width 411 of the first interior cavity portion 410. The second width 413 may be about two times greater than the first width 411. The second width 413 may be at least two times greater than the first width 411. The enlarged cavity portion 412 may be located at least partially below the neutral axis 401 of the golf club head 100. The enlarged cavity portion 412 may be located wholly below a neutral axis 401 of the golf club head 100. The first width 411 may be located above the neutral axis 401. The second width 413 may be located below the neutral axis 401. The enlarged cavity portion 412 may be defined by a second wall portion 324 that may extend from the first wall portion 322 toward the rear portion 180 and the bottom portion 140, and traverse back over the second port region 220. The first interior cavity portion 410 may include a third wall portion 326 that extends from the second wall portion 324 to a location at or proximate to the bottom portion 140. The first interior cavity portion 410 may have a third width 414 ($W_{C3}$) extending from the third wall portion 326 to the back surface 176 of the face portion 175. The third width 414 may be located below the enlarged cavity portion 412. The third width 414 may be located below the second width 413. The third width 414 may be less than the second width 413. The third width 414 may be substantially equal to the first width 411. As shown in the illustrated example of FIG. 4, the third width 414 may be located between the second port region 220 and the face portion 175. The third width 414 may be located proximate to the bottom portion 140. In another example, the first width 411 may be similar to the second width 413 of the first interior cavity portion 410 (not shown). Accordingly, the first wall portion 322 of the cavity wall portion 320 may located farther back toward the rear portion 180 than the location of the first wall portion 322 shown in FIG. 4 such that the portion of the first interior cavity portion 410 above the second port region 220 extends over the one or more ports of the second port region 220. In other examples, the first interior cavity portion 410 may be configured similar any of the interior cavities described herein and shown in FIGS. 5-13. The apparatus, methods, and articles of manufacture described herein are not limited in this regard.

In one example, the first interior cavity portion 410 may be unfilled (i.e., empty space). Alternatively, the first interior cavity portion 410 may be partially (i.e., less than 100% filled) or entirely filled with a filler material (i.e., a cavity filling portion) to absorb shock, isolate vibration, dampen noised, and/or provide structural support for the face portion. For example, at least 50% of the first interior cavity portion 410 may be filled with a TPE material to absorb shock, isolate vibration, and/or dampen noise when the golf club head 100 strikes a golf ball via the face portion 175. In one example, the first interior cavity portion 410 may be partially or entirely filled with a filler material through a port (e.g. port 224) located in the bottom portion 140. In one example, as shown in FIG. 4, the port 224 may include an opening that accesses the first interior cavity portion 410. The opening may provide a fluid pathway for filler material to be introduced to the first interior cavity portion 410. The apparatus, methods, and articles of manufacture described herein are not limited in this regard.

When the face portion 175 of the golf club head 100 strikes a golf ball, the face portion 175 and the filler material may deform and/or compress. The kinetic energy of the impact may be transferred to the face portion 175 and/or the filler material. For example, some of the kinetic energy may be transformed into heat by the filler material or work done in deforming and/or compressing the filler material. Further, some of the kinetic energy may be transferred back to the golf ball to launch the golf ball at a certain velocity. A filler material with a relatively higher COR may transfer relatively more kinetic energy to the golf ball and dissipate relatively less kinetic energy. Accordingly, a filler material with a relatively high COR may generate relatively higher golf ball speeds because a relatively greater part of the kinetic energy of the impact may be transferred back to the golf ball to launch the golf ball from the golf club head 100. The apparatus, methods, and articles of manufacture described herein are not limited in this regard.

With the support of the cavity wall portion 320 to form the first interior cavity portion 410 and filling at least a portion of the first interior cavity portion 410 with a filler material, the face portion 175 may be relatively thin without degrading the structural integrity, sound, and/or feel of the golf club head 100. In one example, the face portion 175 may have a thickness of less than or equal to 0.075 inch (e.g., a distance between a front surface 174 and the back surface 176). In another example, the face portion 175 may have a thickness of less than or equal to 0.2 inch. In another example, the face portion 175 may have a thickness of less than or equal to 0.06 inch. In yet another example, the face portion 175 may have a thickness of less than or equal to 0.05 inch. Further, the face portion 175 may have a thickness of less than or equal to 0.03 inch. In yet another example, a thickness of the face portion 175 may be greater than or equal to 0.03 inch and less than or equal to 0.2 inch. The apparatus, methods, and articles of manufacture described herein are not limited in this regard.

In the illustrated example of FIGS. 1-4, the second interior cavity portion 420 may be unfilled (i.e., empty space). Alternatively (not shown), the second interior cavity portion 420 may be partially or entirely filled with a filler material (i.e., a cavity filling portion), which may include one or more similar or different types of materials described herein and may be different or similar to the filler material used to fill the first interior cavity portion 410. The apparatus, methods, and articles of manufacture described herein are not limited in this regard.

Figure 5:
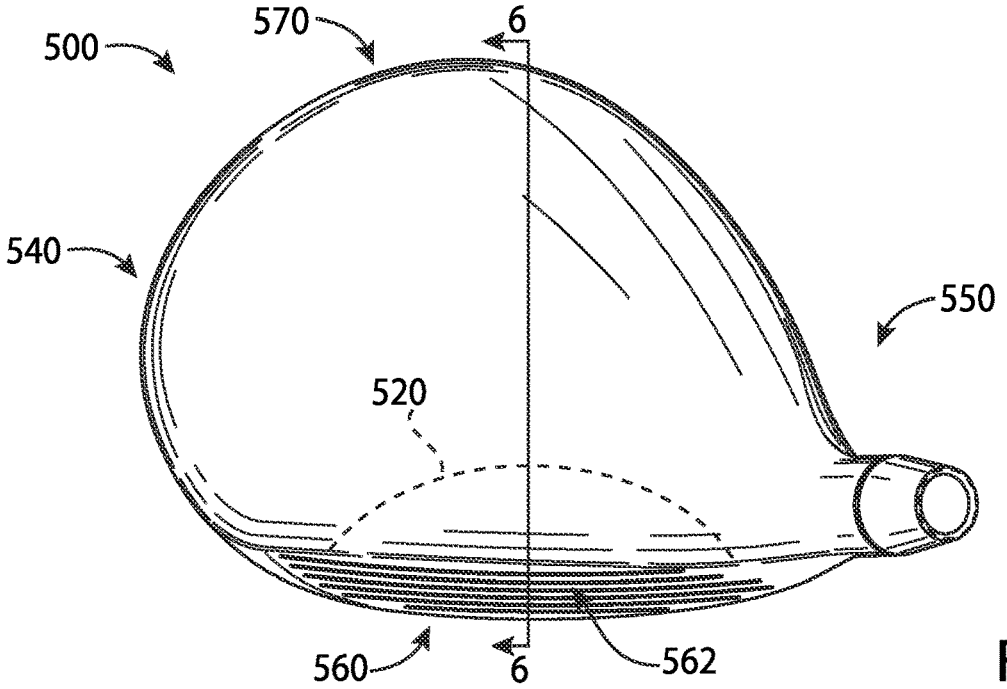
FIGS. 5, 6, and 7 depict a top view, a schematic cross-sectional view (along line 6-6 of FIG. 5), and a front view, respectively, of a golf club head according to an embodiment of the apparatus, methods, and articles of manufacture described herein.
Figure 6:
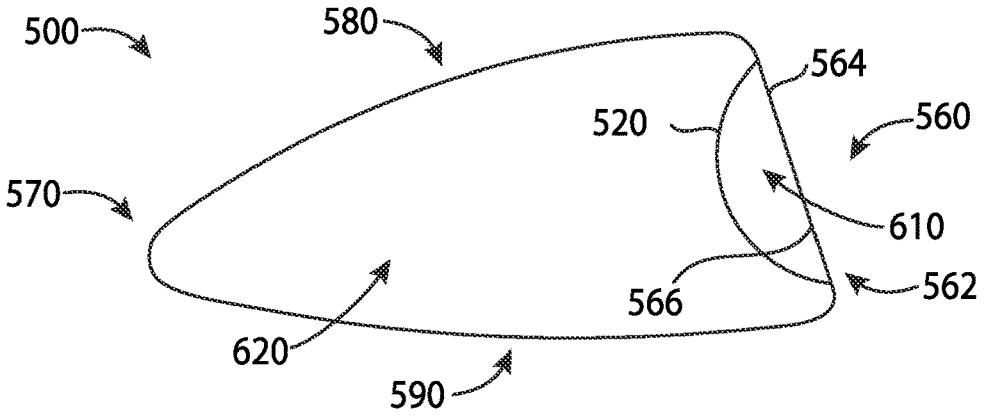
Figure 7:
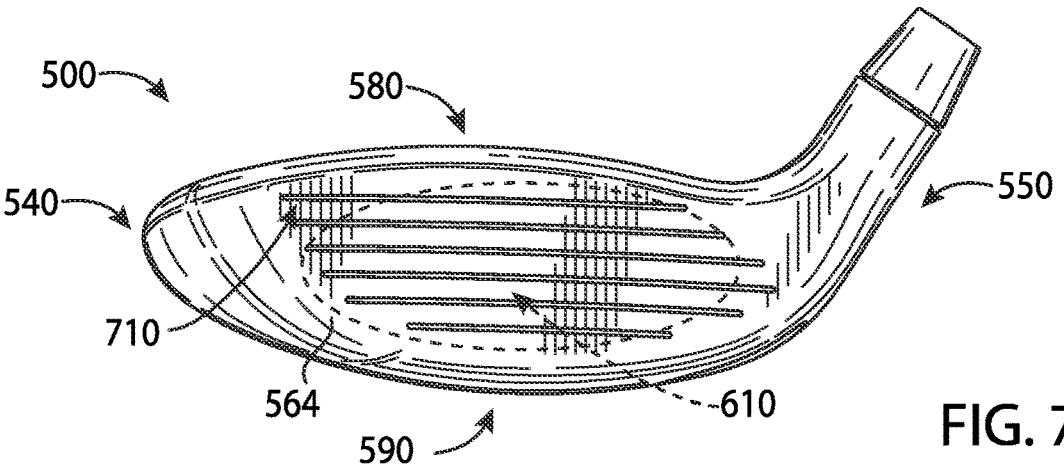

While each of the examples herein may describe a certain type of golf club head, the apparatus, methods, and articles of manufacture described herein may be applicable to other types of golf club heads. Referring to FIGS. 5-7, for example, a golf club head 500 may include a body portion 510 and a cavity wall portion 520. Although FIGS. 5-7 may depict a particular type of club head (e.g., a fairway wood-type club head), the apparatus, methods, and articles of manufacture described herein may be applicable to other types of club head (e.g., a driver-type club head, a hybrid-type club head, an iron-type club head, a putter-type club head, etc.). The apparatus, methods, and articles of manufacture described herein are not limited in this regard.

The body portion 510 may include a toe portion 540, a heel portion 550, a front portion 560, a rear portion 570, a top portion 580 (e.g., a crown portion), and a bottom portion 590 (e.g., a sole portion). The front portion 560 may include a face portion 562 (e.g., a strike face). The face portion 562 may include a front surface 564 and a back surface 566. The front surface 564 may include a plurality of grooves, generally shown as 710 in FIG. 7. The cavity wall portion 520 may form a first interior cavity portion 610 and a second interior cavity portion 620 within the body portion 510. As illustrated in FIG. 6, for example, the cavity wall portion 520 may extend from the back surface 566 of the face portion 562. The cavity wall portion 520 may be a single curved wall section. In particular, the cavity wall portion 520 may have a convex arc profile relative to the back surface 566 (e.g., C shape) to form a dome-like structure with an elliptical base (e.g., FIG. 7) or a circular base on the back surface 566. In another example, the cavity wall portion 520 may form a cone-like structure or a cylinder-like structure with the body portion 510. Alternatively, the cavity wall portion 520 may be a concave arc profile relative to the back surface 566. The apparatus, methods, and articles of manufacture described herein are not limited in this regard.

The first interior cavity portion 610 may be partially or entirely filled with a suitable filler material such as any of the filler materials described herein or described in any of the incorporated by reference applications to absorb shock, isolate vibration, dampen noise, and/or provide structural support. The elastic polymer material may be injected into the first interior cavity portion 610 via an injection molding process via a port on the face portion 562. With the support of the cavity wall portion 520 to form the first interior cavity portion 610 and filling at least a portion of the first interior cavity portion 610 with an elastic polymer material, the face portion 562 may be relatively thin without degrading the structural integrity, sound, and/or feel of the golf club head 500. The apparatus, methods, and articles of manufacture described herein are not limited in this regard.

Figure 8:
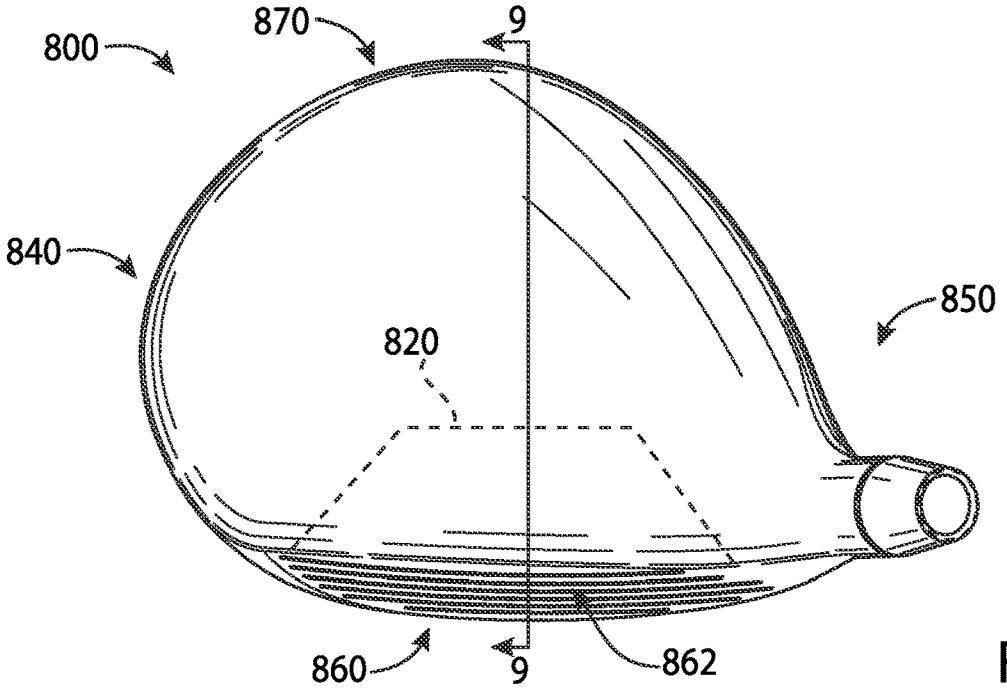
FIGS. 8, 9, and 10 depict a top view, a schematic cross-sectional view (along line 9-9 of FIG. 8), and a front view, respectively, of a golf club head according to an embodiment of the apparatus, methods, and articles of manufacture described herein.
Figure 9:
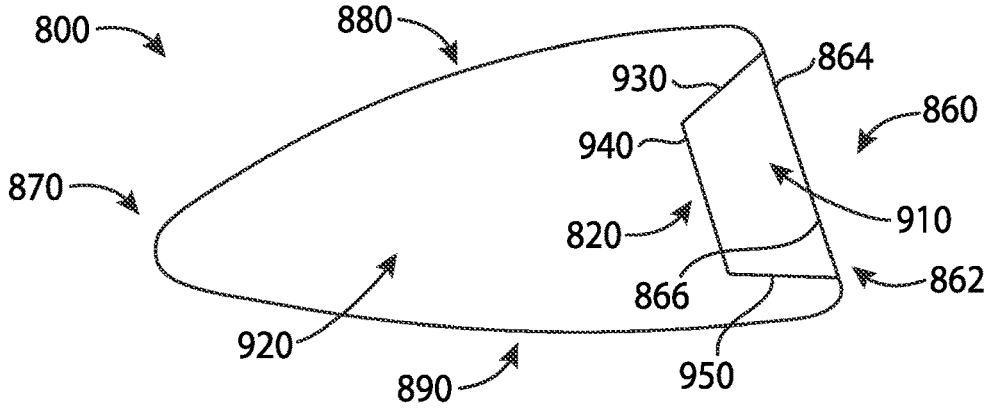
Figure 10:
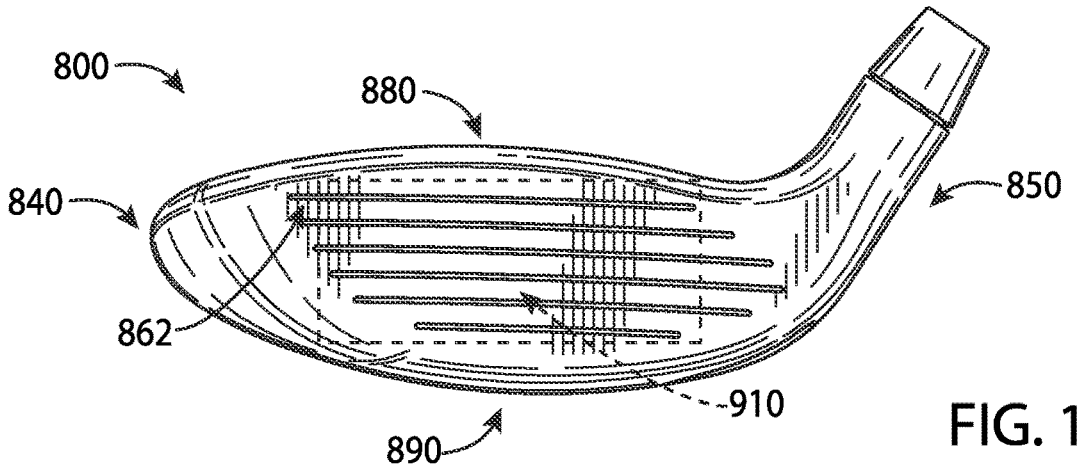

The cavity wall portion 520 may include multiple sections. Turning to FIGS. 8-10, for example, a golf club head 800 may include a body portion 810 and a cavity wall portion 820. The body portion 810 may include a toe portion 840, a heel portion 850, a front portion 860, a rear portion 870, a top portion 880 (e.g., a crown portion), and a bottom portion 890 (e.g., a sole portion). The front portion 860 may include a face portion 862 (e.g., a strike face) with a front surface 864 and a back surface 866. The cavity wall portion 820 may extend from the back surface 866 to form a first interior cavity portion 910 and a second interior cavity portion 920 within the body portion 810. The cavity wall portion 820 may include two or more wall sections, generally shown as 930, 940, and 950 in FIG. 9. Similar to the first interior cavity portion 610 (FIGS. 5-7), the first interior cavity portion 910 may be partially or entirely filled with a filler material. The filler material may be injected into the first interior cavity portion 910 via an injection molding process via a port on the face portion 862. The apparatus, methods, and articles of manufacture described herein are not limited in this regard.

Figure 11:
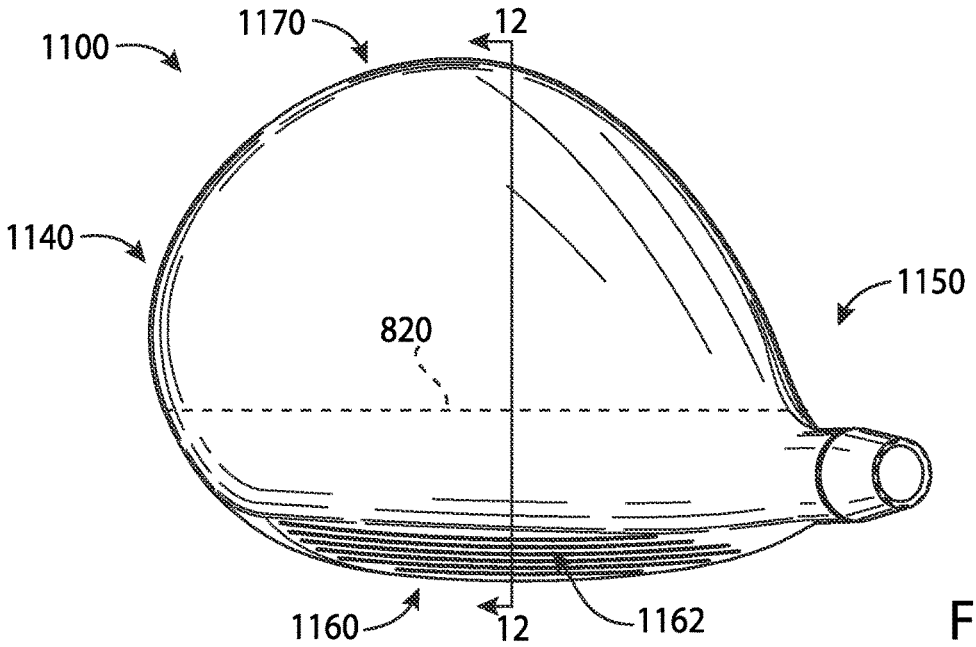
FIGS. 11, 12, and 13 depict a top view, a schematic cross-sectional view (along line 12-12 of FIG. 11), and another schematic cross-sectional view (along line 12-12 of FIG. 11), respectively, of a golf club head according to an embodiment of the apparatus, methods, and articles of manufacture described herein.
Figure 12:
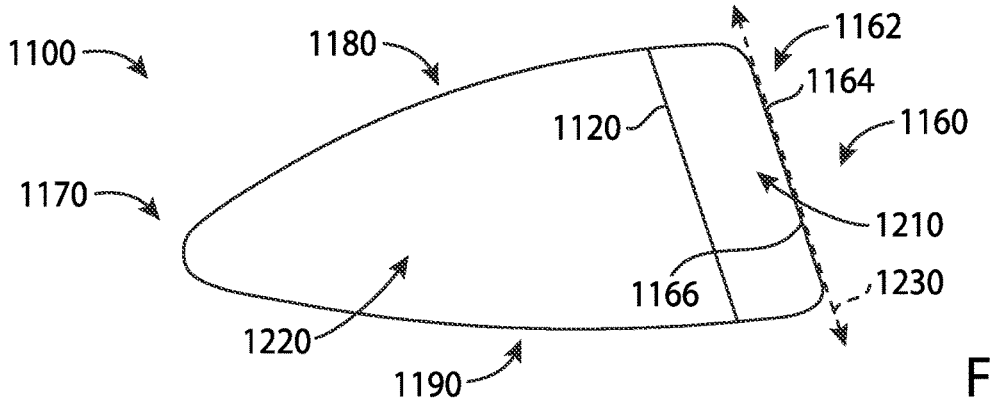
Figure 13:
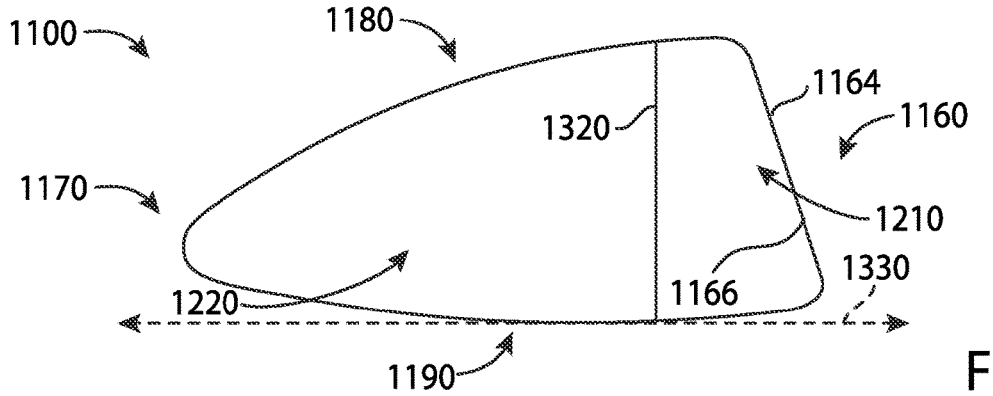
Figure 14:
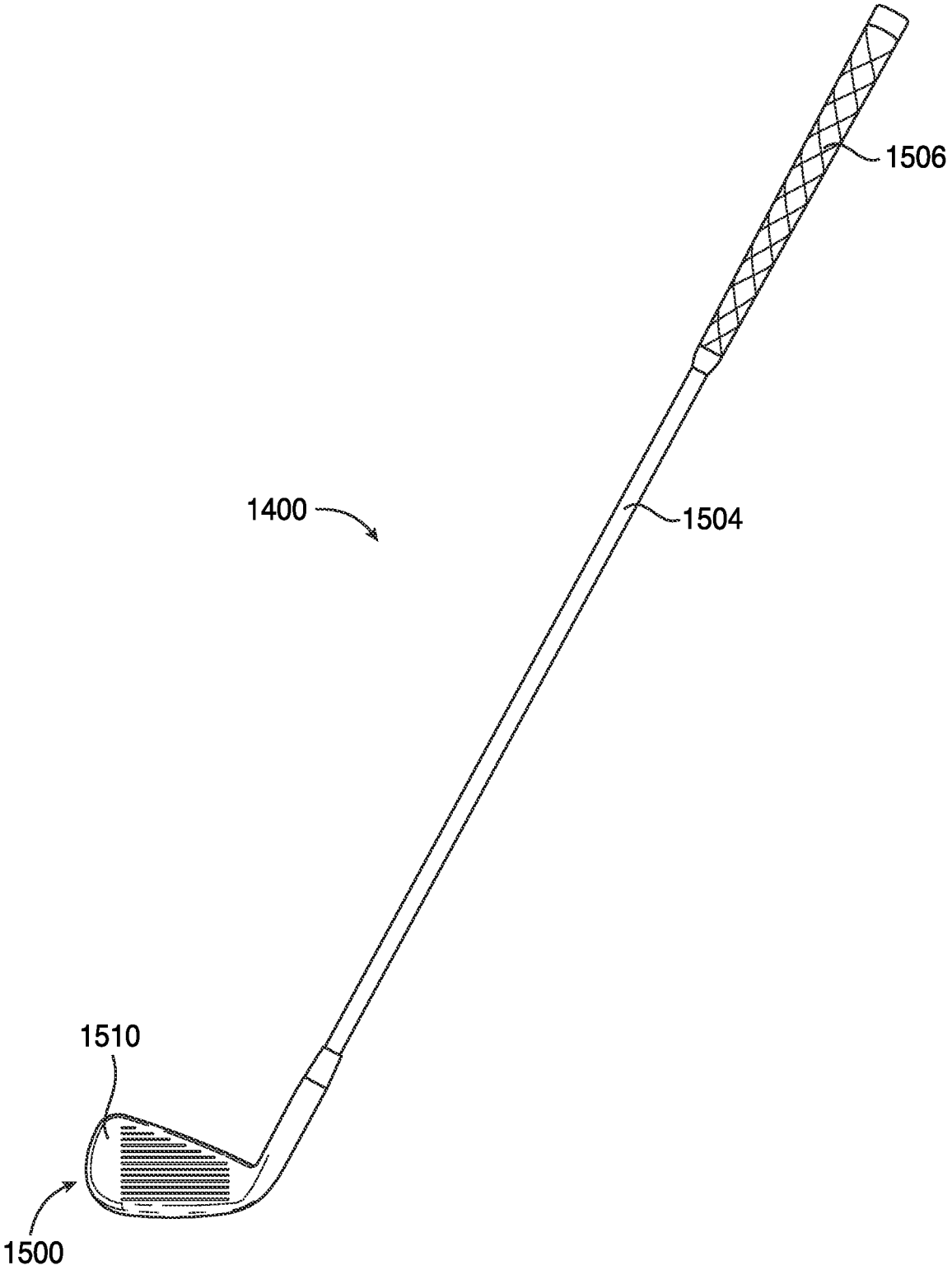
FIG. 14 depicts a front view of a golf club according to an embodiment of the apparatus, methods, and articles of manufacture described herein.

As illustrated in FIGS. 11 and 12, for example, a golf club head 1100 may include a body portion 1110 and a cavity wall portion 1120. The body portion 1110 may include a toe portion 1140, a heel portion 1150, a front portion 1160, a rear portion 1170, a top portion 1180 (e.g., a crown portion), and a bottom portion 1190 (e.g., a sole portion). The front portion 1160 may include a face portion 1162 (e.g., a strike face) with a front surface 1164 and a back surface 1166. The face portion 1162 may be associated with a loft plane 1230 that defines the loft angle of the golf club head 1100. The cavity wall portion 1120 may be a single flat wall section. In particular, the cavity wall portion 1120 may extend between the toe portion 1140 and the heel portion 1150 and between the top portion 1180 and the bottom portion 1190 to form a first interior cavity portion 1210 and a second interior cavity portion 1220 within the body portion 1110. The cavity wall portion 1120 may be parallel or substantially parallel to the loft plane 1230. Alternatively, as shown in FIG. 13, a cavity wall portion 1320 may be perpendicular or substantially perpendicular to a ground plane 1330. Similar to the interior cavity portion 610 (FIGS. 5-7) and interior cavity portion 910 (FIGS. 8-10), the first interior cavity portion 1210 may be partially or entirely filled with an elastic polymer or elastomer material. The elastic polymer material may be injected into the first interior cavity portion 1210 via an injection molding process via a port on the face portion 1162 and/or the bottom portion 1190 as described herein or described in any of the incorporated by reference applications. The apparatus, methods, and articles of manufacture described herein are not limited in this regard.

Alternatively, the cavity wall portion 1120 may extend between the bottom portion 1190 and a top-and-front transition region (i.e., a transition region between the top portion 1180 and the front portion 1160) so that the cavity wall portion 1120 and the loft plane 1230 may not be parallel to each other. In another example, the cavity wall portion 1120 may extend between the top portion 1180 and a bottom-and-front transition region (i.e., a transition region between the bottom portion 1190 and the front portion 1160) so that the cavity wall portion 1120 and the loft plane 1230 may be not parallel to each other. Although FIGS. 11-13, may depict the cavity wall portions 1120 and 1320 being flat or substantially flat, the cavity wall portions 1120 and/or 1320 may be concave or convex relative to the face portion 1162. The apparatus, methods, and articles of manufacture described herein are not limited in this regard.

While above examples may describe a cavity wall portion dividing an interior cavity of a hollow body portion to form two separate interior cavities with one interior cavity partially or entirely filled with an elastic polymer material, the apparatus, methods, and articles of manufacture described herein may include two or more cavity wall portions dividing an interior cavity of a hollow body portion to form three or more separate interior cavities with at least two interior cavities partially or entirely filled with an elastic polymer material. In one example, one interior cavity may be partially or entirely filled with a TPE material whereas another interior cavity may be partially or entirely filled with a TPU material. The apparatus, methods, and articles of manufacture described herein are not limited in this regard.

In the example of FIGS. 14-32, a golf club 1400 may include a golf club head 1500, a shaft 1504, and a grip 1506. The golf club head 1500 may be attached to one end of the shaft 1504 and the grip 1506 may be attached to the opposite end of the shaft 1504. An individual can hold the grip 1506 and swing the golf club head 1500 with the shaft 1504 to strike a golf ball (not shown). The golf club head 1500 may include a body portion 1510, and two or more weight portions, generally shown as a first set of weight portions 1720 (e.g., shown as weight portions 1721, 1722, 1723, and 1724) and a second set of weight portions 1730 (e.g., shown as weight portions 1731, 1732, 1733, 1734, 1735, 1736, and 1737). The body portion 1510 may include a toe portion 1540 with a toe portion edge 1541, a heel portion 1550 with a heel portion edge 1551, a front portion 1560, a back portion 1570, a top portion 1580 with a top portion edge 1581, and a sole portion 1590 with a sole portion edge 1591. The toe portion 1540 and the heel portion 1550 may be on opposite ends of the body portion 1510. The heel portion 1550 may include a hosel portion 1555 configured to receive a shaft (e.g., the shaft 1504). The body portion 1510 may be made of a first material whereas the first and second sets of weight portions 1720 and 1730, respectively, may be made of a second material. The first and second materials may be similar or different materials. For example, the body portion 1510 may be partially or entirely made of a steel-based material (e.g., 17-4 PH stainless steel, Nitronic® 50 stainless steel, maraging steel or other types of stainless steel), a titanium-based material, an aluminum-based material (e.g., a high-strength aluminum alloy or a composite aluminum alloy coated with a high-strength alloy), any combination thereof, and/or other suitable types of materials. The first and second sets of weight portions 1720 and 1730, respectively, may be partially or entirely made of a high-density material such as a tungsten-based material or other suitable types of materials. Alternatively, the body portion 1510 and/or the first and second sets of weight portions 1720 and 1730, respectively, may be partially or entirely made of a non-metal material (e.g., composite, plastic, etc.). The apparatus, methods, and articles of manufacture are not limited in this regard.

The golf club head 1500 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees) (°), 48°, 52°, 56°, 60°, etc.). Although FIGS. 15-32 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The front portion 1560 may include a face portion 1562 (e.g., a strike face). The face portion 1562 may include a front surface 1564 and a back surface 1566. The front surface 1564 may include one or more grooves 1568 extending between the toe portion 1540 and the heel portion 1550. While the figures may depict a particular number of grooves, the apparatus, methods, and articles of manufacture described herein may include more or less grooves. The face portion 1562 may be used to impact a golf ball (not shown). The face portion 1562 may be an integral portion of the body portion 1510. Alternatively, the face portion 1562 may be a separate piece or an insert coupled to the body portion 1510 via various manufacturing methods and/or processes (e.g., a bonding process such as adhesive, a welding process such as laser welding, a brazing process, a soldering process, a fusing process, a mechanical locking or connecting method, any combination thereof, or other suitable types of manufacturing methods and/or processes). The face portion 1562 may be associated with a loft plane 1567 that with a vertical plane 1596 defines a loft angle 1569 of the golf club head 1500. The loft angle 1569 may vary based on the type of golf club (e.g., a long iron, a middle iron, a short iron, a wedge, etc.). In one example, the loft angle 1569 may be between five degrees and seventy-five degrees. In another example, the loft angle 1569 may be between twenty degrees and sixty degrees. The apparatus, methods, and articles of manufacture described herein are not limited in this regard.

Figure 20:
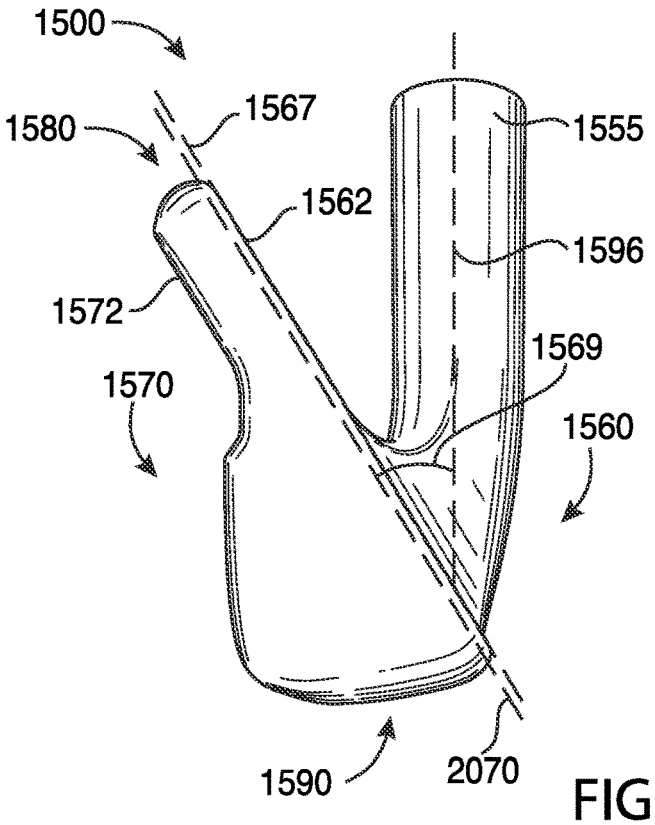

The back portion 1570 may include a portion of the body portion 1510 opposite of the front portion 1560. In one example, the back portion 1570 may be a portion of the body portion 1510 behind the back surface 1566 of the face portion 1562. As shown in FIG. 20, for example, the back portion 1570 may be a portion of the body portion 1510 behind a plane 2070 defined by the back surface 1566 of the face portion 1562. In another example, as shown in FIG. 20, the plane 2070 may be parallel to the loft plane 1567 of the face portion 1562. As mentioned above, for example, the face portion 1562 may be a separate piece or an insert coupled to the body portion 1510. Accordingly, the back portion 1570 may include remaining portion(s) of the body portion 1510 other than the face portion 1562. The apparatus, methods, and articles of manufacture described herein are not limited in this regard.

Figure 28:
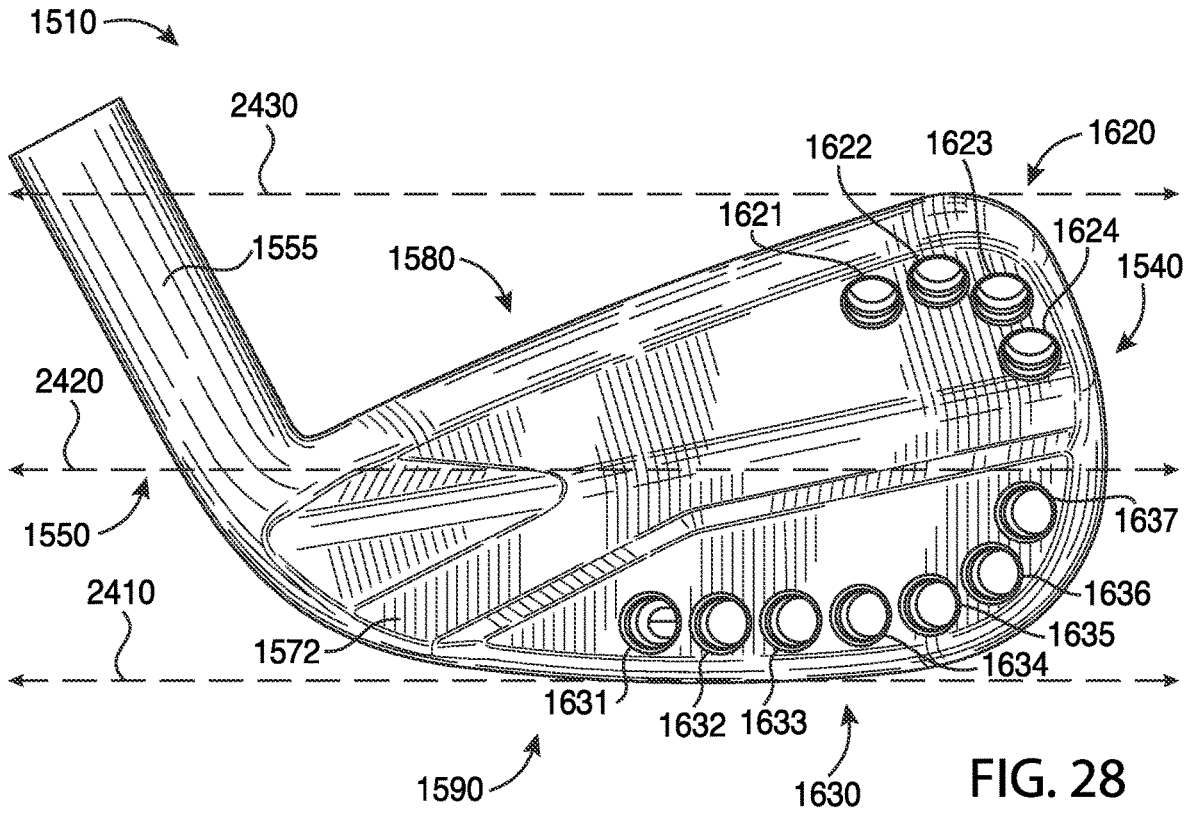
FIG. 28 depicts a rear view of the golf club head of FIG. 15.

As illustrated in FIG. 28, the back portion 1570 may include a back wall portion 1572 with one or more exterior weight ports along a periphery of the back portion 1570, generally shown as a first set of exterior weight ports 1620 (e.g., shown as weight ports 1621, 1622, 1623, and 1624) and a second set of exterior weight ports 1630 (e.g., shown as weight ports 1631, 1632, 1633, 1634, 1635, 1636, and 1637). Each exterior weight port may be associated with a port diameter. In one example, the port diameter may be about 0.25 inch (6.35 millimeters). Any two adjacent exterior weight ports of the first set of exterior weight ports 1620 may be separated by less than the port diameter. In a similar manner, any two adjacent exterior weight ports of the second set of exterior weight ports 1630 may be separated by less than the port diameter. The first set and second set of exterior weight ports 1620 and 1630 may be exterior weight ports configured to receive one or more weight portions. In particular, each weight portion of the first set of weight portions 1720 (e.g., shown as weight portions 1721, 1722, 1723, and 1724) may be disposed in a weight port located at or proximate to the toe portion 1540 and/or the top portion 1580 on the back portion 1570. For example, the weight portion 1721 may be partially or entirely disposed in the weight port 1621. In another example, the weight portion 1722 may be disposed in a weight port 1622 located in a transition region between the top portion 1580 and the toe portion 1540 (e.g., a top-and-toe transition region). Each weight portion of the second set of weight portions 1730 (e.g., shown as weight portions 1731, 1732, 1733, 1734, 1735, 1736, and 1737) may be disposed in a weight port located at or proximate to the toe portion 1540 and/or the sole portion 1590 on the back portion 1570. For example, the weight portion 1735 may be partially or entirely disposed in the weight port 1635. In another example, the weight portion 1736 may be disposed in a weight port 1636 located in a transition region between the sole portion 1590 and the toe portion 1540 (e.g., a sole-and-toe transition region). As described in detail below, the first and second sets of weight portions 1720 and 1730, respectively, may be coupled to the back portion 1570 of the body portion 1510 with various manufacturing methods and/or processes (e.g., a bonding process, a welding process, a brazing process, a mechanical locking method, any combination thereof, or other suitable manufacturing methods and/or processes).

Alternatively, the golf club head 1500 may not include (i) the first set of weight portions 1720, (ii) the second set of weight portions 1730, or (iii) both the first and second sets of weight portions 1720 and 1730. In particular, the back portion 1570 of the body portion 1510 may not include weight ports at or proximate to the top portion 1580 and/or the sole portion 1590. For example, the mass of the first set of weight portions 1720 (e.g., 3 grams) and/or the mass of the second set of weight portions 1730 (e.g., 16.8 grams) may be integral part(s) the body portion 1510 instead of separate weight portion(s). The apparatus, methods, and articles of manufacture described herein are not limited in this regard.

Figure 25:
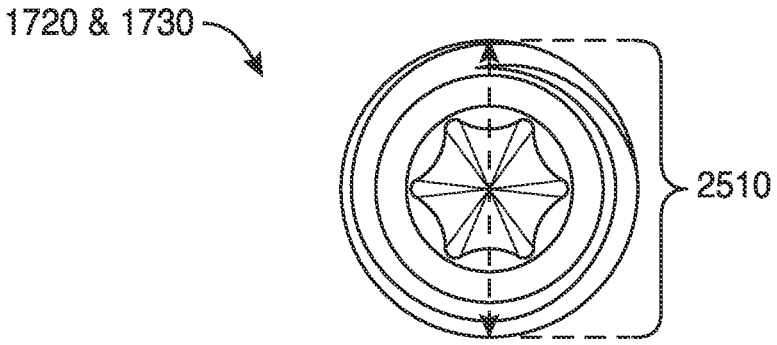
FIGS. 25 and 26 depict a top view and a side view, respectively, of a mass portion associated with a golf club head according to an embodiment of the apparatus, methods, and articles of manufacture described herein.

The first and second sets of weight portions 1720 and 1730, respectively, may have similar or different physical properties (e.g., color, shape, size, density, mass, volume, etc.). As a result, the first and second sets of weight portions 1720 and 1730, respectively, may contribute to the ornamental design of the golf club head 1500. In the illustrated example as shown in FIG. 25, each of the weight portions of the first and second sets of weight portions 1720 and 1730, respectively, may have a cylindrical shape (e.g., a circular cross section). Alternatively, each of the weight portions of the first set of weight portions 1720 may have a first shape (e.g., a cylindrical shape) whereas each of the weight portions of the second set of weight portions 1730 may have a second shape (e.g., a cubical shape). In another example, the first set of weight portions 1720 may include two or more weight portions with different shapes (e.g., the weight portion 1721 may be a first shape whereas the weight portion 1722 may be a second shape different from the first shape). Likewise, the second set of weight portions 1730 may also include two or more weight portions with different shapes (e.g., the weight portion 1731 may be a first shape whereas the weight portion 1732 may be a second shape different from the first shape). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). While the above examples and figures may depict multiple weight portions as a set of weight portions, each set of the first and second sets of weight portions 1720 and 1730, respectively, may be a single piece of weight portion. In one example, the first set of weight portions 1720 may be a single piece of weight portion instead of a series of four separate weight portions. In another example, the second set of weight portions 1730 may be a single piece of weight portion instead of a series of seven separate weight portions. The apparatus, methods, and articles of manufacture described herein are not limited in this regard.

Figure 26:
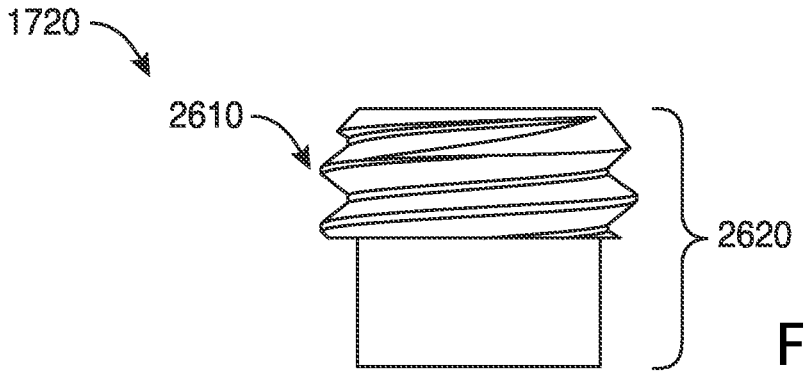
Figure 27:
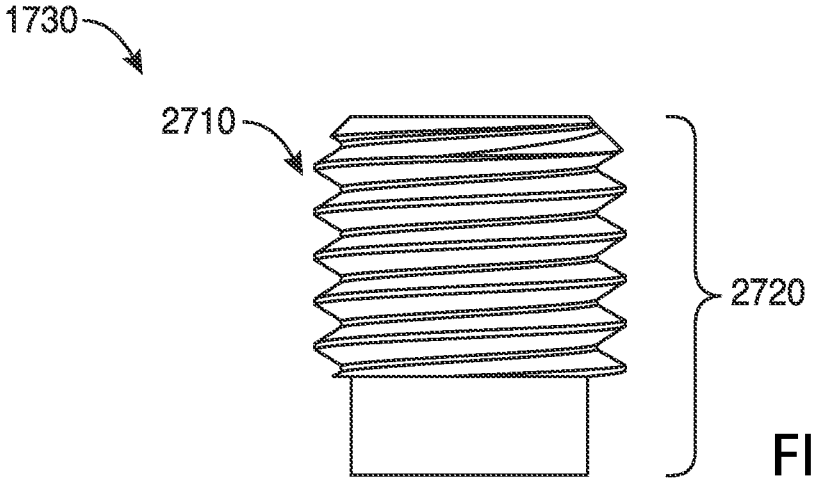
FIG. 27 depicts a side view of a mass portion associated with a golf club head according to an embodiment of the apparatus, methods, and articles of manufacture described herein.

Referring to FIGS. 26 and 27, for example, the first and second sets of weight portions 1720 and 1730, respectively, may include threads, generally shown as 2610 and 2710, respectively, to engage with correspondingly configured threads in the weight ports to secure in the weight ports of the back portion 1570 (generally shown as 1620 and 1630 in FIG. 28). For example, each weight portion of the first and second sets of weight portions 1720 and 1730, respectively, may be a screw. The first and second sets of weight portions 1720 and 1730, respectively, may not be readily removable from the body portion 1510 with or without a tool. Alternatively, the first and second sets of weight portions 1720 and 1730, respectively, may be readily removable (e.g., with a tool) so that a relatively heavier or lighter weight portion may replace one or more of the weight portions of the first and second sets of weight portions 1720 and 1730, respectively. In another example, the first and second sets of weight portions 1720 and 1730, respectively, may be secured in the weight ports of the back portion 1570 with epoxy or adhesive so that the first and second sets of weight portions 1720 and 1730, respectively, may not be readily removable. In yet another example, the first and second sets of weight portions 1720 and 1730, respectively, may be secured in the weight ports of the back portion 1570 with both epoxy and threads so that the first and second sets of weight portions 1720 and 1730, respectively, may not be readily removable. The apparatus, methods, and articles of manufacture described herein are not limited in this regard.

As mentioned above, the first and second sets of weight portions 1720 and 1730, respectively, may be similar in some physical properties but different in other physical properties. As illustrated in FIGS. 25-27, for example, each of the weight portions of the first and second sets 1720 and 1730, respectively, may have a diameter 2510 of about 0.25 inch (6.35 millimeters) but the first and second sets of weight portions 1720 and 1730, respectively, may be different in height. In particular, each of the weight portions of the first set of weight portions 1720 may be associated with a first height 2620 (FIG. 26), and each of the weight portion of the second set of weight portions 1730 may be associated with a second height 2720 (FIG. 27). The first height 2620 may be relatively shorter than the second height 2720. In one example, the first height 2620 may be about 0.125 inch (3.175 millimeters) whereas the second height 2720 may be about 0.3 inch (7.62 millimeters). In another example, the first height 2620 may be about 0.16 inch (4.064 millimeters) whereas the second height 2720 may be about 0.4 inch (10.16 millimeters). Alternatively, the first height 2620 may be equal to or greater than the second height 2720. The apparatus, methods, and articles of manufacture described herein are not limited in this regard.

Figure 24:
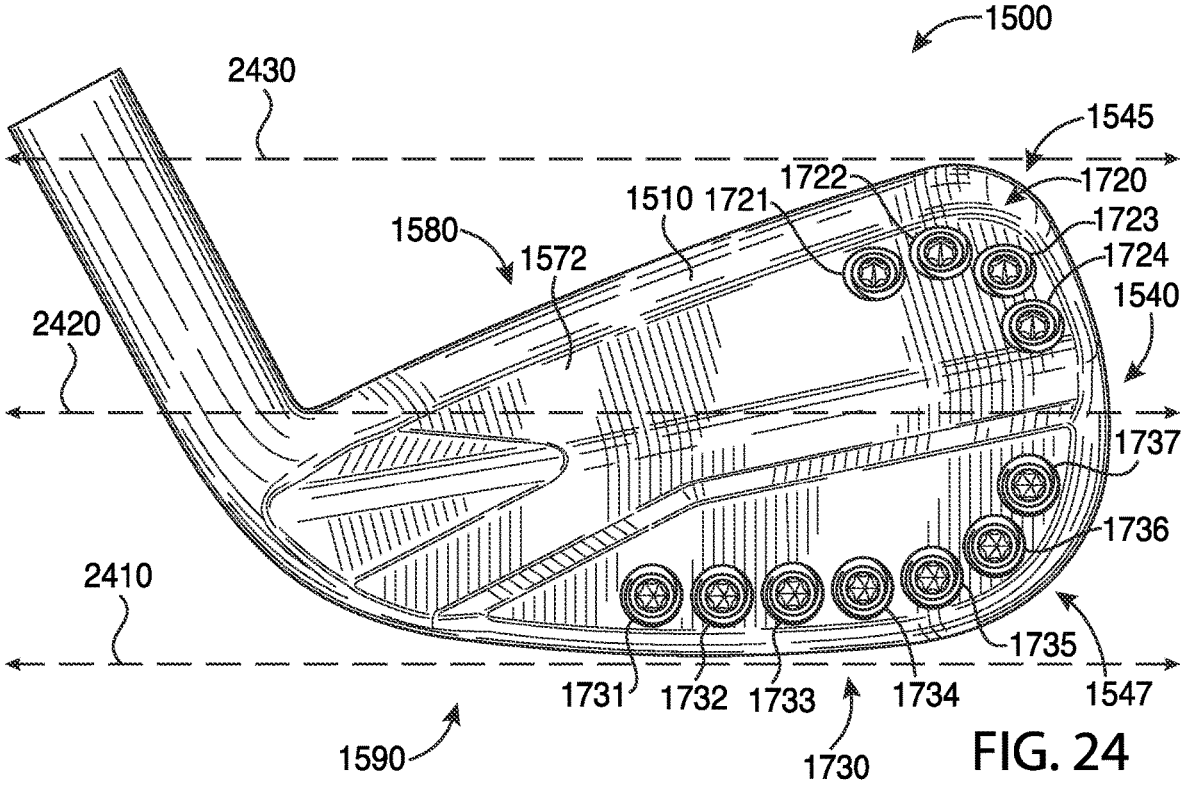

Referring to FIGS. 24 and 28, for example, the golf club head 1500 may be associated with a ground plane 2410, a horizontal midplane 2420, and a top plane 2430. In particular, the ground plane 2410 may be a tangential plane to the sole portion 1590 of the golf club head 1500 when the golf club head 1500 is at an address position (e.g., the golf club head 1500 is aligned to strike a golf ball). A top plane 2430 may be a tangential plane to the top portion 1580 of the golf club head 1500 when the golf club head 1500 is at the address position. The ground and top planes 2410 and 2430, respectively, may be substantially parallel to each other. The horizontal midplane 2420 may be vertically halfway between the ground and top planes 2410 and 2430, respectively.

To provide optimal perimeter weighting for the golf club head 1500, the first set of weight portions 1720 (e.g., weight portions 1721, 1722, 1723, and 1724) may be configured to counter-balance the weight of the hosel portion 1555. For example, as shown in FIG. 24, the first set of weight portions 1720 (e.g., weight portions 1721, 1722, 1723 and 1724) may be located near the periphery of the body portion 1510 and extend from the top portion to a transition region 1545 between the top portion 1580 and the toe portion 1540, and from the transition region 1545 to the toe portion 1540. In other words, the first set of weight portions 1720 may be located on the golf club head 1500 at a generally opposite location relative to the hosel portion 1555. According to one example, at least a portion of the first set of weight portions 1720 may be located near the periphery of the body portion 1510 and extend through the transition region 1545. According to another example, at least a portion of the first set of weight portions 1720 may extend near the periphery of the body portion 1510 and extend along a portion of the top portion 1580. According to another example, at least a portion of the first set of weight portions 1720 may extend near the periphery of the body portion 1510 and extend along a portion of the toe portion 1540. The first set of weight portions 1720 may be above the horizontal midplane 2420 of the golf club head 1500. At least a portion of the first set of weight portions 1720 may be near the toe portion 1540 to increase the moment of inertia of the golf club head 1500 about a vertical axis of the golf club head 1500 that extends through the center of gravity of the golf club head 1500. Accordingly, the first set of weight portions 1720 may be near the periphery of the body portion 1510 and extend through the top portion 1580, the toe portion 1540 and/or the transition region 1545 to counter-balance the weight of the hosel portion 1555 and/or increase the moment of inertia of the golf club head 1500. The locations of the first set of weight portions 1720 (i.e., the locations of the first set of exterior weight ports 1620) and the physical properties and materials of construction of the weight portions of the first set of weight portions 1720 may be determined to optimally affect the weight, weight distribution, center of gravity, moment of inertia characteristics, structural integrity and/or or other static and/or dynamic characteristics of the golf club head 1500. The apparatus, methods, and articles of manufacture described herein are not limited in this regard.

The second set of weight portions 1730 (e.g., weight portions 1731, 1732, 1733, 1734, 1735, 1736, and 1737)

may be configured to place the center of gravity of the golf club head 1500 at an optimal location and optimize the moment of inertia of the golf club head about a vertical axis that extends through the center of gravity of the golf club head 1500. Referring to FIG. 24, all or a substantial portion of the second set of weight portions 1730 may be generally near the sole portion 1590. For example, the second set of weight portions 1730 (e.g., weight portions 1731, 1732, 1733, 1734, 1735, 1736, and 1737) may be near the periphery of the body portion 1510 and extend from the sole portion 1590 to the toe portion 1540. As shown in the example of FIG. 24, the weight portions 1731, 1732, 1733, and 1734 may be located near the periphery of the body portion 1510 and extend along the sole portion 1590 to lower the center of gravity of the golf club head 1500. The weight portions 1735, 1736 and 1737 may be located near the periphery of the body portion 1510 and extend from the sole portion 1590 to the toe portion 1540 through a transition region 1547 between the sole portion 1590 and the toe portion 1540 to lower the center of gravity and increase the moment of inertia of the golf club head 1500 about a vertical axis that extends through the center of gravity. To lower the center of gravity of the golf club head 1500, all or a portion of the second set of weight portions 1730 may be located closer to the sole portion 1590 than to the horizontal midplane 2420. For example, the weight portions 1731, 1732, 1733, 1734, 1735, and 1736 may be closer to the sole portion 1590 than to the horizontal midplane 2420. The locations of the second set of weight portions 1730 (i.e., the locations of the second set of exterior weight ports 1630) and the physical properties and materials of construction of the weight portions of the second set of weight portions 1730 may be determined to optimally affect the weight, weight distribution, center of gravity, moment of inertia characteristics, structural integrity and/or or other static and/or dynamic characteristics of the golf club head 1500. The apparatus, methods, and articles of manufacture described herein are not limited in this regard.

Figure 21:
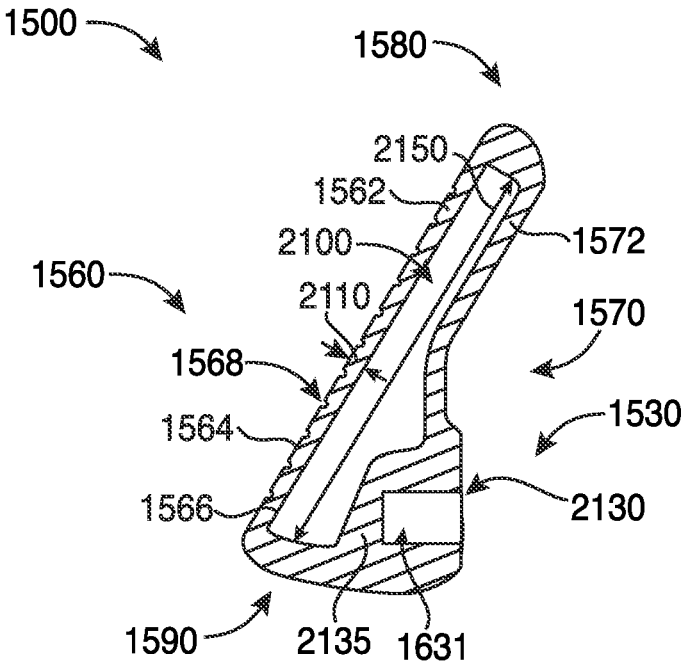
Figure 22:
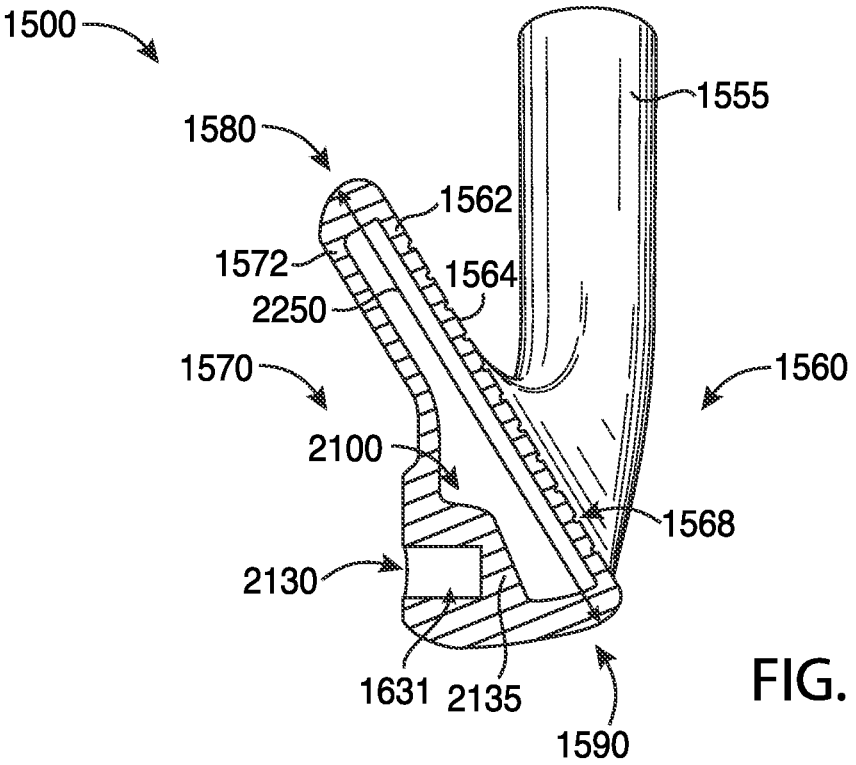
Figure 23:
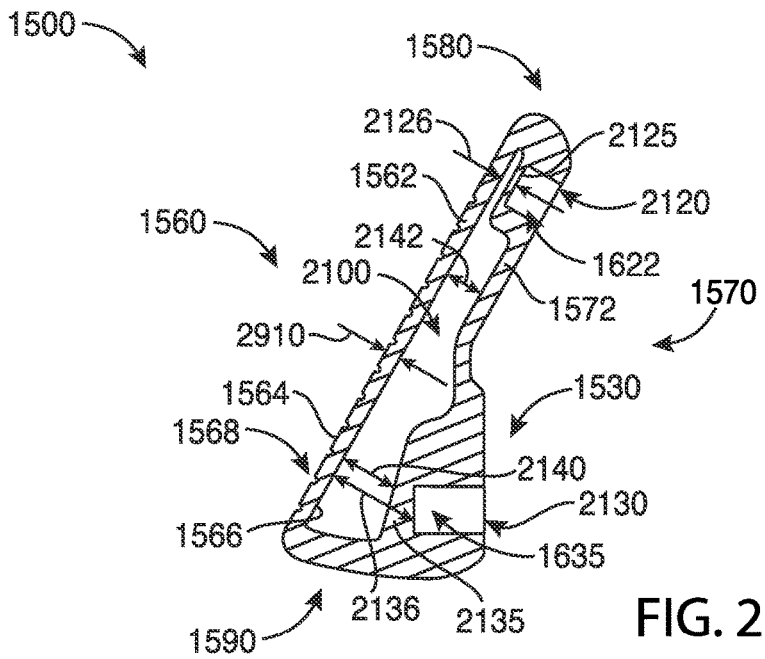

Turning to FIGS. 21-23, for example, the first and second sets of weight portions 1720 and 1730, respectively, may be located away from the back surface 1566 of the face portion 1562 (e.g., not directly coupled to each other). That is, the first and second sets of weight portions 1720 and 1730, respectively, and the back surface 1566 may be partially or entirely separated by an interior cavity 2100 of the body portion 1510. As shown in FIG. 28, for example, each exterior weight port of the first and second sets of exterior weight ports 1620 and 1630 may include an opening (e.g., generally shown as 2120 and 2130) and a port wall (e.g., generally shown as 2125 and 2135). The port walls 2125 and 2135 may be integral portions of the back wall portion 1572 (e.g., a section of the back wall portion 1572). Each of the openings 2120 and 2130 may be configured to receive a weight portion such as weight portions 1722 and 1735, respectively. The opening 2120 may be located at one end of the weight port 1621, and the port wall 2125 may be located or proximate to at an opposite end of the weight port 1621. In a similar manner, the opening 2130 may be located at one end of the weight port 1635, and the port wall 2135 may be located at or proximate to an opposite end of the weight port 1635. The port walls 2125 and 2135 may be separated from the face portion 1562 (e.g., separated by the interior cavity 2100). The port wall 2125 may have a distance 2126 from the back surface 1566 of the face portion 1562 as shown in FIG. 23. The port wall 2135 may have a distance 2136 from the back surface 1566 of the face portion 1562. The distances 2126 and 2136 may be determined to optimize the location of the center of gravity of the golf club head 1500 when the first and second sets of weight ports 1620 and 1630, respectively, receive weight portions as described herein. According to one example, the distance 2136 may be greater than the distance 2126 so that the center of gravity of the golf club head 1500 is moved toward the back portion 1570. As a result, a width 2140 of a portion of the interior cavity 2100 below the horizontal midplane 2420 may be greater than a width 2142 of the interior cavity 2100 above the horizontal midplane 2420. The apparatus, methods, and articles of manufacture described herein are not limited in this regard.

As discussed herein, the center of gravity (CG) of the golf club head 1500 may be relatively farther back away from the face portion 1562 and relatively lower towards a ground plane (e.g., one shown as 2410 in FIG. 24) with all or a substantial portion of the second set of weight portions 1730 being closer to the sole portion 1590 than to the horizontal midplane 2420 and the first and second sets of weight portions 1720 and 1730, respectively being away from the back surface 1566 than if the second set of weight portions 1730 were directly coupled to the back surface 1566. The locations of the first and second sets of weight ports 1620 and 1630 and the physical properties and materials of construction of the weight portions of the first and second sets of weight portions 1720 and 1730, respectively, may be determined to optimally affect the weight, weight distribution, center of gravity, moment of inertia characteristics, structural integrity and/or or other static and/or dynamic characteristics of the golf club head 1500. The apparatus, methods, and articles of manufacture described herein are not limited in this regard.

While the figures may depict weight ports with a particular cross-section shape, the apparatus, methods, and articles of manufacture described herein may include weight ports with other suitable cross-section shapes. In one example, the weight ports of the first and/or second sets of weight ports 1620 and 1630 may have U-like cross-section shape. In another example, the weight ports of the first and/or second set of weight ports 1620 and 1630 may have V-like cross-section shape. One or more of the weight ports associated with the first set of weight portions 1720 may have a different cross-section shape than one or more weight ports associated with the second set of weight portions 1730. For example, the weight port 1622 may have a U-like cross-section shape whereas the weight port 1635 may have a V-like cross-section shape. Further, two or more weight ports associated with the first set of weight portions 1720 may have different cross-section shapes. In a similar manner, two or more weight ports associated with the second set of weight portions 1730 may have different cross-section shapes. The apparatus, methods, and articles of manufacture described herein are not limited in this regard.

The first and second sets of weight portions 1720 and 1730, respectively, may be similar in mass (e.g., all of the weight portions of the first and second sets of weight portions 1720 and 1730, respectively, weigh about the same). Alternatively, the first and second sets of weight portions 1720 and 1730, respectively, may be different in mass individually or as an entire set. In particular, each of the weight portions of the first set of weight portions 1720 (e.g., shown as 1721, 1722, 1723, and 1724) may have relatively less mass than any of the weight portions of the second set of weight portions 1730 (e.g., shown as 1731, 1732, 1733, 1734, 1735, 1736, and 1737). For example, the second set of weight portions 1730 may account for more than 50% of the total mass from exterior weight portions of the golf club head 1500. As a result, the golf club head 1500 may be configured to have at least 50% of the total mass from exterior weight portions disposed below the horizontal midplane 2420. The apparatus, methods, and articles of manufacture described herein are not limited in this regard.

In one example, the golf club head 1500 may have a mass in the range of about 220 grams to about 330 grams based on the type of golf club (e.g., a 4-iron versus a lob wedge). The body portion 1510 may have a mass in the range of about 200 grams to about 310 grams with the first and second sets of weight portions 1720 and 1730, respectively, having a mass of about 20 grams (e.g., a total mass from exterior weight portions). Each of the weight portions of the first set of weight portions 1720 may have a mass of about one gram (1.0 g) whereas each of the weight portions of the second set of weight portions 1730 may have a mass of about 2.4 grams. The sum of the mass of the first set of weight portions 1720 may be about 3 grams whereas the sum of the mass of the first set of weight portions 1730 may be about 16.8 grams. The total mass of the second set of weight portions 1730 may weigh more than five times as much as the total mass of the first set of weight portions 1720 (e.g., a total mass of the second set of weight portions 1730 of about 16.8 grams versus a total mass of the first set of weight portions 1720 of about 3 grams). The golf club head 1500 may have a total mass of 19.8 grams from the first and second sets of weight portions 1720 and 1730, respectively (e.g., sum of 3 grams from the first set of weight portions 1720 and 16.8 grams from the second set of weight portions 1730). Accordingly, the first set of weight portions 1720 may account for about 15% of the total mass from exterior weight portions of the golf club head 1500 whereas the second set of weight portions 1730 may be account for about 85% of the total mass from exterior weight portions of the golf club head 1500. The apparatus, methods, and articles of manufacture described herein are not limited in this regard.

By coupling the first and second sets of weight portions 1720 and 1730, respectively, to the body portion 1510 (e.g., securing the first and second sets of weight portions 1720 and 1730 in the weight ports on the back portion 1570), the location of the center of gravity (CG) and the moment of inertia (MOI) of the golf club head 1500 may be optimized. In particular, as described herein, the first and second sets of weight portions 1720 and 1730, respectively, may lower the location of the CG towards the sole portion 1590 and further back away from the face portion 1562. Further, the MOI may be higher as measured about a vertical axis extending through the CG (e.g., perpendicular to the ground plane 2410). The MOI may also be higher as measured about a horizontal axis extending through the CG (e.g., extending towards the toe and heel portions 1540 and 1550, respectively, of the golf club head 1500). As a result, the club head 1500 may provide a relatively higher launch angle and a relatively lower spin rate than a golf club head without the first and second sets of weight portions 1720 and 1730, respectively. The apparatus, methods, and articles of manufacture described herein are not limited in this regard.

Alternatively, two or more weight portions in the same set may be different in mass. In one example, the weight portion 1721 of the first set of weight portions 1720 may have a relatively lower mass than the weight portion 1722 of the first set of weight portions 1720. In another example, the weight portion 1731 of the second set of weight portions 1730 may have a relatively lower mass than the weight portion 1735 of the second set of weight portions 1730. With relatively greater mass at the top-and-toe transition region and/or the sole-and-toe transition region, more weight may be distributed away from the center of gravity (CG) of the golf club head 1500 to increase the moment of inertia (MOI) about the vertical axis through the CG.

Although the figures may depict the weight portions as separate and individual parts, each set of the first and second sets of weight portions 1720 and 1730, respectively, may be a single piece of weight portion. In one example, all of the weight portions of the first set of weight portions 1720 (e.g., shown as 1721, 1722, 1723, and 1724) may be combined into a single piece of weight portion (e.g., a first weight portion). In a similar manner, all of the weight portions of the second set of weight portions 1730 (e.g., 1731, 1732, 1733, 1734, 1735, 1736, and 1737) may be combined into a single piece of weight portion as well (e.g., a second weight portion). In this example, the golf club head 1500 may have only two weight portions. While the figures may depict a particular number of weight portions, the apparatus, methods, and articles of manufacture described herein may include more or less number of weight portions. In one example, the first set of weight portions 1720 may include two separate weight portions instead of three separate weight portions as shown in the figures. In another example, the second set of weight portions 1730 may include five separate weight portions instead of seven separate weight portions a shown in the figures. Alternatively as mentioned above, the apparatus, methods, and articles of manufacture described herein may not include any separate weight portions (e.g., the body portion 1510 may be manufactured to include the mass of the separate weight portions as integral part(s) of the body portion 1510). The apparatus, methods, and articles of manufacture described herein are not limited in this regard.

Referring back to FIGS. 21-23, for example, the body portion 1510 may be a hollow body including the interior cavity 2100 extending between the front portion 1560 and the back portion 1570. Further, the interior cavity 2100 may extend between the top portion 1580 and the sole portion 1590. The interior cavity 2100 may be associated with a cavity height 2150 ($H_C$), and the body portion 1510 may be associated with a body height 2250 ($H_B$). While the cavity height 2150 and the body height 2250 may vary between the toe and heel portions 1540 and 1550, the cavity height 2150 may be at least 50% of a body height 2250 ($H_C>0.5*H_B$). For example, the cavity height 2150 may vary between 70-85% of the body height 2250. With the cavity height 2150 of the interior cavity 2100 being greater than 50% of the body height 2250, the golf club head 1500 may produce relatively more consistent feel, sound, and/or result when the golf club head 1500 strikes a golf ball via the face portion 1562 than a golf club head with a cavity height of less than 50% of the body height. The apparatus, methods, and articles of manufacture described herein are not limited in this regard.

In one example, the interior cavity 2100 may be unfilled (i.e., empty space). The body portion 1510 with the interior cavity 2100 may weigh about 100 grams less than the body portion 1510 without the interior cavity 2100. Alternatively, the interior cavity 2100 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 2100 may be filled with a TPE material to absorb shock, isolate vibration, and/or dampen noise when the golf club head 1500 strikes a golf ball via the face portion 1562.

In another example, the interior cavity 2100 may be partially or entirely filled with a polymer material such as an ethylene copolymer material to absorb shock, isolate vibration, and/or dampen noise when the golf club head 1500 strikes a golf ball via the face portion 1562. In particular, at least 50% of the interior cavity 2100 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

Figure 29:
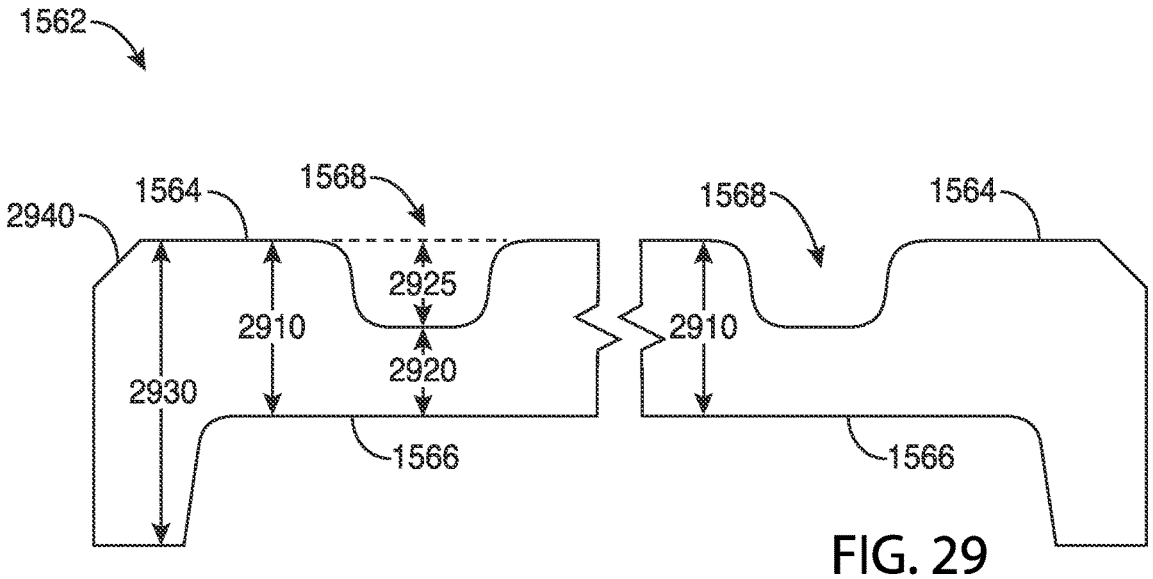
FIG. 29 depicts a cross-sectional view of a face portion associated with a golf club head according to an embodiment of the apparatus, methods, and articles of manufacture described herein.

Turning to FIG. 29, for example, the face portion 1562 may include a first thickness 2910 ($T_1$), and a second thickness 2920 ($T_2$). The first thickness 2910 may be a thickness of a section of the face portion 1562 adjacent to a groove 1568 whereas the second thickness 2920 may be a thickness of a section of the face portion 1562 below the groove 1568. For example, the first thickness 2910 may be a maximum distance between the front surface 1564 and the back surface 1566. The second thickness 2920 may be based on the groove 1568. In particular, the groove 1568 may have a groove depth 2925 ($D_{groove}$). The second thickness 2920 may be a maximum distance between the bottom of the groove 1568 and the back surface 1566. The sum of the second thickness 2920 and the groove depth 2925 may be substantially equal to the first thickness 2910 (e.g., $T_2+D_{groove}=T_1$). Accordingly, the second thickness 2920 may be less than the first thickness 2910 (e.g., $T_2<T_1$).

To lower and/or move the CG of the golf club head 1500 further back, weight from the front portion 1560 of the golf club head 1500 may be removed by using a relatively thinner face portion 1562. For example, the first thickness 2910 may be about 0.075 inch (1.905 millimeters) (e.g., $T_1=0.075$ inch). With the support of the back wall portion 1572 to form the interior cavity 2100 and filling at least a portion of the interior cavity 2100 with an elastic polymer material, the face portion 1562 may be relatively thinner (e.g., $T_1<0.075$ inch) without degrading the structural integrity, sound, and/or feel of the golf club head 1500. In one example, the first thickness 2910 may be less than or equal to 0.060 inch (1.524 millimeters) (e.g., $T_1\leq 0.060$ inch). In another example, the first thickness 2910 may be less than or equal to 0.040 inch (1.016 millimeters) (e.g., $T_1\leq 0.040$ inch). Based on the type of material(s) used to form the face portion 1562 and/or the body portion 1510, the face portion 1562 may be even thinner with the first thickness 2910 being less than or equal to 0.030 inch (0.762 millimeters) (e.g., $T_1\leq 0.030$ inch). The groove depth 2925 may be greater than or equal to the second thickness 2920 (e.g., $D_{groove}\geq T_2$). In one example, the groove depth 2925 may be about 0.020 inch (0.508 millimeters) (e.g., $D_{groove}=0.020$ inch). Accordingly, the second thickness 2920 may be about 0.010 inch (0.254 millimeters) (e.g., $T_2=0.010$ inch). In another example, the groove depth 2925 may be about 0.015 inch (0.381 millimeters), and the second thickness 2920 may be about 0.015 inch (e.g., $D_{groove}=T_2=0.015$ inch). Alternatively, the groove depth 2925 may be less than the second thickness 2920 (e.g., $D_{groove}<T_2$). Without the support of the back wall portion 1572 and the elastic polymer material to fill in the interior cavity 2100, a golf club head may not be able to withstand multiple impacts by a golf ball on a face portion. In contrast to the golf club head 1500 as described herein, a golf club head with a relatively thin face portion but without the support of the back wall portion 1572 and the elastic polymer material to fill in the interior cavity 2100 (e.g., a cavity-back golf club head) may produce unpleasant sound (e.g., a tinny sound) and/or feel during impact with a golf ball. The apparatus, methods, and articles of manufacture described herein are not limited in this regard.

Based on manufacturing processes and methods used to form the golf club head 1500, the face portion 1562 may include additional material at or proximate to a periphery of the face portion 1562. Accordingly, the face portion 1562 may also include a third thickness 2930, and a chamfer portion 2940. The third thickness 2930 may be greater than either the first thickness 2910 or the second thickness 2920 (e.g., $T_3>T_1>T_2$). In particular, the face portion 1562 may be coupled to the body portion 1510 by a welding process. For example, the first thickness 2910 may be about 0.030 inch (0.762 millimeters), the second thickness 2920 may be about 0.015 inch (0.381 millimeters), and the third thickness 2930 may be about 0.050 inch (1.27 millimeters). Accordingly, the chamfer portion 2940 may accommodate some of the additional material when the face portion 1562 is welded to the body portion 1510.

Figure 30:
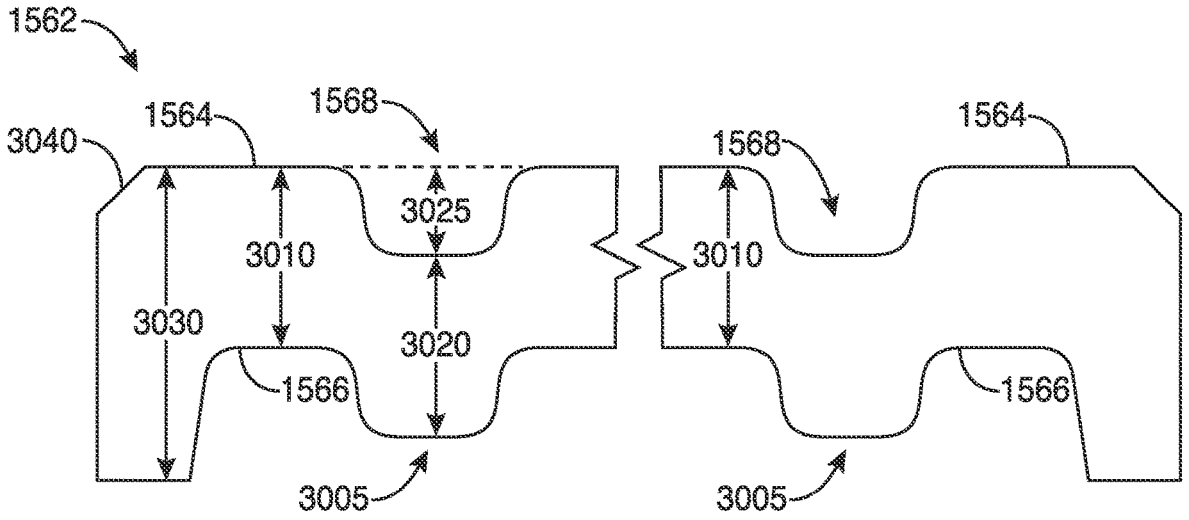
FIG. 30 depicts a cross-section view of a face portion associated with a golf club head according to an embodiment of the apparatus, methods, and articles of manufacture described herein.

As illustrated in FIG. 30, for example, the face portion 1562 may include a reinforcement section, generally shown as 3005, below one or more grooves 1568. In one example, the face portion 1562 may include a reinforcement section 3005 below each groove. Alternatively, face portion 1562 may include the reinforcement section 3005 below some grooves (e.g., every other groove) or below only one groove. The face portion 1562 may include a first thickness 3010, a second thickness 3020, a third thickness 3030, and a chamfer portion 3040. The groove 1568 may have a groove depth 3025. The reinforcement section 3005 may define the second thickness 3020. The first and second thicknesses 3010 and 3020, respectively, may be substantially equal to each other (e.g., $T_1=T_2$). In one example, the first and second thicknesses 3010 and 3020, respectively, may be about 0.030 inch (0.762 millimeters) (e.g., $T_1=T_2=0.030$ inch). The groove depth 3025 may be about 0.015 inch (0.381 millimeters), and the third thickness 3030 may be about 0.050 inch (1.27 millimeters). The groove 1568 may also have a groove width. The width of the reinforcement section 3005 may be greater than or equal to the groove width. The apparatus, methods, and articles of manufacture described herein are not limited in this regard.

Alternatively, the face portion 1562 may vary in thickness at and/or between the top portion 1580 and the sole portion 1590. In one example, the face portion 1562 may be relatively thicker at or proximate to the top portion 1580 than at or proximate to the sole portion 1590 (e.g., thickness of the face portion 1562 may taper from the top portion 1580 towards the sole portion 1590). In another example, the face portion 1562 may be relatively thicker at or proximate to the sole portion 1590 than at or proximate to the top portion 1580 (e.g., thickness of the face portion 1562 may taper from the sole portion 1590 towards the top portion 1580). In yet another example, the face portion 1562 may be relatively thicker between the top portion 1580 and the sole portion 1590 than at or proximate to the top portion 1580 and the sole portion 1590 (e.g., thickness of the face portion 1562 may have a bell-shaped contour). The apparatus, methods, and articles of manufacture described herein are not limited in this regard.

Different from other golf club head designs, the interior cavity 2100 of the body portion 1510 and the location of the first and second sets of weight portions 1720 and 1730, respectively, along the perimeter of the golf club head 1500 may result in a golf ball traveling away from the face portion 1562 at a relatively higher ball launch angle and a relatively lower spin rate. As a result, the golf ball may travel farther (i.e., greater total distance, which includes carry and roll distances).

As described herein, the interior cavity 2100 may be partially or fully filled with an elastic polymer material to provide structural support for the face portion 1562. In particular, the elastic polymer material may also provide vibration and/or noise dampening for the body portion 1510 when the face portion 1562 strikes a golf ball. Alternatively, the elastic polymer material may only provide vibration and/or noise dampening for the body portion 1510 when the face portion 1562 strikes a golf ball. In one example, the body portion 1510 of the golf club head 1500 (e.g., an iron-type golf club head) may have a body portion volume ($V_b$) between about 2.0 cubic inches (32.77 cubic centimeters) and about 4.2 cubic inches (68.83 cubic centimeters). The volume of the elastic polymer material filling the interior cavity ($V_e$), such as the interior cavity 2100, may be between 0.5 and 1.7 cubic inches (8.19 and 27.86 cubic centimeters, respectively). A ratio of the elastic polymer material volume ($V_e$) to the body portion volume ($V_b$) may be expressed as:

$$0.2 \le \frac{V_e}{V_b} \le 0.5$$

Where: $V_e$ is the elastic polymer material volume in units of $in^3$, and $V_b$ is the body portion volume in units of $in^3$.

In another example, the ratio of the elastic polymer material volume ($V_e$) to the body portion volume ($V_b$) may be between about 0.2 and about 0.4. In yet another example, the ratio of the elastic polymer material volume ($V_e$) to the body portion volume ($V_b$) may be between about 0.25 and about 0.35. The apparatus, methods, and articles of manufacture described herein are not limited in this regard.

Based on the amount of elastic polymer material filling the interior cavity, for example, the thickness of the face portion may be between about 0.025 inches (0.635 millimeters) and about 0.075 inches (1.905 millimeters). In another example, the thickness of the face portion ($T_f$) may be between about 0.02 inches (0.508 millimeters) and about 0.09 inches (2.286 millimeters). The thickness of the face portion ($T_f$) may depend on the volume of the elastic polymer material in the interior cavity ($V_e$), such as the interior cavity 2100. The ratio of the thickness of the face portion ($T_f$) to the volume of the elastic polymer material ($V_e$) may be expressed as:

$$0.01 \le \frac{T_f}{V_e} \le 0.2$$

Where: $T_f$ is the thickness of the face portion in units of inches, and $V_e$ is the elastic polymer material volume in units of $in^3$.

In one example, the ratio of the thickness of the face portion ($T_f$) to the volume of the elastic polymer material ($V_e$) may be between 0.02 and 0.09. In another example, the ratio of the thickness of the face portion ($T_f$) to the volume of the elastic polymer material ($V_e$) may be between 0.04 and 0.14. The thickness of the face portion ($T_f$) may be the same as $T_1$ and/or $T_2$ mentioned above. The apparatus, methods, and articles of manufacture described herein are not limited in this regard.

The thickness of the face portion ($T_f$) may depend on the volume of the elastic polymer material in the interior cavity ($V_e$), such as the interior cavity 2100, and the body portion volume ($V_b$). The volume of the elastic polymer material ($V_e$) may be expressed as:

$$V_e = a * V_b + b \pm c * T_f$$

$$a \cong 0.48$$

$$b \cong -0.38$$

$$0 \le c \le 10$$

Where: $V_e$ is the elastic polymer material volume in units of $in^3$, $V_b$ is the body portion volume in units of $in^3$, and $T_f$ is the thickness of the face portion in units of inches.

As described herein, for example, the body portion volume ($V_b$) may be between about 2.0 cubic inches (32.77 cubic centimeters) and about 4.2 cubic inches (68.83 cubic centimeters). In one example, the thickness of the face portion ($T_f$) may be about 0.03 inches (0.762 millimeters). In another example, the thickness of the face portion ($T_f$) may be about 0.06 inches (1.524 millimeters). In yet another example, the thickness of the face portion ($T_f$) may be about 0.075 inches (1.905 millimeters). The apparatus, methods, and articles of manufacture described herein are not limited in this regard.

Further, the volume of the elastic polymer material ($V_e$) when the interior cavity is fully filled with the elastic polymer material, may be similar to the volume of the interior cavity ($V_c$). Accordingly, when the interior cavity is fully filled with an elastic polymer material, the volume of the elastic polymer material ($V_e$) in any of the equations provided herein may be replaced with the volume of the interior cavity ($V_c$). Accordingly, the above equations expressed in terms of the volume of the interior cavity ($V_c$) may be expressed as:

$$0.2 \le \frac{Vc}{Vb} \le 0.5$$

$$0.01 \le \frac{Tf}{Vc} \le 0.2$$

$$Vc = a.Vb + b \pm c.Tf$$

$$a \cong 0.48$$

-continued $$b \cong -0.38$$

$$0 \leq c \leq 10$$

Where: $V_c$ is the volume of the interior cavity in units of $in^3$, $V_b$ is the body portion volume in units of $in^3$, and $T_f$ is the thickness of the face portion in units of inches.

Figure 31:
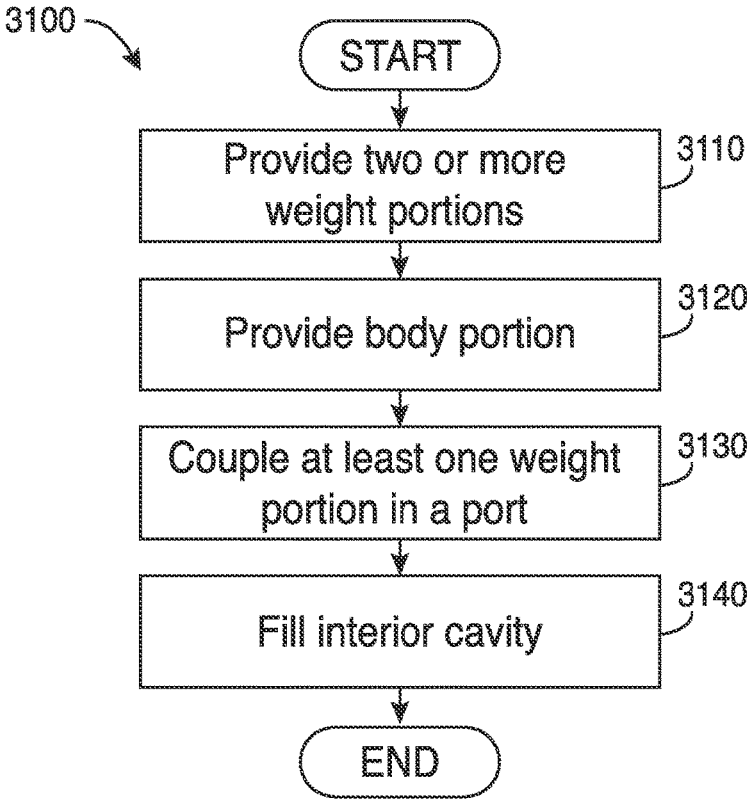
FIG. 31 depicts one manner in which a golf club head according to an embodiment of the apparatus, methods, and articles of manufacture described herein may be manufactured.

FIG. 31 depicts one manner in which the example golf club head described herein may be manufactured. In the example of FIG. 31, the process 3100 may begin with providing two or more weight portions, generally shown as the first and second sets of weight portions 1720 and 1730, respectively (block 3110). The first and second sets of weight portions 1720 and 1730, respectively, may be made of a first material such as a tungsten-based material. In one example, the weight portions of the first and second sets of weight portions 1720 and 1730, respectively, may be tungsten-alloy screws.

The process 3100 may provide a body portion 1510 having the face portion 1562, the interior cavity 2100, and the back portion 1570 with two or more exterior weight ports, generally shown as 1620 and 1630 (block 3120). The body portion 1510 may be made of a second material, which is different than the first material. The body portion 1510 may be manufactured using an investment casting process, a billet forging process, a stamping process, a computer numerically controlled (CNC) machining process, a die casting process, any combination thereof, or other suitable manufacturing processes. In one example, the body portion 1510 may be made of 17-4 PH stainless steel using a casting process. In another example, the body portion 1510 may be made of other suitable type of stainless steel (e.g., Nitronic® 50 stainless steel manufactured by AK Steel Corporation, West Chester, Ohio) using a forging process. By using Nitronic® 50 stainless steel to manufacture the body portion 1510, the golf club head 1500 may be relatively stronger and/or more resistant to corrosion than golf club heads made from other types of steel. Each weight port of the body portion 1510 may include an opening and a port wall. For example, the weight port 1621 may include the opening 2120 and the port wall 2125 with the opening 2120 and the port wall 2125 being on opposite ends of each other. The interior cavity 2100 may separate the port wall 2125 of the weight port 1621 and the back surface 1566 of the face portion 1562. In a similar manner, the weight port 1635 may include the opening 2130 and the port wall 2135 with the opening 2130 and the port wall 2135 being on opposite ends of each other. The interior cavity 2100 may separate the port wall 2135 of the weight port 1635 and the back surface 1566 of the face portion 1562.

The process 3100 may couple each of the first and second sets of weight portions 1720 and 1730 into one of the two or more exterior weight ports (blocks 3130). In one example, the process 3100 may insert and secure the weight portion 1721 in the exterior weight port 1621, and the weight portion 1735 in the exterior weight portion 1635. The process 3100 may use various manufacturing methods and/or processes to secure the first and second sets of weight portions 1720 and 1730, respectively, in the exterior weight ports such as the weight ports 1621 and 1635 (e.g., epoxy, welding, brazing, mechanical lock(s), any combination thereof, etc.).

Figure 32:
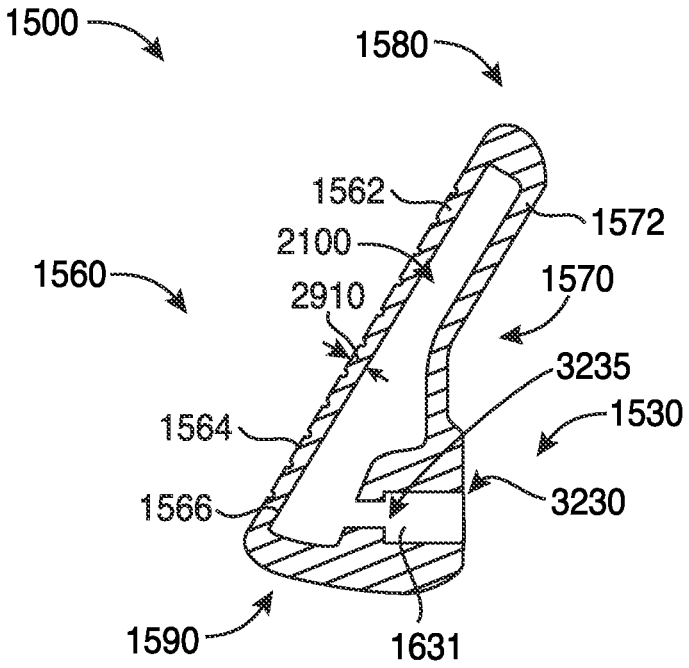
FIG. 32 depicts a cross-sectional view along line 32-32 of FIG. 18 of the golf club head of FIG. 15.

The process 3100 may partially or entirely fill the interior cavity 2100 with an elastic polymer material (e.g., Sorbothane® material) or a polymer material (e.g., an ethylene copolymer material such as DuPont™ HPF family of materials) (block 3140). In one example, at least 50% of the interior cavity 2100 may be filled with the elastic polymer material. As mentioned above, the elastic polymer material may absorb shock, isolate vibration, and/or dampen noise in response to the golf club head 1500 striking a golf ball. In addition or alternatively, the interior cavity 2100 may be filled with a thermoplastic elastomer material and/or a thermoplastic polyurethane material. As illustrated in FIG. 32, for example, the golf club head 1500 may include one or more weight ports (e.g., one shown as 1631 in FIG. 28) with a first opening 3230 and a second opening 3235. The second opening 3235 may be used to access the interior cavity 2100. In one example, the process 3100 (FIG. 31) may fill the interior cavity 2100 with an elastic polymer material by injecting the elastic polymer material into the interior cavity 2100 from the first opening 3230 via the second opening 3235. The first and second openings 3230 and 3235, respectively, may be same or different in size and/or shape. While the above example may describe and depict a particular weight port with a second opening, any other weight ports of the golf club head 1500 may include a second opening (e.g., any of the weight ports of the first set of weight ports 1620 or the second set of weight ports 1630). The apparatus, methods, and articles of manufacture described herein are not limited in this regard.

Referring back to FIG. 31, the example process 3100 is merely provided and described in conjunction with other figures as an example of one way to manufacture the golf club head 1500. While a particular order of actions is illustrated in FIG. 31, these actions may be performed in other temporal sequences. For example, two or more actions depicted in FIG. 31 may be performed sequentially, concurrently, or simultaneously. In one example, blocks 3110, 3120, 3130, and/or 3140 may be performed simultaneously or concurrently. Although FIG. 31 depicts a particular number of blocks, the process may not perform one or more blocks. In one example, the interior cavity 2100 may not be filled (i.e., block 3140 may not be performed). The apparatus, methods, and articles of manufacture described herein are not limited in this regard.

Referring back to FIGS. 15-28, the face portion 1562 may include a non-smooth back surface to improve adhesion and/or mitigate delamination between the face portion 1562 and the elastic polymer material used to fill the interior cavity 2100 (e.g., FIG. 21). Various methods and/or processes such as an abrasive blasting process (e.g., a bead blasting process, a sand blasting process, other suitable blasting process, or any combination thereof) and/or a milling (machining) process may be used to form the back surface 1566 into a non-smooth surface. For example, the back surface 1566 may have with a surface roughness (Ra) ranging from 0.5 to 250 μin (0.012 to 6.3 μm). The apparatus, methods, and articles of manufacture are not limited in this regard.

Figure 33:
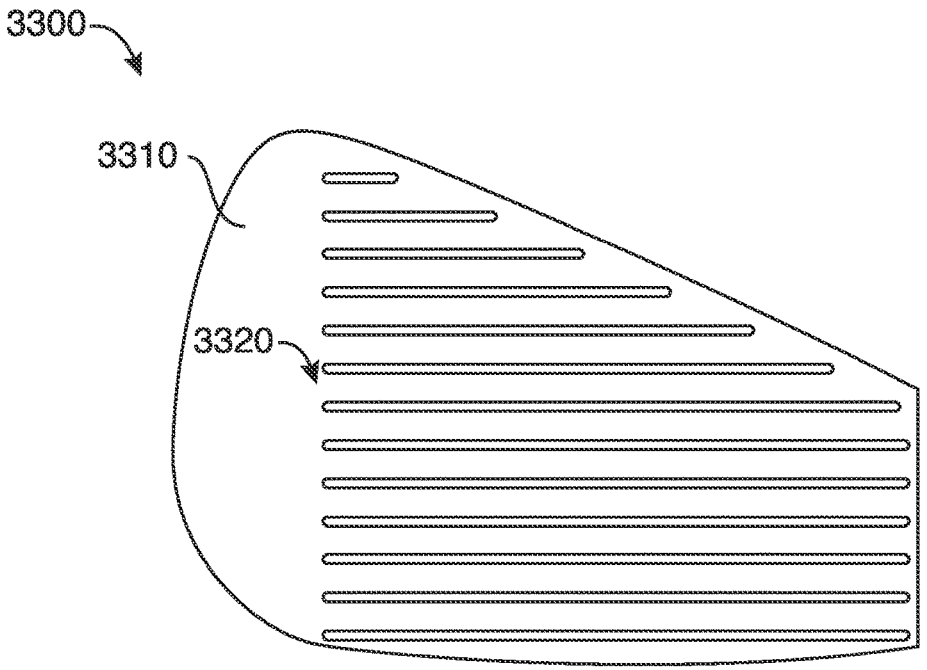
FIGS. 33 and 34 depict a front view and a back view, respectively, of a face portion of the example golf club head of FIG. 15.
Figure 34:
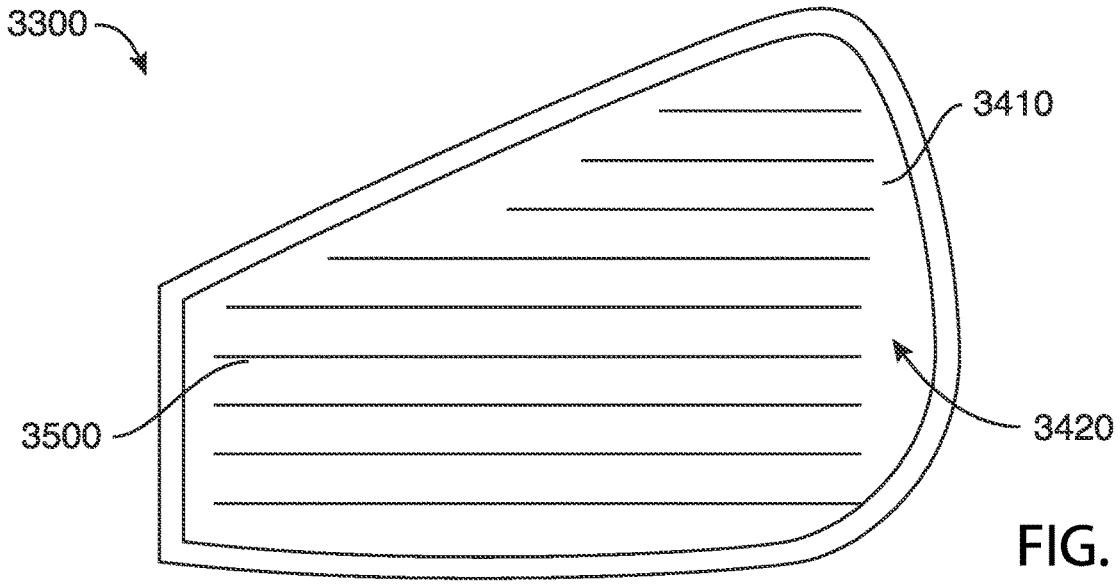
Figure 35:
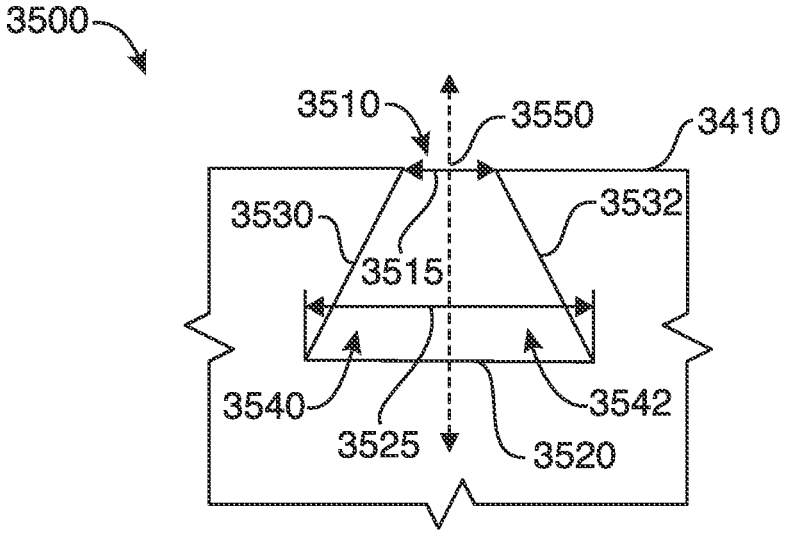
FIGS. 35, 36, 37, and 38 depict cross-sectional views of example channels of the face portion of FIG. 33.

As illustrated in FIGS. 33-35, for example, a face portion 3300, which may be any of the face portions described herein, may include a front surface 3310, and a back surface 3410. The front surface 3310 may include one or more grooves, generally shown as 3320, extending longitudinally across the front surface 3310 (e.g., extending between the toe portion 1540 and the heel portion 1550 of FIG. 15). The front surface 3310 may be used to impact a golf ball (not shown).

The back surface 3410 may also include one or more channels, generally shown as 3420. The channels 3420 may extend longitudinally across the back surface 3410. The channels 3420 may be parallel or substantially parallel to each other. The channels 3420 may engage with the elastic polymer material used to fill the interior cavity 2100, and serve as a mechanical locking mechanism between the face portion 3300 and the elastic polymer material. In particular, a channel 3500 may include an opening 3510, a bottom section 3520, and two sidewalls, generally shown as 3530 and 3532. The bottom section 3520 may be parallel or substantially parallel to the back surface 3410. The two sidewalls 3530 and 3532 may be converging sidewalls (i.e., the two sidewalls 3530 and 3532 may not be parallel to each other). The bottom section 3520 and the sidewalls 3530 and 3532 may form two undercut portions, generally shown as 3540 and 3542. That is, a width 3515 at the opening 3510 may be less than a width 3525 of the bottom section 3520. A cross section of the channel 3500 may be symmetrical about an axis 3550. While FIG. 35 may depict flat or substantially flat sidewalls, the two sidewalls 3530 and 3532 may be curved (e.g., convex relative to each other).

Figure 36:
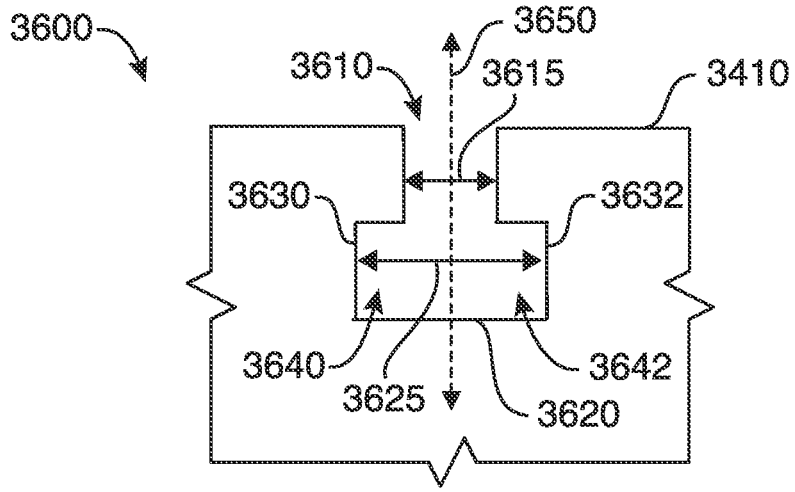

Instead of flat or substantially flat sidewalls as shown in FIG. 35, a channel may include other types of sidewalls. As illustrated in FIG. 36, for example, a channel 3600 may include an opening 3610, a bottom section 3620, and two sidewalls, generally shown as 3630 and 3632. The bottom section 3620 may be parallel or substantially parallel to the back surface 3410. The two sidewalls 3630 and 3632 may be stepped sidewalls. The bottom section 3620 and the sidewalls 3630 and 3632 may form two undercut portions, generally shown as 3640 and 3642. That is, a width 3615 at the opening 3610 may be less than a width 3625 of the bottom section 3620. A cross section of the channel 3600 may be symmetrical about an axis 3650.

Figure 37:
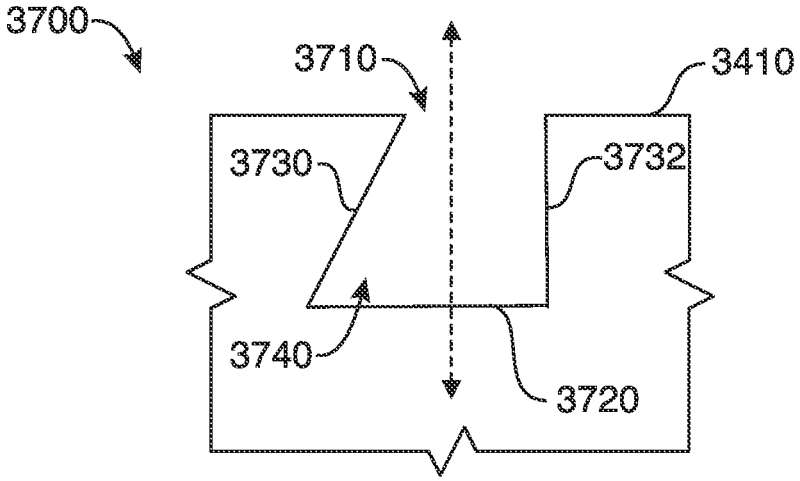

Instead of being symmetrical as shown in FIGS. 35 and 36, a channel may be asymmetrical. As illustrated in FIG. 37, for another example, a channel 3700 may include an opening 3710, a bottom section 3720, and two sidewalls, generally shown as 3730 and 3732. The bottom section 3720 may be parallel or substantially parallel to the back surface 3410. The bottom section 3720 and the sidewall 3730 may form an undercut portion 3740.

Figure 38:
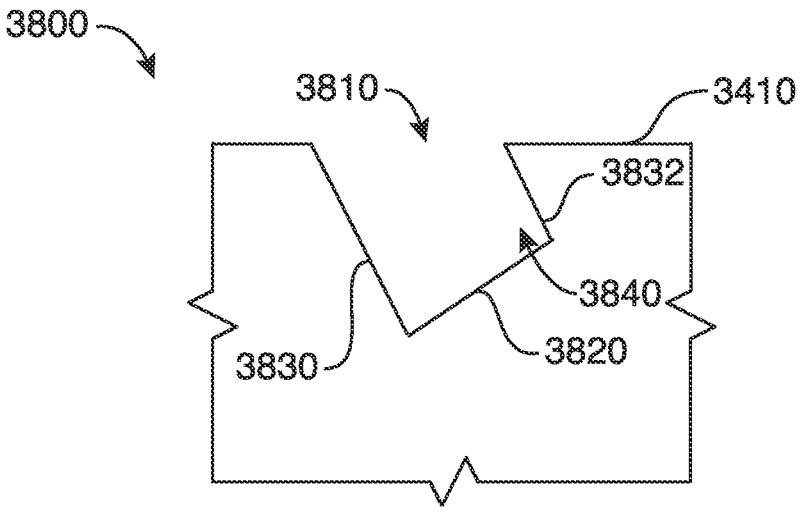

Referring to FIG. 38, for example, a channel 3800 may include an opening 3810, a bottom section 3820, and two sidewalls, generally shown as 3830 and 3832. The bottom section 3820 may not be parallel or substantially parallel to the back surface 3410. The two sidewalls 3830 and 3832 may be parallel or substantially parallel to each other but one sidewall may be longer than the other sidewall. The bottom section 3820 and the sidewall 3832 may form an undercut portion 3840.

Figure 15:
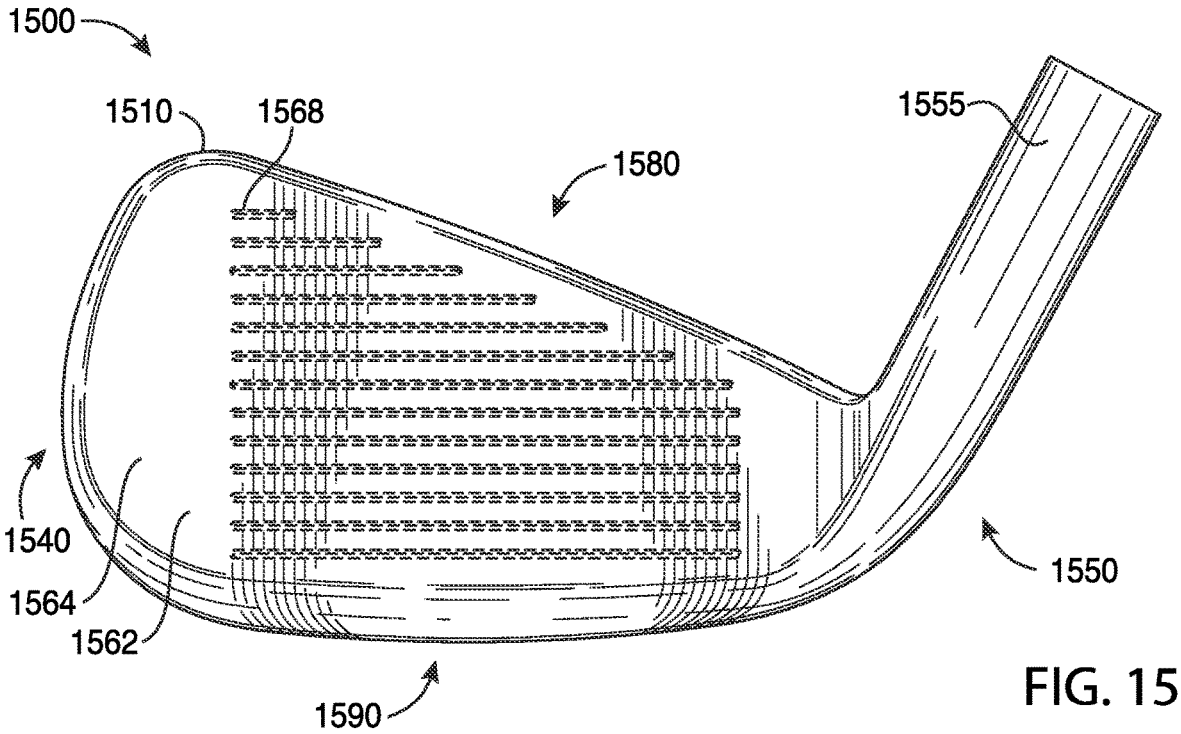
FIGS. 15, 16, 17, 18, 19, 20, 21, 22, 23, and 24 depict a front view, a rear view, a top view, a bottom view, a heel-side view, a toe-side view, a cross-sectional view along line 21-21 of FIG. 18, a cross-sectional view along line 22-22 of FIG. 17, a cross-sectional view along line 23-23 of FIG. 18, and another rear view, respectively, of a golf club head of the golf club of FIG. 14.
Figure 16:
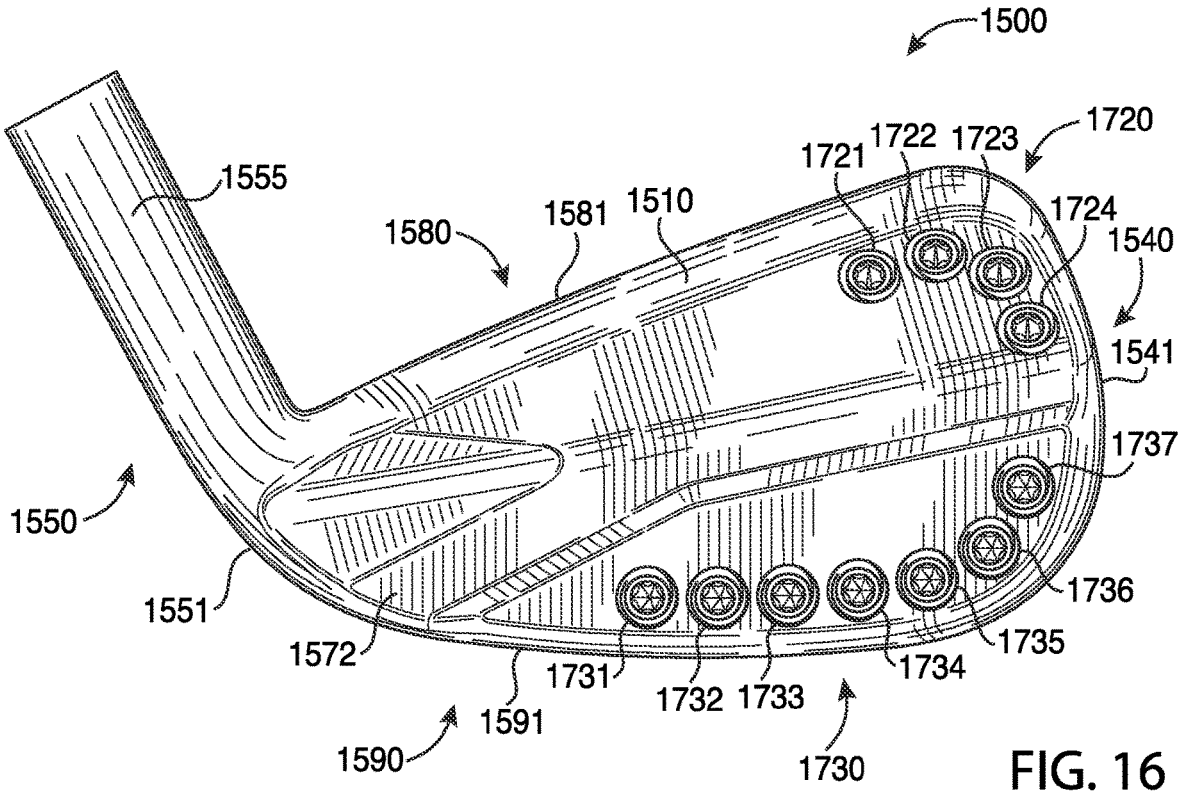
Figure 17:
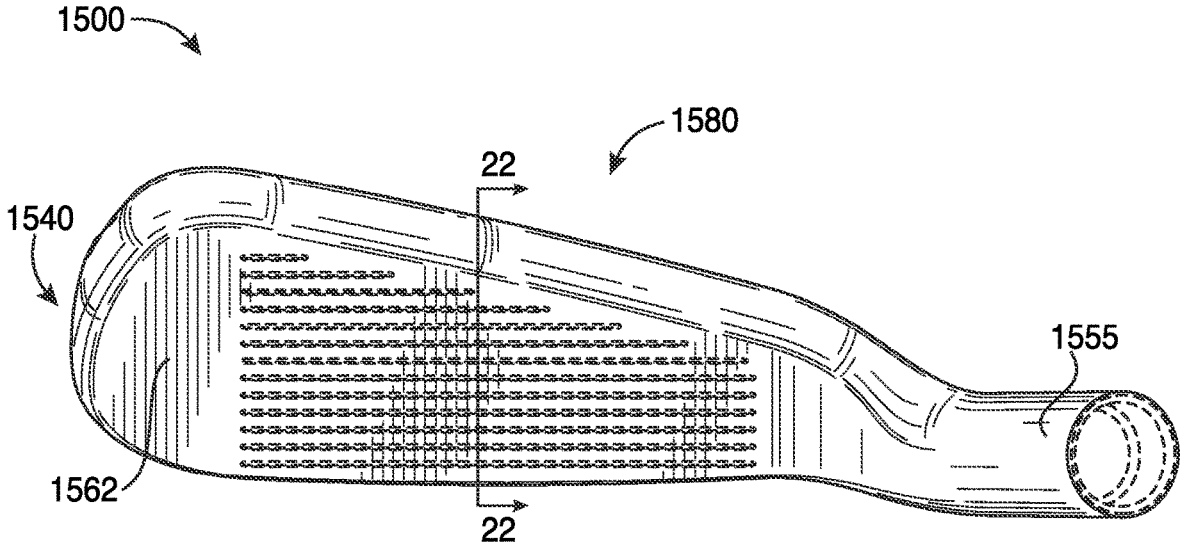
Figure 18:
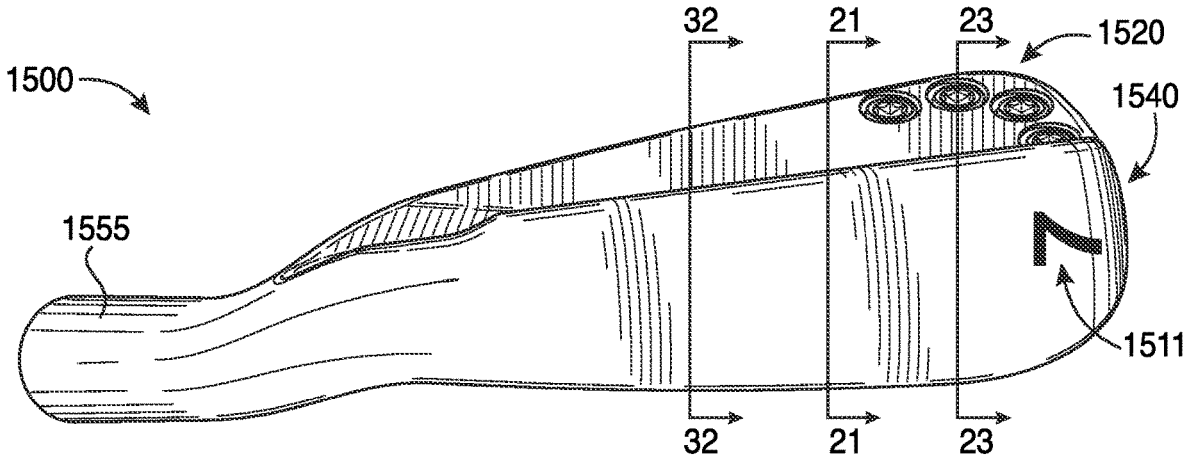
Figure 19:
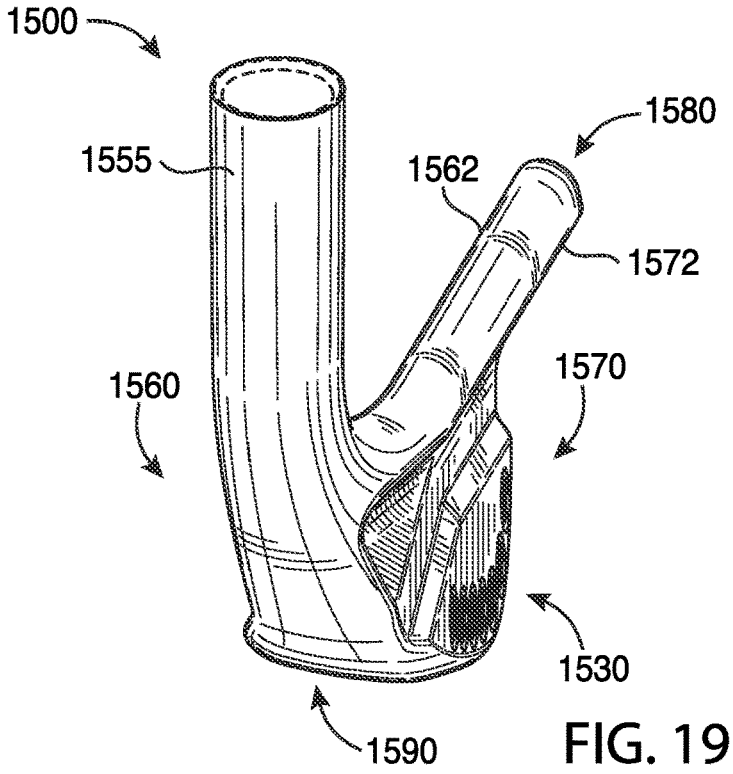
Figure 39:
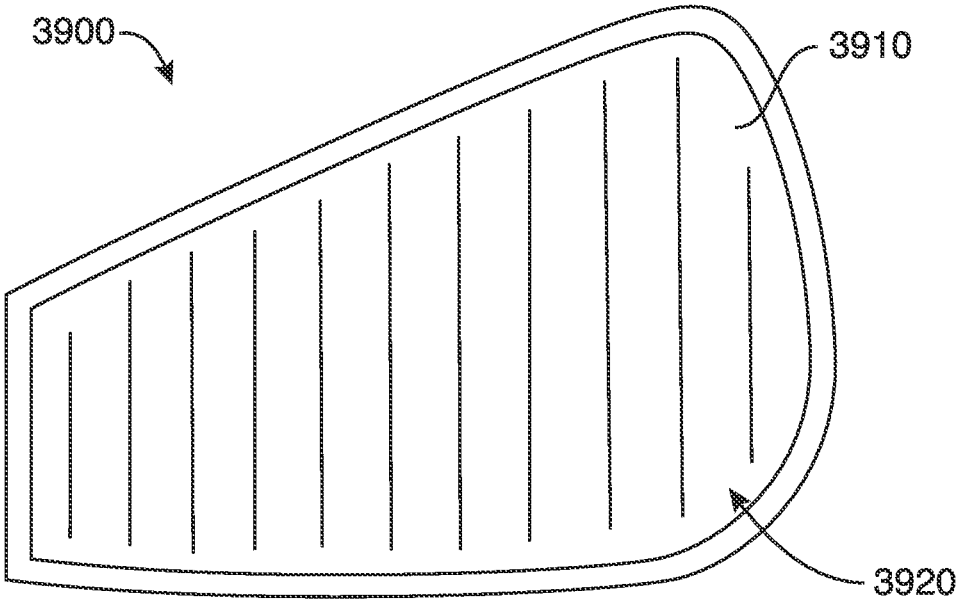
FIGS. 39, 40 and 41 depict back views of example face portions of the example golf club head of FIG. 15.
Figure 40:
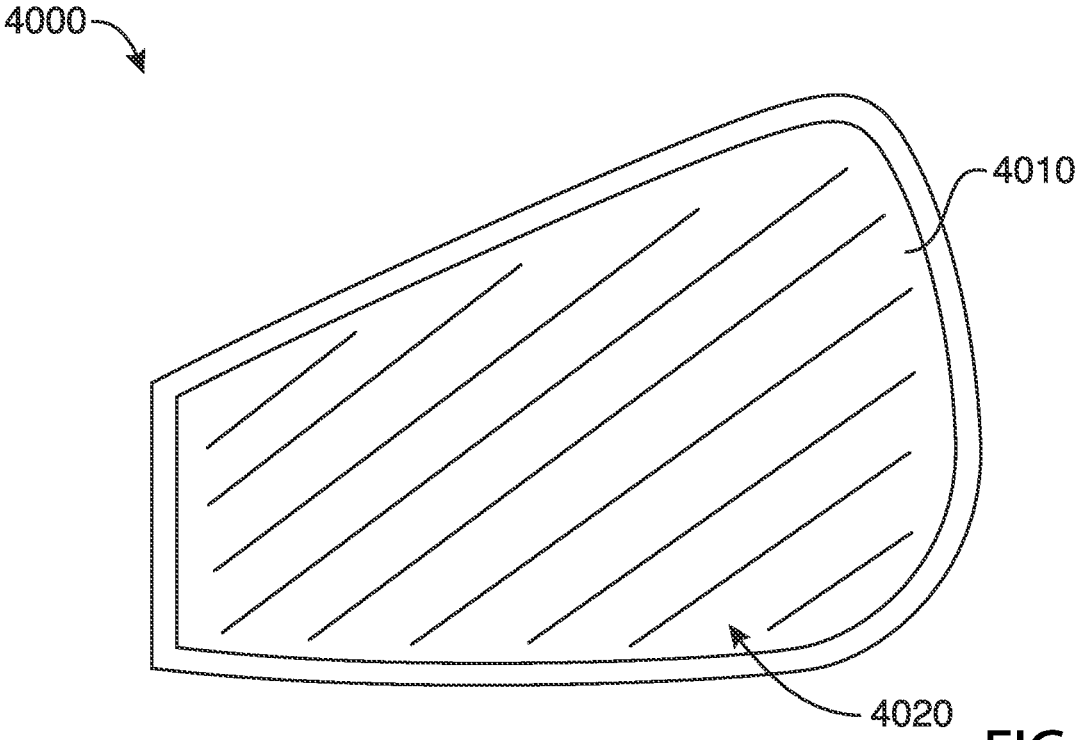
Figure 41:
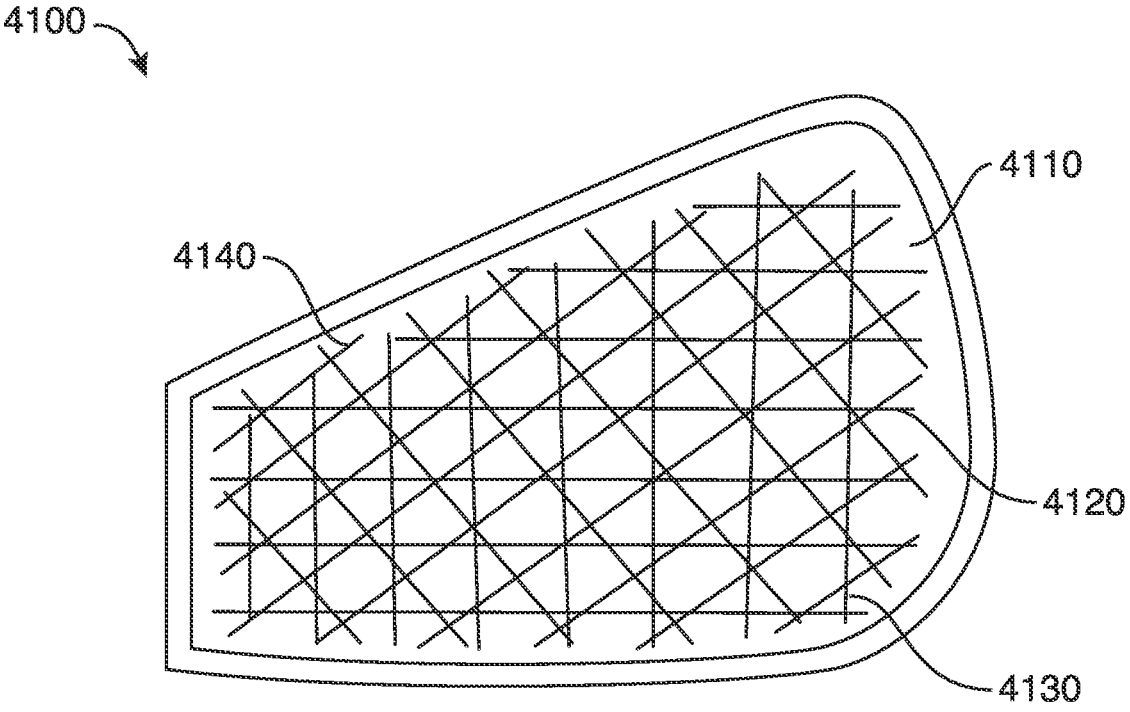

In the example as shown in FIG. 39, a face portion 3900, which may be any of the face portions described herein, may include a back surface 3910 with one or more channels, generally shown as 3920, extending laterally across the back surface 3910 (e.g., extending between the top portion 1580 and the sole portion 1590 of FIG. 15). In another example as depicted in FIG. 40, a face portion 4000, which may be any of the face portions described herein, may include a back surface 4010 with one or more channels, generally shown as 4020, extending diagonally across the back surface 4010. Alternatively, a face portion may include a combination of channels extending in different directions across a back surface of the face portion (e.g., extending longitudinally, laterally, and/or diagonally). Turning to FIG. 41, for yet another example, a face portion 4100, which may be any of the face portions described herein, may include a back surface 4110 with one or more channels, generally shown as 4120, 4130, and 4140, extending in different directions across the back surface 4110. In particular, the face portion 4100 may include a plurality of channels 4120 extending longitudinally across the back surface 4110, a plurality of channels 4130 extending laterally across the back surface 4110, and a plurality of channels 4140 extending diagonally across the back surface 4110.

Figure 42:
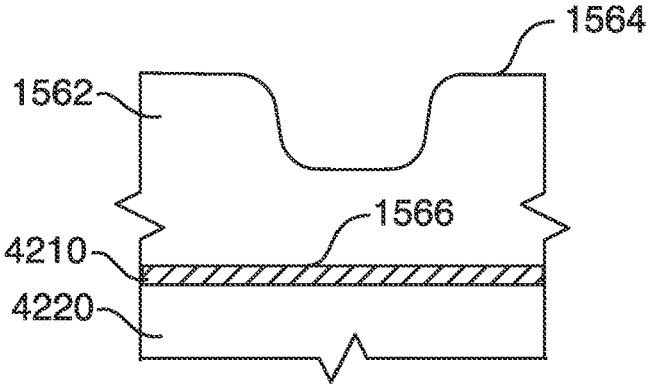
FIG. 42 depicts a cross-sectional view of a portion of the example golf club head of FIG. 15.

Referring to FIG. 42, for example, the golf club head 1500 may include the face portion 1562, a bonding portion 4210, and an elastic polymer material 4220. The bonding portion 4210 may provide connection, attachment and/or bonding of the elastic polymer material 4220 to the face portion 1562. The bonding portion 4210 may be a bonding agent, a combination of bonding agents, a bonding structure or attachment device, a combination of bonding structures and/or attachment devices, and/or a combination of one or more bonding agents, one or more bonding structures and/or one or more attachment devices. For example, the golf club head 1500 may include a bonding agent to improve adhesion and/or mitigate delamination between the face portion 1562 and the elastic polymer material used to fill the interior cavity 2100 of the golf club head 1500 (e.g., FIG. 21). In one example, the bonding portion 4210 may be low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In another example, the bonding portion 4210 may be LOCTITE® materials manufactured by Henkel Corporation, Rocky Hill, Conn. The bonding portion 4210 may be applied to the back surface 1566 to bond the elastic polymer material 4220 to the face portion 1562 (e.g., extending between the back surface 1566 and the elastic polymer material 4220). For example, the bonding portion 4210 may be applied when the interior cavity 2100 is filled with the elastic polymer material 4220 via an injection-molding process. In another example, the bonding portion 4210 may be an integral portion of the elastic polymer material 4220. Alternatively, the elastic polymer material 4220 may have adhesion properties. In other words, the elastic polymer material 4220 may adhere directly to the back surface 1566 of the face portion 1562, or the bonding portion 4210 may be included in the elastic polymer material 4220. The apparatus, methods, and articles of manufacture are not limited in this regard.

Figure 43:
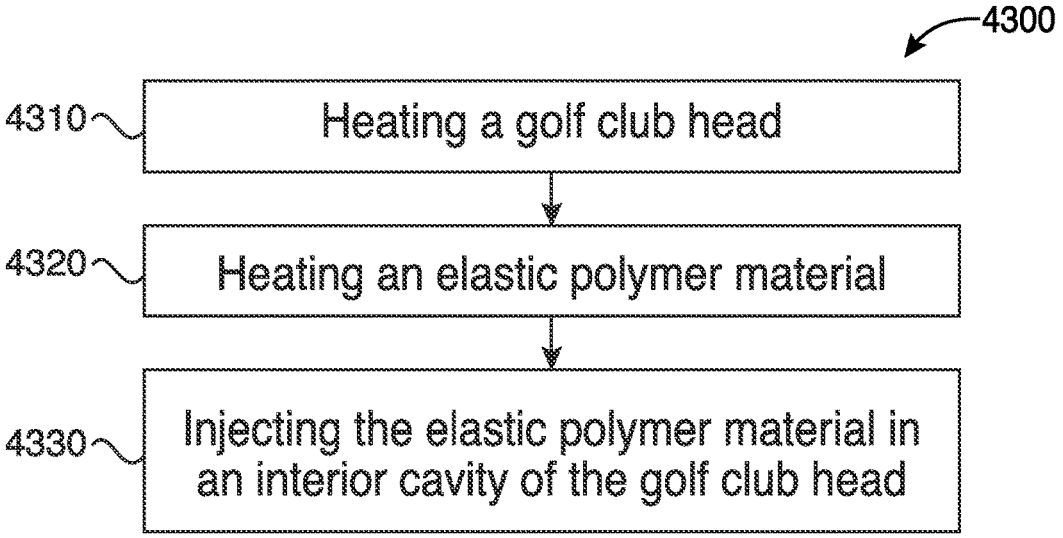
FIG. 43 depicts another manner in which an example golf club head described herein may be manufactured.

FIG. 43 depicts one manner in which the interior cavity 2100 of the golf club head 1500 or any of the golf club heads described herein is partially or entirely filled with an elastic polymer material or an elastomer material. The process 4300 may begin with heating the golf club head 1500 to a certain temperature (block 4310). In one example, the golf club head 1500 may be heated to a temperature ranging between 150° C. to 250° C., which may depend on factors such as the vaporization temperature of the elastic polymer material to be injected in the interior cavity 2100. The elastic polymer material may then be heated to a certain temperature (block 4320). The elastic polymer material may be a non-foaming and injection-moldable thermoplastic elastomer (TPE) material. Accordingly, the elastic polymer material may be heated to reach a liquid or a flowing state prior to being injected into the interior cavity 2100. The temperature to which the elastic polymer material may be heated may depend on the type of elastic polymer material used to partially or fully fill the interior cavity 2100. The heated elastic polymer material may be injected into the interior cavity 2100 to partially or fully fill the interior cavity 2100 (block 4330). The elastic polymer material may be injected into the interior cavity 2100 from one or more of the weight ports described herein (e.g., one or more weight ports of the first and second sets of weight ports 1620 and 1630, respectively, shown in FIG. 28). One or more other weight ports may allow the air inside the interior cavity 2100 displaced by the elastic polymer material to vent from the interior cavity 2100. In one example, the golf club head 1500 may be oriented horizontally as shown in FIG. 28 during the injection molding process. The elastic polymer material may be injected into the interior cavity 2100 from weight ports 1631 and 1632. The weight ports 1621, 1622 and/or 1623 may serve as air ports for venting the displaced air from the interior cavity 2100. Thus, regardless of the orientation of the golf club head 1500 during the injection molding process, the elastic polymer material may be injected into the interior cavity 2100 from one or more lower positioned weight ports while one or more upper positioned weight ports may serve as air vents. The mold (i.e., the golf club head 1500) may then be cooled passively (e.g., at room temperature) or actively so that the elastic polymer material reaches a solid state and adheres to the back surface 1566 of the face portion 1562. The elastic polymer material may directly adhere to the back surface 1566 of the face portion 1562. Alternatively, the elastic polymer material may adhere to the back surface 1566 of the face portion 1562 with the aid of the one or more structures on the back surface 1566 and/or a bonding agent described herein (e.g., the bonding portion 4210 shown in FIG. 42). The apparatus, methods, and articles of manufacture described herein are not limited in this regard.

As discussed above, the elastic polymer material may be heated to a liquid state (i.e., non-foaming) and solidifies after being injection molded in the interior cavity 2100. An elastic polymer material with a low modulus of elasticity may provide vibration and noise dampening for the face portion 1562 when the face portion 1562 impacts a golf ball. For example, an elastic polymer material that foams when heated may provide vibration and noise dampening. However, such a foaming elastic polymer material may not have sufficient rigidity to provide structural support to a relatively thin face portion because of possible excessive deflection and/or compression of the elastic polymer material when absorbing the impact of a golf ball. In one example, the elastic polymer material that is injection molded in the interior cavity 2100 may have a relatively high modulus of elasticity to provide structural support to the face portion 1562 and yet elastically deflect to absorb the impact forces experienced by the face portion 1562 when striking a golf ball. Thus, a non-foaming and injection moldable elastic polymer material with a relatively high modulus of elasticity may be used for partially or fully filling the interior cavity 2100 to provide structural support and reinforcement for the face portion 1562 in addition to providing vibration and noise dampening. That is, the non-foaming and injection moldable elastic polymer material may be a structural support portion for the face portion 1562. The apparatus, methods, and articles of manufacture are not limited in this regard.

Figure 44:
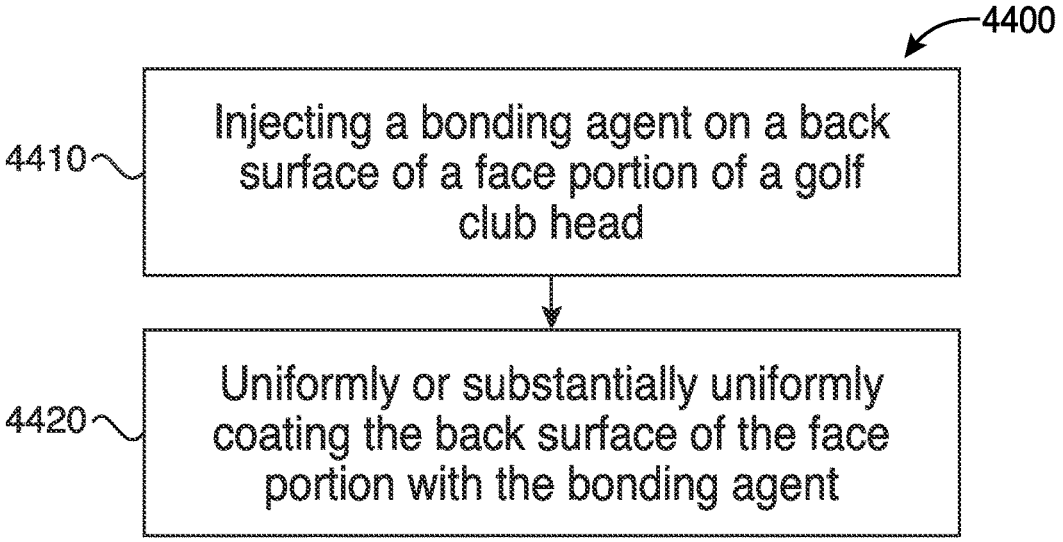
FIG. 44 depicts yet another manner in which an example golf club head described herein may be manufactured.

FIG. 44 depicts one manner in which a bonding agent as described herein may be applied to a golf club head prior to partially of fully injecting an elastic polymer in the interior cavity 2100. In the example of FIG. 44, the process 4400 may begin with injecting a bonding agent on the back surface 1566 of the face portion 1562 (block 4410). The bonding agent may be injected on the back surface 1566 prior to or after heating the golf club head as described above depending on the properties of the bonding agent. The bonding agent may be injected through one or more of the first set of weight ports 1620 and/or the second set of weight ports 1630. The bonding agent may be injected on the back surface 1566 through several or all of the first set of weight ports 1620 and the second set of weight ports 1630. For example, an injection instrument such as a nozzle or a needle may be inserted into each weight port until the tip or outlet of the instrument is near the back surface 1566. The bonding agent may then be injected on the back surface 1566 from the outlet of the instrument. Additionally, the instrument may be moved, rotated and/or swiveled while inside the interior cavity 2100 so that the bonding agent is injected onto an area of the back surface 1566 surrounding the instrument. For example, the outlet of the injection instrument may be moved in a circular pattern while inside a weight port to inject the bonding agent in a corresponding circular pattern on the back surface 1566. Each of the first set of weight ports 1620 and the second set of weight ports 1630 may be utilized to inject a bonding agent on the back surface 1566. However, utilizing all of first weight ports 1620 and/or the second set of weight ports 1630 may not be necessary. For example, using every other adjacent weight port may be sufficient to inject a bonding agent on the entire back surface 1566. In another example, weight ports 1621, 1622, 1631, 1633 and 1636 may be used to inject the bonding agent on the back surface 1566. The apparatus, methods, and articles of manufacture are not limited in this regard.

The process 4400 may also include spreading the bonding agent on the back surface 1566 (block 4420) after injection of the bonding agent onto the back surface 1566 so that a generally uniform coating of the bonding agent is provided on the back surface 1566. According to one example, the bonding agent may be spread on the back surface 1566 by injecting air into the interior cavity 2100 through one or more of the first set of weight ports 1620 and the second set of weight ports 1630. The air may be injected into the interior cavity 2100 and on the back surface 1566 by inserting an air nozzle into one or more of the first set of weight ports 1620 and the second set of weight ports 1630. According to one example, the air nozzle may be moved, rotated and/or swiveled at a certain distance from the back surface 1566 so as to uniformly blow air onto the bonding agent to spread the bonding agent on the back surface 1566 for a uniform coating or a substantially uniform coating of the bonding agent on the back surface 1566. The apparatus, methods, and articles of manufacture are not limited in this regard.

The example process 4400 is merely provided and described in conjunction with other figures as an example of one way to manufacture the golf club head 1500. While a particular order of actions is illustrated in FIG. 44, these actions may be performed in other temporal sequences. Further, two or more actions depicted in FIG. 44 may be performed sequentially, concurrently, or simultaneously. The process 4400 may include a single action of injecting and uniformly or substantially uniformly coating the back surface 1566 with the bonding agent. In one example, the bonding agent may be injected on the back surface 1566 by being converted into fine particles or droplets (i.e., atomized) and sprayed on the back surface 1566. Accordingly, the back surface 1566 may be uniformly or substantially uniformly coated with the bonding agent in one action. A substantially uniform coating of the back surface 1566 with the bonding agent may be defined as a coating having slight non-uniformities due to the injection process or the manufacturing process. However, such slight non-uniformities may not affect the bonding of the elastic polymer material or the elastomer material to the back surface 1566 with the bonding agent as described herein. For example, spraying the bonding agent on the back surface 1566 may result in overlapping regions of the bonding agent having a slightly greater coating thickness than other regions of the bonding agent on the back surface 1566. The apparatus, methods, and articles of manufacture are not limited in this regard.

Figure 45:
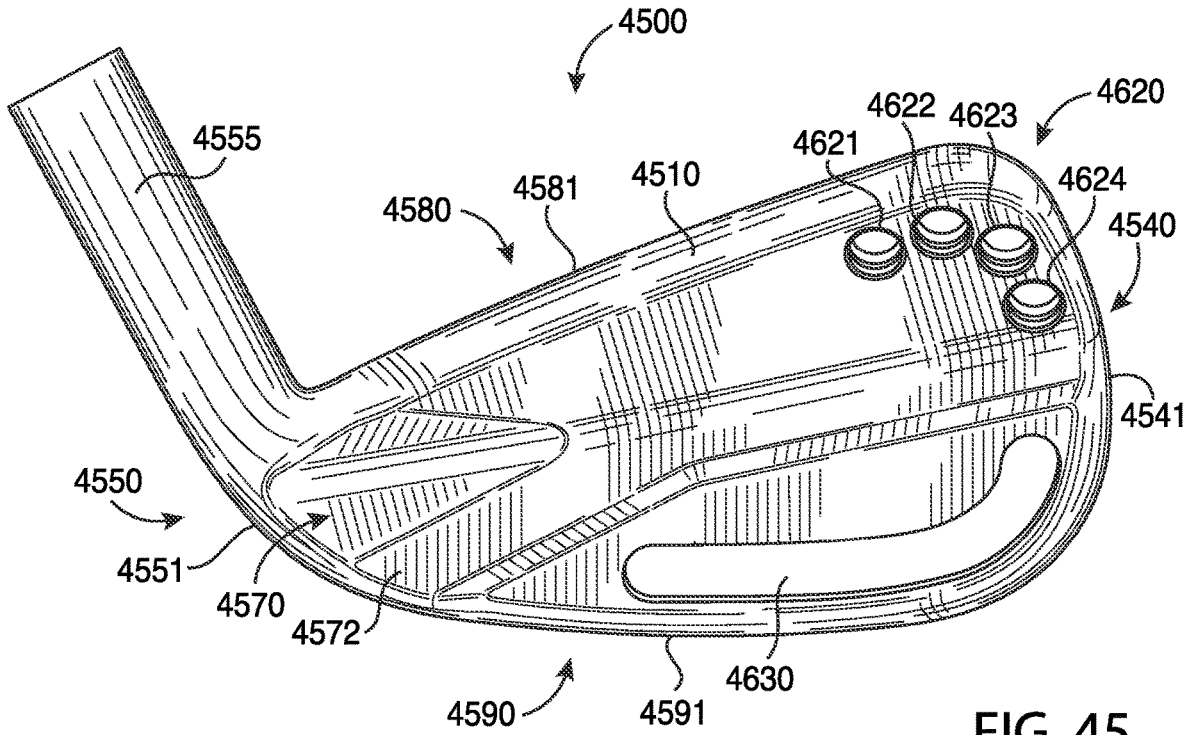
FIGS. 45 and 46 depict rear views of a golf club head according to an embodiment of the apparatus, methods, and articles of manufacture described herein.
Figure 46:
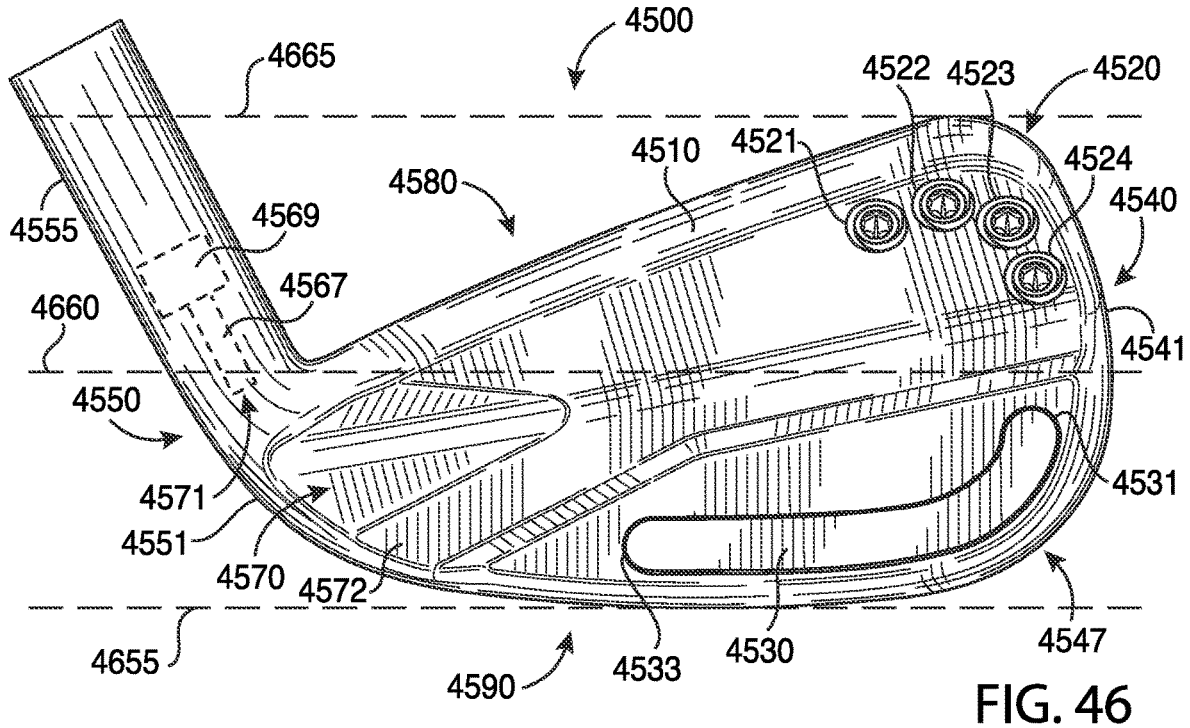
Figure 47:
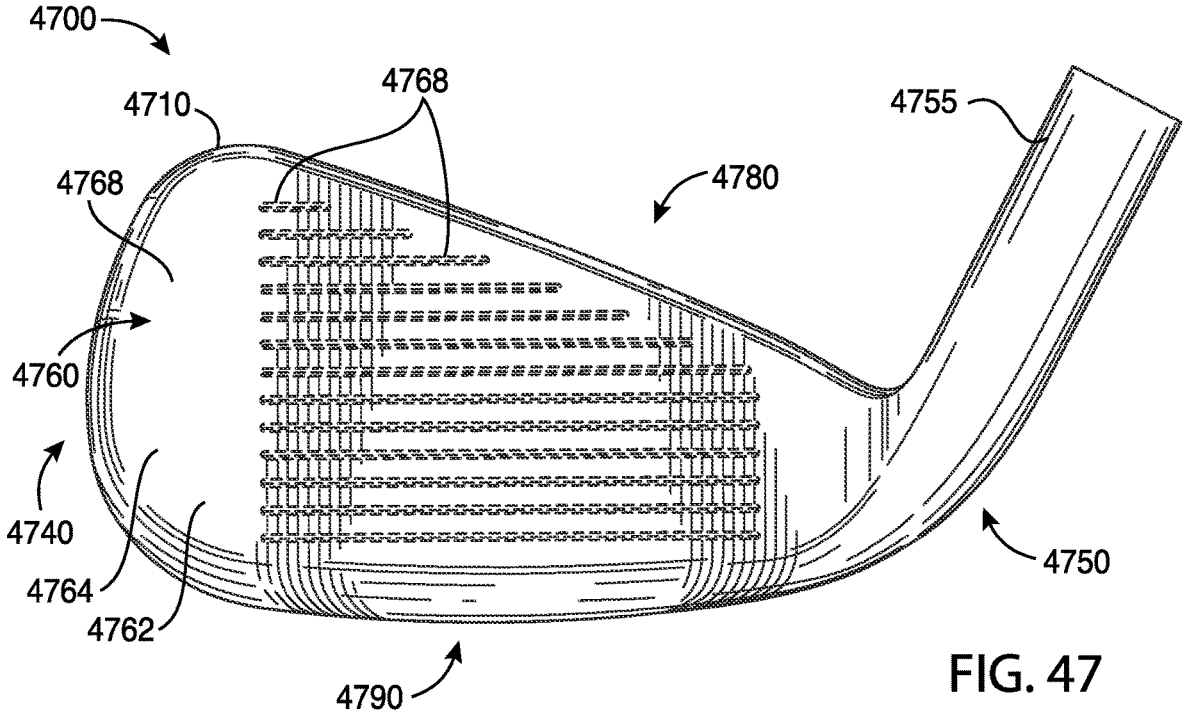
FIGS. 47, 48, 49, 50, 51, 52, 53, 54, and 55 depict a front view, a rear view, a rear perspective view, a rear view, a cross-sectional view along vertical section line 51-51 of FIG. 50, a cross-sectional view along vertical section line 52-52 of FIG. 50, a cross-sectional view along vertical section line 53-53 of FIG. 50, a cross-sectional view along vertical section line 54-54 of FIG. 50, and a cross-sectional view along vertical section line 55-55 of FIG. 50 of a golf club head according to an embodiment of the apparatus, methods, and articles of manufacture described herein.

As described herein, any two or more of the weight portions may be configured as a single weight portion. In the example of FIGS. 45 and 46, a golf club head 4500 may include a body portion 4510 and two or more weight portions, generally shown as a first set of weight portions 4520 (e.g., shown as weight portions 4521, 4522, 4523, and 4524) and a second weight portion 4530. The body portion 4510 may include a toe portion 4540 with a toe portion edge 4541, a heel portion 4550 with a heel portion edge 4551, a front portion (not shown), a back portion 4570 with a back wall portion 4572, a top portion 4580 with a top portion edge 4581, and a sole portion 4590 with a sole portion edge 4591. The golf club head 4500 may be similar in many respects to any of the golf club heads described herein.

The body portion 4510 may be made of a first material whereas the first set of weight portions 4520 and the second weight portion 4530 may be made of a second material. The first and second materials may be similar or different materials. For example, the body portion 4510 may be partially or entirely made of a steel-based material (e.g., 17-4 PH stainless steel, Nitronic® 50 stainless steel, maraging steel or other types of stainless steel), a titanium-based material, an aluminum-based material (e.g., a high-strength aluminum alloy or a composite aluminum alloy coated with a high-strength alloy), any combination thereof, and/or other suitable types of materials. The first set of weight portions 4520 and the second weight portion 4530 may be partially or entirely made of a high-density material such as a tungsten-based material or other suitable types of materials. Alternatively, the body portion 4510 and/or the first set of weight portions 4520 and the second weight portion 4530 may be partially or entirely made of a non-metal material (e.g., composite, plastic, etc.). The apparatus, methods, and articles of manufacture are not limited in this regard.

The golf club head 4500 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees (°), 48°, 52°, 56°, 60°, etc.). Although FIGS. 45 and 46 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard. The toe portion 4540 and the heel portion 4550 may be on opposite ends of the body portion 4510. The heel portion 4550 may include a hosel portion 4555 configured to receive a shaft (an example shown in FIG. 14) with a grip (an example shown in FIG. 14) on one end and the golf club head 4500 on the opposite end of the shaft to form a golf club.

The back portion 4570 may include a back wall portion 4572 with one or more exterior weight ports along a periphery of the back portion 4570, generally shown as a first set of exterior weight ports 4620 (e.g., shown as weight ports 4621, 4622, 4623, and 4624) above a horizontal midplane 4660 and a second weight port 4630 below the horizontal midplane 4660, which may be vertically halfway between the ground and top planes 4655 and 4665, respectively. The first set of weight ports 4620 and/or the second set of weight ports 4630 may be at any internal or external location on the body portion 4510. Each exterior weight port of the first set of weight ports 4620 may be associated with a port diameter. In one example, the port diameter may be about 0.25 inch (6.35 millimeters). Any two adjacent exterior weight ports of the first set of exterior weight ports 4620 may be separated by less than the port diameter. As shown in FIGS. 45 and 46, a distance between each weight port of the first set of exterior weight ports 4620 and the toe portion edge 4541 may be less than a distance between each exterior weight port of the first set of exterior weight ports 4620 and the hosel portion 4555, respectively. The first set of weight ports 4620 and the second weight port 4630 may be exterior weight ports configured to receive one or more weight portions.

Each weight portion of the first set of weight portions 4520 (e.g., shown as weight portions 4521, 4522, 4523, and 4524) may be disposed in a weight port of the first set of weight ports 4620 (e.g., shown as weight ports 4621, 4622, 4623, and 4624) located at or proximate to the toe portion 4540 and/or the top portion 4580 on the back portion 4570. For example, the weight portion 4521 may be partially or entirely disposed in the weight port 4621. In another example, the weight portion 4522 may be disposed in a weight port 4622 located in a transition region between the top portion 4580 and the toe portion 4540 (e.g., a top-and-toe transition region). The configuration of the first set of weight ports 4620 and the first set of weight portions 4520 is similar to many respects to the golf club head 1500. Accordingly, a detailed description of the configuration of the first set of weight ports 4620 and the first set of weight portions 4520 is not provided.

The second weight port 4630 may be a recess extending from the toe portion 4540 or a location proximate to the toe portion 4540 to the sole portion or a location proximate to the sole portion 4590 and through the transition region between the toe portion 4540 and the sole portion 4590. Accordingly, as shown in FIG. 46, the second weight port 4630 may resemble an L-shaped recess. The second weight portion 4530 may resemble the shape of the second weight port 4630 and may be configured to be disposed in the second weight port 4630. The second weight portion 4530 may have a first end 4531 and a second end 4533. As shown in FIG. 46, a distance between the first end 4531 and the toe portion edge 4541 may be less than a distance between the second end 4533 and the toe portion edge 4541. As further shown in FIG. 46, a distance between the first end 4531 and the horizontal midplane 4660 may be less than a distance between the second end 4533 and the horizontal midplane 4660. The second weight portion 4530 may be partially or fully disposed in the weight port 4630. For example, as shown in FIG. 45, the length of the second port 4630 may be greater than the width of the second port 4630. Accordingly, as shown in FIG. 46, the length of the second weight portion 4630 may be greater than the width of the second weight portion 4630 The second weight portion 4530 may have any shape such as oval, rectangular, triangular, or any geometric or non-geometric shape. The second weight port 4630 may be shaped similar to the second weight portion 4530. However, portions of the second weight portion 4530 that are inserted in the second weight port 4630 may have similar shapes as the weight port 4630. As described in detail herein, any of the weight portions described herein, including the weight portions 4520 and the second weight portion 4530 may be coupled to the back portion 4570 of the body portion 4510 with various manufacturing methods and/or processes (e.g., a bonding process, a welding process, a brazing process, a mechanical locking method, any combination thereof, or other suitable manufacturing methods and/or processes).

The second weight portion 4530 may be configured to place the center of gravity of the golf club head 1500 at an optimal location and optimize the moment of inertia of the golf club head about a vertical axis that extends through the center of gravity of the golf club head 4500. All or a substantial portion of the second weight portion 4530 may be generally near the sole portion 4590. For example, the second weight portion 4530 may be near the periphery of the body portion 4510 and extend from the sole portion 4590 to the toe portion 4540. As shown in the example of FIG. 46, the second weight portion 4530 may be located near the periphery of the body portion 4510 and partially or substantially extend along the sole portion 4590 to lower the center of gravity of the golf club head 4500. A portion of the second weight portion 4530 may be located near the periphery of the body portion 4510 and extend from the sole portion 4590 to the toe portion 4540 through a transition region 4547 between the sole portion 4590 and the toe portion 4540 to lower the center of gravity and increase the moment of inertia of the golf club head 4500 about a vertical axis that extends through the center of gravity. To lower the center of gravity of the golf club head 4500, all or a portion of the second weight portion 4530 may be located closer to the sole portion 4590 than to a horizontal midplane 4660 of the golf club head 4500. The location of the second weight portion 4530 (i.e., the location of the weight port 4630) and the physical properties and materials of construction of the weight portions of the second weight port 4630 may be determined to optimally affect the weight, weight distribution, center of gravity, moment of inertia characteristics, structural integrity and/or or other static and/or dynamic characteristics of the golf club head 4500. The apparatus, methods, and articles of manufacture described herein are not limited in this regard.

The weight portions of the first set of weight portions 4520 may have similar or different physical properties (e.g., color, shape, size, density, mass, volume, etc.). In the illustrated example as shown in FIG. 46, each of the weight portions of the first set of weight portions 4520 may have a cylindrical shape (e.g., a circular cross section). Alternatively, each of the weight portions of the first set of weight portions 4520 may have different shapes. Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

To balance the weight of a golf club head, such as any of the golf club heads described herein, a golf club head may include one or more hosel weight portions. In one example, the golf club head 4500 may include hosel weight portions 4567 and 4569. The hosel weight portion 4567 may be permanently attached to the hosel portion 4555 whereas the hosel weight portion 4569 may be removable and exchangeable with other hosel weight portions to balance the mass of the golf club head 4500 at the hosel portion 4555. The hosel weight portions 4567 and 4569 may be a third set of weight portions for the golf club head 4500. In one example, the hosel weight portions 4567 and 4569 and the first set of weight portions 4520 may be collectively the first set of weight portions. The apparatus, methods, and articles of manufacture described herein are not limited in this regard.

While the figures may depict a particular number of weight portions in the hosel portion 4555 (e.g., two shown as hosel weight portions 4567 and 4569), the apparatus, methods, and articles of manufacture described herein may include separate weight portions or a single weight portion (e.g., the hosel weight portions 4567 and 4569 may be a single weight portion). The hosel weight portions 4567 and/or 4569 may be the same or different material than the body portion 4510 and/or other weight portions of the golf club head 4500 (e.g., generally shown as 4520 and 4530). The mass of each of the hosel weight portions 4567 and 4569 may be greater than, less than, or equal to the mass of any other weight portions of the golf club head 4500 (e.g., generally shown as 4520 and 4530). Further, the hosel portion 4555 may include one or more ports configured to receive and/or engage one or more weight portions. In one example, a port (e.g. one shown as 4571 in FIG. 46) in the hosel portion 4555 may be connected to an interior cavity (e.g., one schematically shown as 2100 in FIG. 21) of the golf club head. The port 4571 in the hosel portion 4555 may include an opening. Accordingly, the interior cavity may be partially or entirely filled through an opening of the port 4571 in the hosel portion 4555. For example, the polymer material may be injected into the interior cavity from the port 4571. The hosel weight portions 4567 and/or 4569 may enclose the port 4571 in the hosel portion 4555. In one example, the hosel weight portions 4567 and/or 4569 may be a screw to engage the port 4571 in the hosel portion 4555. In another example, the hosel weight portions 4567 and/or 4569 may not include any threads (i.e., the hosel weight portions 4567 and/or 4569 may be coupled to the port 4571 in the hosel portion 4555 with or without adhesive. The apparatus, methods, and articles of manufacture described herein are not limited in this regard.

In the example of FIGS. 47-56, a golf club head 4700 may include a body portion 4710, and two or more weight portions, generally shown as a first set of weight portions 4720 (e.g., shown as weight portions 4721 and 4722) and a second set of weight portions 4730 (e.g., shown as weight portions 4731, 4732, 4733, 4734 and 4735). The body portion 4710 may include a toe portion 4740, a heel portion 4750, a front portion 4760, a back portion 4770, a top portion 4780, and a sole portion 4790. The heel portion 4750 may include a hosel portion 4755 configured to receive a shaft (an example shown in FIG. 14) with a grip (an example shown in FIG. 14) on one end and the golf club head 4700 on the opposite end of the shaft to form a golf club.

The body portion 4710 may be made of a first material whereas the first and second sets of weight portions 4720 and 4730, respectively, may be made of a second material. The first and second materials may be similar or different materials. The materials from which the golf club head 4700, weight portions 4720 and/or weight portions 4730 are constructed may be similar in many respects to any of the golf club heads and the weight portions described herein such as the golf club head 1500. Accordingly, a detailed description of the materials of construction of the golf club head 4700, weight portions 4720 and/or weight portions 4730 are not described in detail. The apparatus, methods, and articles of manufacture are not limited in this regard.

The golf club head 4700 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees (°), 48°, 52°, 56°, 60°, etc.). Although FIGS. 47-56 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The front portion 4760 may include a face portion 4762 (e.g., a strike face). The face portion 4762 may include a front surface 4764 and a back surface 4766 (shown in FIG. 51). The front surface 4764 may include one or more grooves 4768 extending between the toe portion 4740 and the heel portion 4750. While the figures may depict a particular number of grooves, the apparatus, methods, and articles of manufacture described herein may include more or less grooves. The face portion 4762 may be used to impact a golf ball (not shown). The face portion 4762 may be an integral portion of the body portion 4710. Alternatively, the face portion 4762 may be a separate piece or an insert coupled to the body portion 4710 via various manufacturing methods and/or processes (e.g., a bonding process such as adhesive, a welding process such as laser welding, a brazing process, a soldering process, a fusing process, a mechanical locking or connecting method, any combination thereof, or other suitable types of manufacturing methods and/or processes). The face portion 4762 may be associated with a loft plane that defines the loft angle of the golf club head 4700. The loft angle may vary based on the type of golf club (e.g., a long iron, a middle iron, a short iron, a wedge, etc.). In one example, the loft angle may be between five degrees and seventy-five degrees. In another example, the loft angle may be between twenty degrees and sixty degrees. The loft angle of the golf club head may be similar in many respects to the loft angle of the golf club head 1500 as shown in FIG. 20. The apparatus, methods, and articles of manufacture described herein are not limited in this regard.

Figure 50:
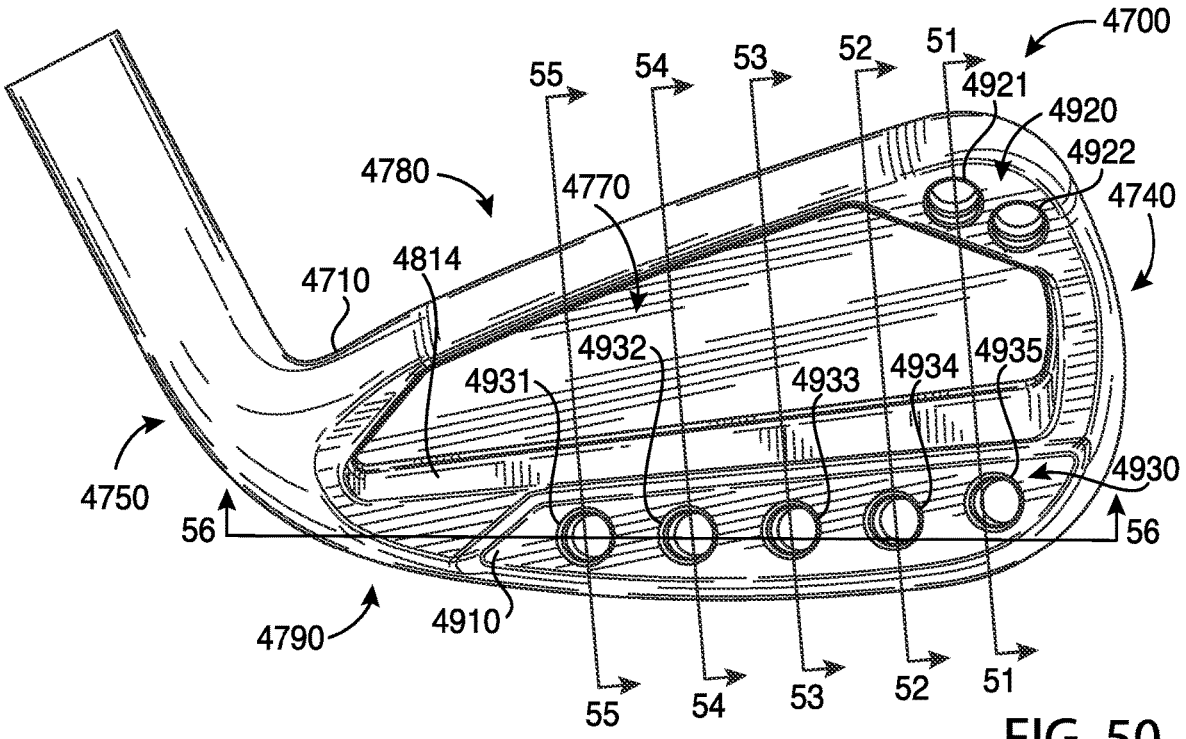

As illustrated in FIG. 50, the back portion 4770 may include a back wall portion 4910 with one or more exterior weight ports along a periphery of the back portion 4770, generally shown as a first set of exterior weight ports 4920 (e.g., shown as weight ports 4921 and 4922) and a second set of exterior weight ports 4930 (e.g., shown as weight ports 4931, 4932, 4933, 4934 and 4935). Each exterior weight port may be defined by an opening in the back wall portion 4910. Each exterior weight port may be associated with a port diameter. In one example, the port diameter may be about 0.25 inch (6.35 millimeters). The weight ports of the first set of exterior weight ports 4920 may be separated by less than the port diameter or the port diameter of any of the two adjacent weight ports of the first set of exterior weight ports 4920. In a similar manner, any two adjacent exterior weight ports of the second set of exterior weight ports 4930 may be separated by less than the port diameter or the port diameter of any of the two adjacent weight ports of the second set of exterior weight ports 4930. The first and second exterior weight ports 4920 and 4930, respectively, may be exterior weight ports configured to receive one or more weight portions. In particular, each weight portion of the first set of weight portions 4720 (e.g., shown as weight portions 4721 and 4722) may be disposed in a weight port located at or proximate to the toe portion 4740 and/or the top portion 4780 on the back portion 4770. For example, the weight portion 4721 may be partially or entirely disposed in the weight port 4921. In another example, the weight portion 4722 may be disposed in the weight port 4922 located in a transition region between the top portion 4780 and the toe portion 4740 (e.g., a top-and-toe transition region). Each weight portion of the second set of weight portions 4730 (e.g., shown as weight portions 4731, 4732, 4733, 4734 and 4735) may be disposed in a weight port located at or proximate to the toe portion 4740 and/or the sole portion 4790 on the back portion 4770. For example, the weight portion 4733 may be partially or entirely disposed in the weight port 4933. In another example, the weight portion 4735 may be disposed in a weight port 4935 located in a transition region between the sole portion 4790 and the toe portion 4740 (e.g., a sole-and-toe transition region). In another example, any of the weight portions of the first set of weight portions 4720 and the second set of weight portions 4730 may disposed in any of the weight ports of the first set of weight ports 4920 and the second set of weight ports 4930. As described in detail herein, the first and second sets of weight portions 4720 and 4730, respectively, may be coupled to the back portion 4770 of the body portion 4710 with various manufacturing methods and/or processes (e.g., a bonding process, a welding process, a brazing process, a mechanical locking method, any combination thereof, or other suitable manufacturing methods and/or processes).

Alternatively, the golf club head 4700 may not include (i) the first set of weight portions 4720, (ii) the second set of weight portions 4730, or (iii) both the first and second sets of weight portions 4720 and 4730. In particular, the back portion 4770 of the body portion 4710 may not include weight ports at or proximate to the top portion 4780 and/or the sole portion 4790. For example, the mass of the first set of weight portions 4720 (e.g., 3 grams) and/or the mass of the second set of weight portions 4730 (e.g., 16.8 grams) may be integral part(s) the body portion 4710 instead of separate weight portion(s). The apparatus, methods, and articles of manufacture described herein are not limited in this regard.

The first and second sets of weight portions 4720 and 4730, respectively, may have similar or different physical properties (e.g., color, shape, size, density, mass, volume, etc.). As a result, the first and second sets of weight portions 4720 and 4730, respectively, may contribute to the ornamental design of the golf club head 4700. The physical properties of the first and second sets of weight portions 4720 and 4730 may be similar in many respect to any of the weight portions described herein, such as the weight portions shown in the example of FIGS. 25-27. Furthermore, the devices and/or methods by which the first and second set of weight portions 4720 and 4730 are coupled to the golf club head 4700 may be similar in many respect to any of the weight portions described herein, such as the weight portions shown in the example of FIGS. 25-27. Accordingly, a detailed description of the physical properties of the first and second sets of weight portions 4720 and 4730, and the devices and/or methods by which the first and second sets of weight portions 4720 and 4730 are coupled to the golf club head 4700 are not described in detail herein. The apparatus, methods, and articles of manufacture described herein are not limited in this regard.

Figure 48:
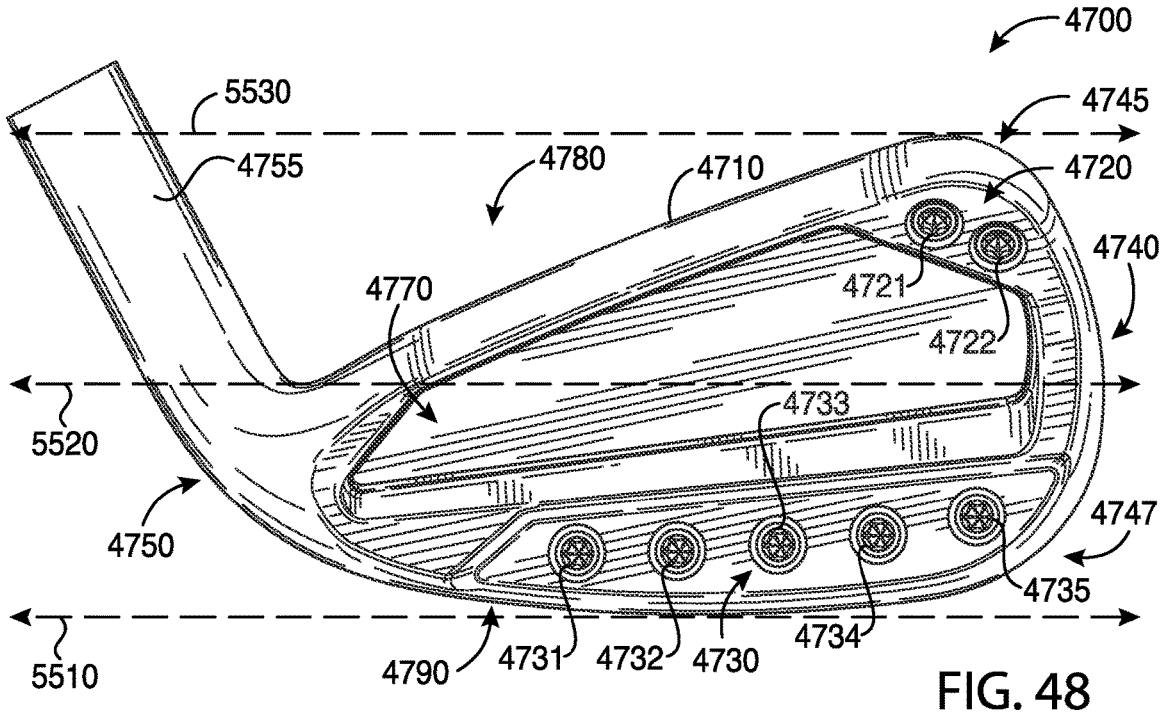
Figure 49:
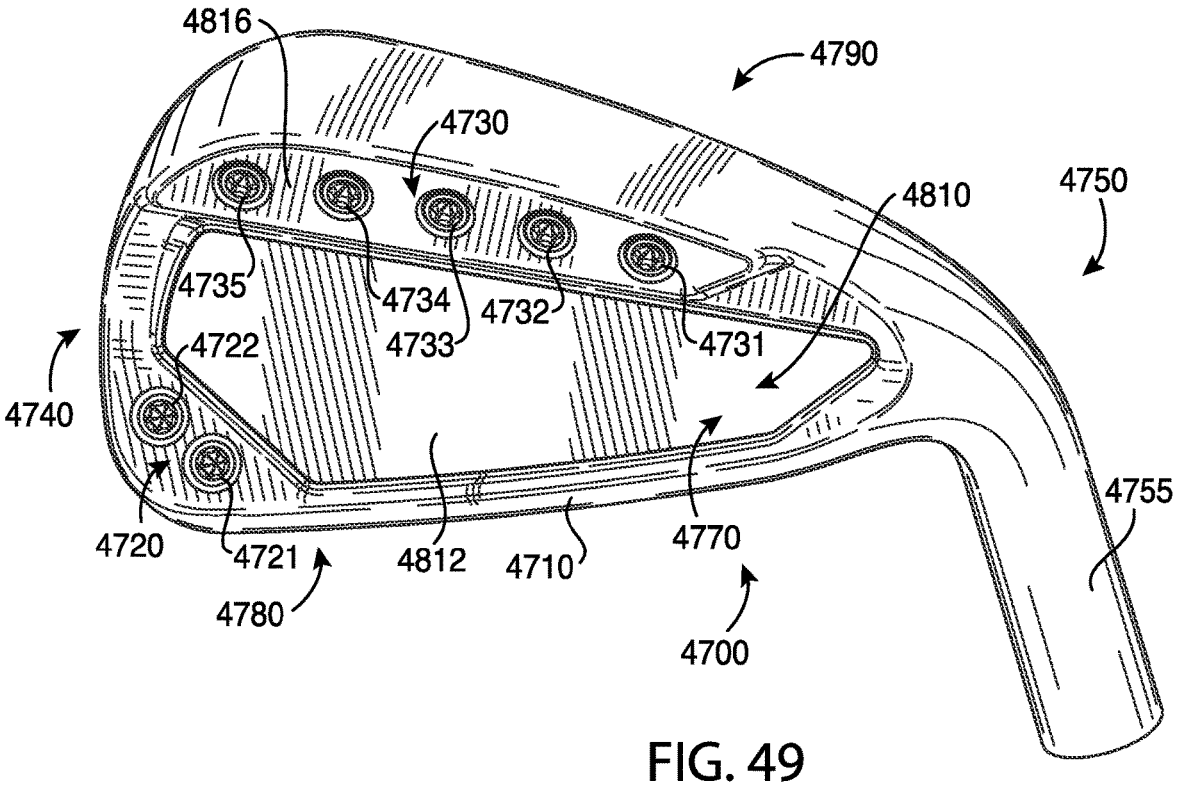

As illustrated in FIG. 48, golf club head 4700 may be associated with a ground plane 5510, a horizontal midplane 5520, and a top plane 5530. In particular, the ground plane 5510 may be a plane that may be substantially parallel with the ground and be tangential to the sole portion 4790 of the golf club head 4700 when the golf club head 4700 is at an address position (e.g., the golf club head 4700 is aligned to strike a golf ball). A top plane 5530 may be a tangential plane to the top portion of the 4780 of the golf club head 4700 when the golf club head 4700 is at the address position. The ground and top planes 5510 and 5530, respectively, may be substantially parallel to each other. The horizontal midplane 5520 may be located at half the vertical distance between the ground and top planes 5510 and 5530, respectively.

To provide optimal perimeter weighting for the golf club head 4700, the first set of weight portions 4720 (e.g., weight portions 4721 and 4722) may be configured to counterbalance the weight of the hosel portion 4755 and/or increase the moment of inertia of the golf club head 4700 about a vertical axis of the golf club head 4700 that extends through the center of gravity of the golf club head 4700. For example, as shown in FIG. 48, the first set of weight portions 4720 (e.g., weight portions 4721 and 4722) may be located near the periphery of the body portion 4710 and extend in a transition region 4745 between the top portion 4780 and the toe portion 4740. In another example, the first set of weight portions 4720 (e.g., weight portions 4721 and 4722) may be located near the periphery of the body portion 4710 and extend proximate to the toe portion 4740. The locations of the first set of weight portions 4720 (i.e., the locations of the first set of weight ports 4920) and the physical properties and materials of construction of the weight portions of the first set of weight portions 4720 may be determined to optimally affect the weight, weight distribution, center of gravity, moment of inertia characteristics, structural integrity and/or or other static and/or dynamic characteristics of the golf club head 4700. The apparatus, methods, and articles of manufacture described herein are not limited in this regard.

The second set of weight portions 4730 (e.g., weight portions 4731, 4732, 4733, 4734 and 4735) may be configured to place the center of gravity of the golf club head 4700 at an optimal location and/or optimize the moment of inertia of the golf club head about a vertical axis that extends through the center of gravity of the golf club head 4700. Referring to FIG. 48, all or a substantial portion of the second set of weight portions 4730 may be near the sole portion 4790. For example, the second set of weight portions 4730 (e.g., weight portions 4731, 4732, 4733, 4734 and 4735) may extend at or near the sole portion 4790 between the toe portion 4740 and the heel portion 4750 to lower the center of gravity of the golf club head 1500. The weight portions 4734 and 4735 may be located closer to the toe portion 4740 than to the heel portion 4750 and/or at or near a transition region 4747 between the sole portion 4790 and the toe portion 4740 to increase the moment of inertia of the golf club head 4700 about a vertical axis that extends through the center of gravity. Some of the weight portions of the second set of weight portions 4730 may be located at the toe portion. To lower the center of gravity of the golf club head 4700, all or a portion of the second set of weight portions 4730 may be located closer to the sole portion 4790 than to the horizontal midplane 5520. The locations of the second set of weight portions 4730 (i.e., the locations of the second set of weight ports 4930) and the physical properties and materials of construction of the weight portions of the second set of weight portions 4730 may be determined to optimally affect the weight, weight distribution, center of gravity, moment of inertia characteristics, structural integrity and/or or other static and/or dynamic characteristics of the golf club head 4700. The apparatus, methods, and articles of manufacture described herein are not limited in this regard.

Figure 51:
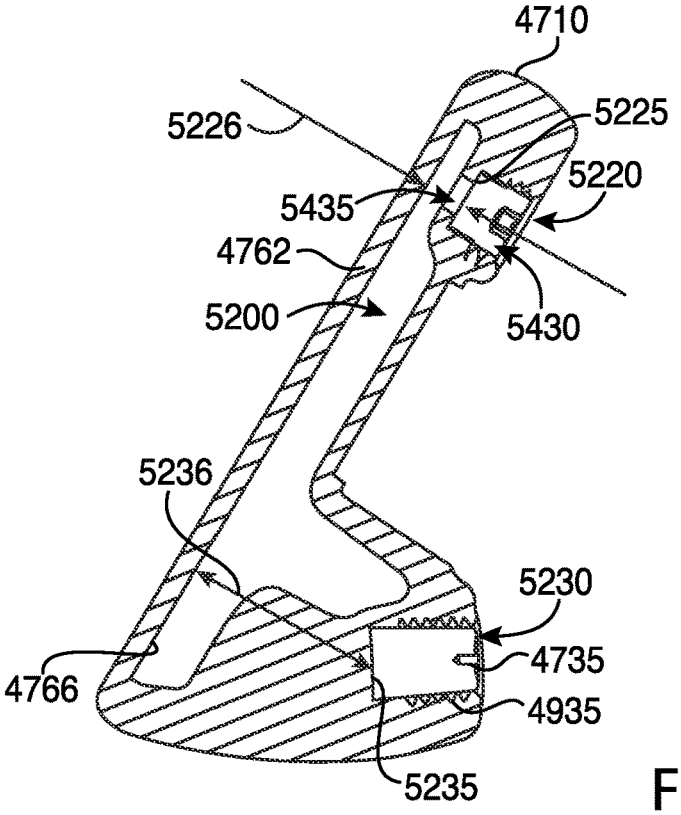

Turning to FIG. 51, for example, the first and second sets of weight portions 4720 and 4730, respectively, may be located away from the back surface 4766 of the face portion 4762 (e.g., not directly coupled to each other). That is, the first and second sets of weight portions 4720 and 4730, respectively, and the back surface 4766 may be partially or entirely separated by an interior cavity 5200 of the body portion 4710. For example, each exterior weight port of the first and second sets of exterior weight ports 4720 and 4730 may include an opening (e.g., generally shown as 5220 and 5230) and a port wall (e.g., generally shown as 5225 and 5235). The port walls 5225 and 5235 may be integral portions of the back wall portion 4910 (e.g., a section of the back wall portion 4910). Each of the openings 5220 and 5230 may be configured to receive a weight portion such as weight portions 4721 and 4735, respectively. The opening 5220 may be located at one end of the weight port 4921, and the port wall 5225 may be located or proximate to at an opposite end of the weight port 4921. In a similar manner, the opening 5230 may be located at one end of the weight port 4935, and the port wall 5235 may be located at or proximate to an opposite end of the weight port 4935. The port walls 5225 and 5235 may be separated from the face portion 4762 (e.g., separated by the interior cavity 5200). Each port wall of the first set of weight ports 4920, such as the port wall 5225 may have a distance 5226 from the back surface 4766 of the face portion 4762 as shown in FIG. 51. Each port wall of the second set of weight ports 4930, such as the port wall 5235 may have a distance 5236 from the back surface 4766 of the face portion 4762. The distances 5226 and 5236 may be determined to optimize the location of the center of gravity of the golf club head 4700 when the first and second sets of weight ports 4920 and 4930, respectively, receive weight portions as described herein. According to one example, the distance 5236 may be greater than the distance 5226 so that the center of gravity of the golf club head 4700 is moved toward the back portion 4770 and/or lowered toward the sole portion 4790. According to one example, the distance 5236 may be greater than the distance 5226 by a factor ranging from about 1.5 to about 4. In other words, the distance 5236 may be about 1.5 times to about 4 times greater than the distance 5226. As a result, a width 5240 (shown in FIG. 52) of a portion of the interior cavity 5200 below the horizontal midplane 5520 may be greater than a width 5242 of the interior cavity 5200 above the horizontal midplane 5520. As shown in the figures (e.g., FIGS. 4, 21, 22, 23, 32, and 51-56) the apparatus, methods, and articles of manufacture described herein may include at least a portion of at least a weight portion (e.g., the first set of weight portions or the second set of weight portions) closer to the face portion than at least a portion of a polymer material in the interior cavity. In one example as illustrated FIGS. 47-56, at least a portion of at least one of the weight portions of the first set of weight portions 4720 (e.g., one generally shown as 4721 and/or 4722) or the second set of weight portions 4730 (e.g., one generally shown as 4731, 4732, 4733, 4734, and/or 4735) may be closer to the face portion 4762 than at least a portion of a polymer material, which may partially or entirely fill the interior cavity 5200. The apparatus, methods, and articles of manufacture described herein are not limited in this regard.

As discussed herein, the center of gravity (CG) of the golf club head 4700 may be relatively farther back from the face portion 4762 and relatively lower towards a ground plane (e.g., one shown as 5510 in FIG. 48) as compared to a golf club without a width 5240 of a portion of the interior cavity 5200 being greater than a width 5242 of the interior cavity 5200 as described herein, with all or a substantial portion of the second set of weight portions 4730 being closer to the sole portion 4790 than to the horizontal midplane 5520, and the first and second sets of weight portions 4720 and 4730, respectively, being away from the back surface 4766 than if the second set of weight portions 4730 were directly coupled to the back surface 4766. The locations of the first and second sets of weight ports 4920 and 4930 and the physical properties and materials of construction of the weight portions of the first and second sets of weight portions 4720 and 4730, respectively, may be determined to optimally affect the weight, weight distribution, center of gravity, moment of inertia characteristics, structural integrity and/or or other static and/or dynamic characteristics of the golf club head 4700. The apparatus, methods, and articles of manufacture described herein are not limited in this regard.

While the figures may depict weight ports with a particular cross-section shape, the apparatus, methods, and articles of manufacture described herein may include weight ports with other suitable cross-section shapes. The weight ports of the first and/or second sets of weight ports 4920 and 4930 may have cross-sectional shapes that are similar to the cross-sectional shapes of any of the weight ports described herein. Accordingly, the detailed description of the cross-sectional shapes of the weight ports 4920 and 4930 are not described in detail. The apparatus, methods, and articles of manufacture described herein are not limited in this regard.

The first and second sets of weight portions 4720 and 4730, respectively, may be similar in mass (e.g., all of the weight portions of the first and second sets 4720 and 4730, respectively, weigh about the same). Alternatively, the first and second sets of weight portions 4720 and 4730, respectively, may be different in mass individually or as an entire set. In particular, each of the weight portions of the first set of weight portions 4720 (e.g., shown as 4721 and 4722) may have relatively less mass than any of the weight portions of the second set of weight portions 4730 (e.g., shown as 4731, 4732, 4733, 4734 and 4735). For example, the second set of weight portions 4730 may account for more than 50% of the total mass from exterior weight portions of the golf club head 4700. As a result, the golf club head 4700 may be configured to have at least 50% of the total mass from exterior weight portions disposed below the horizontal midplane 5520. In one example, the total mass from exterior weight portions may be greater below the horizontal midplane 5520 that the total mass from exterior weight portions above the horizontal midplane 5520. The apparatus, methods, and articles of manufacture described herein are not limited in this regard.

In one example, the golf club head 4700 may have a mass in the range of about 220 grams to about 330 grams based on the type of golf club (e.g., a 4-iron versus a lob wedge). The body portion 4710 may have a mass in the range of about 200 grams to about 310 grams with the first and second sets of weight portions 4720 and 4730, respectively, having a mass of about 20 grams (e.g., a total mass from exterior weight portions). Each of the weight portions of the first set of weight portions 4720 may have a mass of about one gram (1.0 g) whereas each of the weight portions of the second set of weight portions 4730 may have a mass of about 2.4 grams. The sum of the mass of the first set of weight portions 4720 may be about 3 grams whereas the sum of the mass of the first set of weight portions 4730 may be about 16.8 grams. The total mass of the second set of weight portions 4730 may weigh more than five times as much as the total mass of the first set of weight portions 4720 (e.g., a total mass of the second set of weight portions 4730 of about 16.8 grams versus a total mass of the first set of weight portions 4720 of about 3 grams). The golf club head 4700 may have a total mass of 19.8 grams from the first and second sets of weight portions 4720 and 4730, respectively (e.g., sum of 3 grams from the first set of weight portions 4720 and 16.8 grams from the second set of weight portions 4730). Accordingly, the first set of weight portions 4720 may account for about 15% of the total mass from exterior weight portions of the golf club head 4700 whereas the second set of weight portions 4730 may be account for about 85% of the total mass from exterior weight portions of the golf club head 4700. The apparatus, methods, and articles of manufacture described herein are not limited in this regard.

By coupling the first and second sets of weight portions 4720 and 4730, respectively, to the body portion 4710 (e.g., securing the first and second sets of weight portions 4720 and 4730 in the weight ports on the back portion 4770), the location of the center of gravity (CG) and the moment of inertia (MOI) of the golf club head 4700 may be optimized. In particular, the first and second sets of weight portions 4720 and 4730, respectively, may lower the location of the CG towards the sole portion 4790 and further back away from the face portion 4762. Further, the MOI may be higher as measured about a vertical axis extending through the CG (e.g., perpendicular to the ground plane 5510). The MOI may also be higher as measured about a horizontal axis extending through the CG (e.g., extending towards the toe and heel portions 4740 and 4750, respectively, of the golf club head 4700). As a result, the club head 4700 may provide a relatively higher launch angle and a relatively lower spin rate than a golf club head without the first and second sets of weight portions 4720 and 4730, respectively. The apparatus, methods, and articles of manufacture described herein are not limited in this regard.

Alternatively, two or more weight portions in the same set may be different in mass. In one example, the weight portion 4721 of the first set of weight portions 4720 may have a relatively lower mass than the weight portion 4722 of the first set of weight portions 4720. In another example, the weight portion 4731 of the second set of weight portions 4730 may have a relatively lower mass than the weight portion 4735 of the second set of weight portions 4730. With relatively greater mass at the top-and-toe transition region and/or the sole-and-toe transition region, more weight may be distributed away from the center of gravity (CG) of the golf club head 4700 to increase the moment of inertia (MOI) about the vertical axis through the CG.

Although the figures may depict the weight portions as separate and individual parts, each set of the first and second sets of weight portions 4720 and 4730, respectively, may be a single piece of weight portion. In one example, all of the weight portions of the first set of weight portions 4720 (e.g., shown as 4721 and 4722) may be combined into a single piece of weight portion (e.g., a first weight portion). In a similar manner, all of the weight portions of the second set of weight portions 4730 (e.g., 4731, 4732, 4733, 4734 and 4735) may be combined into a single piece of weight portion as well (e.g., a second weight portion) similar to the example of FIG. 46. While the figures may depict a particular number of weight portions, the apparatus, methods, and articles of manufacture described herein may include more or less number of weight portions. The apparatus, methods, and articles of manufacture described herein are not limited in this regard.

The body portion 4710 may be a hollow body including the interior cavity 5200 extending between the front portion 4760 and the back portion 4770. Further, the interior cavity 5200 may extend between the top portion 4780 and the sole portion 4790. The interior cavity 5200 may be associated with a cavity height 5250 ($H_C$), and the body portion 4710 may be associated with a body height 5350 ($H_B$). While the cavity height 5250 and the body height 5350 may vary between the toe and heel portions 4740 and 4750, and the top and sole portions 4780 and 4790, the cavity height 5250 may be at least 50% of a body height 5350 ($H_C$>0.5*$H_B$). For example, the cavity height 5250 may vary between 70%-85% of the body height 5350. With the cavity height 5250 of the interior cavity 5200 being greater than 50% of the body height 5350, the golf club head 4700 may produce relatively more consistent feel, sound, and/or result when the golf club head 4700 strikes a golf ball via the face portion 4762 than a golf club head with a cavity height of less than 50% of the body height. The apparatus, methods, and articles of manufacture described herein are not limited in this regard.

Figure 52:
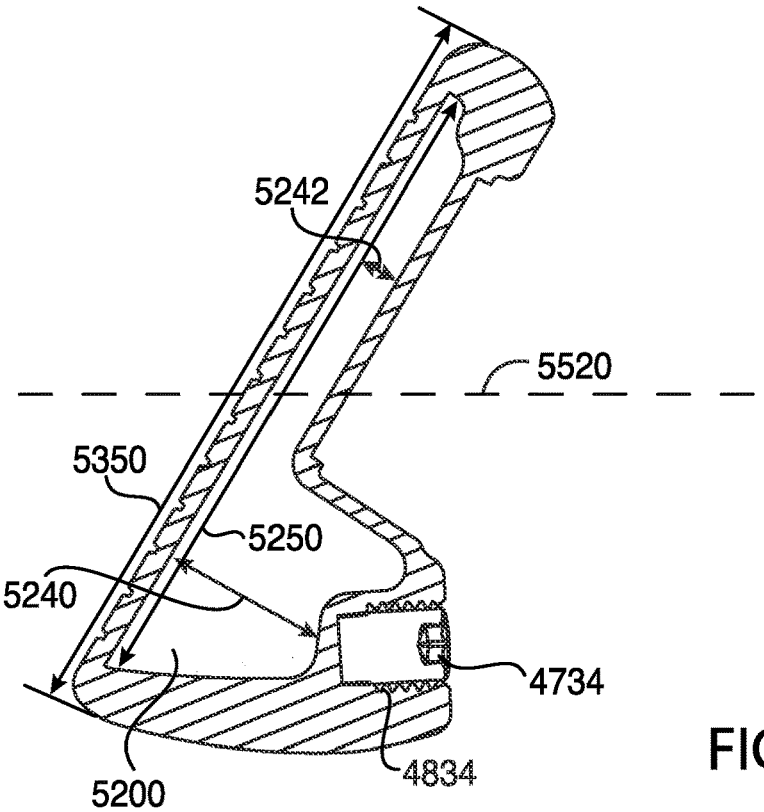
Figure 53:
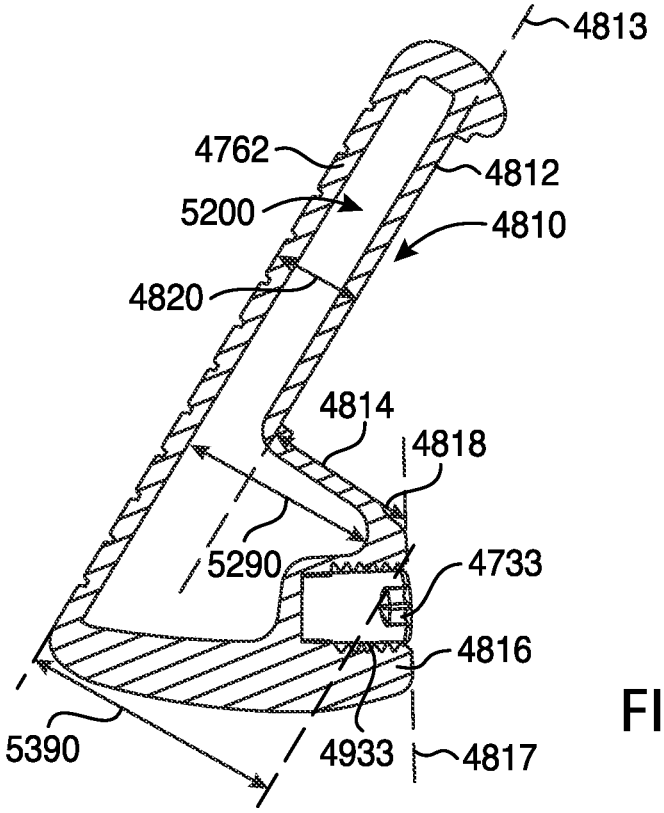
Figure 54:
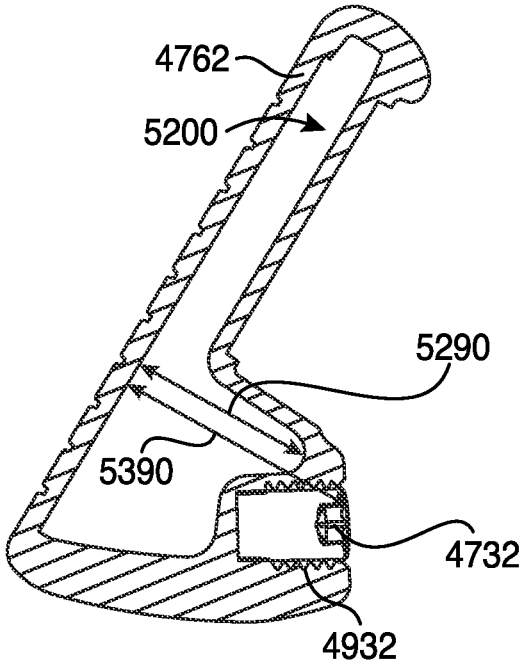
Figure 55:
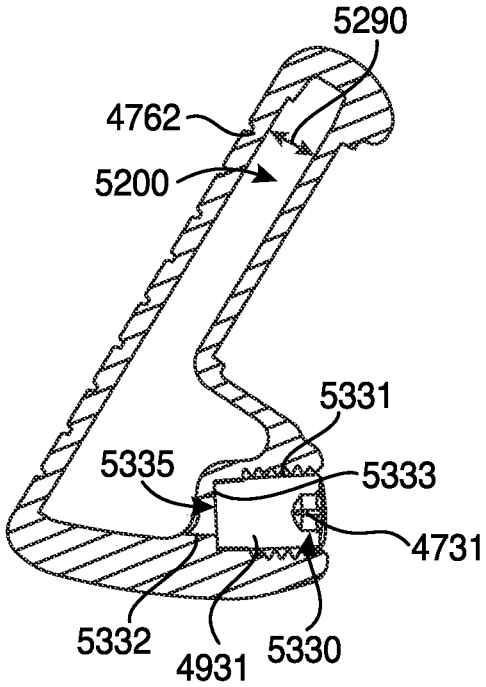
Figure 56:
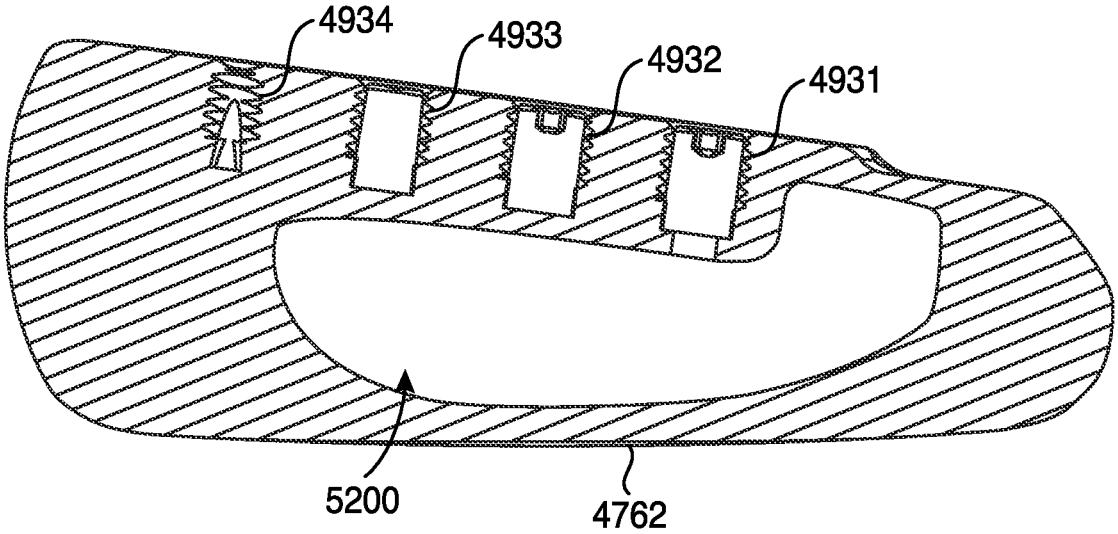
FIG. 56 depicts a cross-sectional view of the example golf club head of FIG. 47 along line 56-56 of FIG. 50.

The interior cavity 5200 may be associated with a cavity width 5240 ($W_C$), and the body portion 4710 may be associated with a body width 5390 ($W_B$). The cavity width 5240 and the body width 5390 may vary between the top portion 4780 and the sole portion 4790 and between the toe portion 4740 and the heel portion 4750. The cavity width 5240 may be at least 50% of a body width 5390 ($W_C$>0.5*$W_B$) at certain regions on the body portion 4710 between the top and sole portions 4780 and 4790 and between the toe and heel portions 4740 and 4750. According to another example, the cavity width 5240 may vary between about 40%-60% of a body width 5390 at certain regions between the top and sole portions 4780 and 4790. According to another example, the cavity width 5240 may vary between about 30%-70% of a body width 5390 at certain regions between the top and sole portions 4780 and 4790. According to another example, the cavity width 5240 may vary between about 20%-80% of a body width 5390 at certain regions between the top and sole portions 4780. For example, the cavity width 5240 may vary between about 20%-80% of the body width 5390 at or below the horizontal midplane 5520. With the cavity width 5290 of the interior cavity 5200 that may vary between about 20% or more to about 80% or less of the body width 5390 at or below the horizontal midplane 5520, a substantial portion of the mass of the golf club head 4700 may be moved lower and farther back as compared to a golf club head with a cavity width of less than about 20% of the body width. Further, the golf club head 4700 may produce relatively more consistent feel, sound, and/or result when the golf club head 4700 strikes a golf ball via the face portion 4762 than a golf club head with a cavity width of less than about 20% of the body width. In one example as illustrated in FIGS. 47-56, the cavity width 5290 at or below the horizontal midplane 5520 and above at least one weight portion (e.g., one generally shown as 4731, 4732, 4733, 4734, and/or 4735) may be greater than a cavity width (e.g., one generally shown as 5242 in FIG. 52) of the interior cavity 5200 at or near the top portion 4780 of the body portion 4710 and greater than a cavity width (e.g., one generally shown as 5240 in FIG. 52) of the interior cavity 5200 at or near the sole portion 4790. As illustrated in the example of FIGS. 50, 51, and 52, a distance between the vertical cross-section of the body portion 4710 shown in FIG. 52 (i.e., a cross-sectional view along vertical section line 52-52 of FIG. 50) and the toe portion edge (i.e., the outer edge of the toe portion 4740 as illustrated for example in FIG. 45 by reference number 4541) is greater than a distance between the vertical cross-section of the body portion 4710 shown in FIG. 51 (i.e., a cross-sectional view along vertical section line 51-51 of FIG. 50) and the toe portion edge. As illustrated in the example of FIGS. 50, 52, and 53, a distance between the vertical cross-section of the body portion 4710 shown in FIG. 53 (i.e., a cross-sectional view along vertical section line 53-53 of FIG. 50) and the toe portion edge is greater than a distance between the vertical cross-section of the body portion 4710 shown in FIG. 52 and the toe portion edge. As illustrated in the example of FIGS. 50, 53, and 54, a distance between the vertical cross-section of the body portion 4710 shown in FIG. 54 (i.e., a cross-sectional view along vertical section line 54-54 of FIG. 50) and the toe portion edge is greater than a distance between the vertical cross-section of the body portion 4710 shown in FIG. 53 and the toe portion edge. As illustrated in the example of FIGS. 50, 54, and 55, a distance between the vertical cross-section of the body portion 4710 shown in FIG. 55 (i.e., a cross-sectional view along vertical section line 55-55 of FIG. 50) and the toe portion edge is greater than a distance between the vertical cross-section of the body portion 4710 shown in FIG. 54 and the toe portion edge. The apparatus, methods, and articles of manufacture described herein are not limited in this regard.

To provide an interior cavity 5200 having cavity a width 5240 that may vary between about 20%-80% of a body width 5390 at or below the horizontal midplane 5520, to lower the CG of the golf club head 4700, and/or to move the CG of the golf club head 4700 farther back relative to the face portion 4762, the back portion 4770 may have a recessed portion 4810 that may extend between a location near the horizontal midplane 5520 and a location at or near the top portion 4780. The recessed portion 4810 may be defined by an upper wall 4812 of the back portion 4770 and a ledge portion 4814. The upper wall 4812 of the back portion 4770 may extend from a location at or near the horizontal midplane 5520 to a location at or near the top portion 4780. The ledge portion 4814 may extend from the upper wall 4812 of the back portion 4770 to a lower wall 4816 of the back portion 4770. The lower wall 4816 of the back portion 4770 may extend from a location at or near the horizontal midplane 5520 to a location at or near the sole portion 4790. The ledge portion 4814 may extends from the upper wall 4812 in a direction away from the face portion 4762. Accordingly, the ledge portion 4814 facilitates a transition from the upper wall 4812 to the lower wall 4816 by which the width of the body portion 4710 is substantially increased at or near the horizontal midplane 5520 as compared to the width of the body portion 4710 above the horizontal midplane. The ledge portion 4814 may have a ledge portion width 4818 (shown in FIG. 53) that is greater than an upper body width 4820 of the body portion 4710. In one example, the ledge portion width 4818 may be defined as a width of a surface on the back portion 4770 that extends between a plane 4813 generally defining the upper wall 4812 of the back portion 4770 and a plane 4817 generally defining the lower wall 4816 of the back portion 4770. The upper body width 4820 may be defined as a width of the body portion 4710 at or above the horizontal midplane 5520. According to one example, the ledge portion width 4818 may be wider than the upper body width 4820 by a factor of between about 0.5 to about 1.0. According to another example, the ledge portion width 4818 may be wider than the upper body width 4820 by a factor of about 1.5. According to another example, the ledge portion width 4818 may be wider than the upper body width 4820 by a factor of about 3.0. Accordingly, a golf club according to the examples described herein may have a ledge portion width 4818 that is wider than the upper body width 4820 by a factor of greater than or equal to about 0.5 to less than or equal to about 3.0. Accordingly, the body width 5390 at, near or below the horizontal midplane 5520 may be substantially greater than the upper body width 4820, which may provide for a cavity width 5240 that may be around 20% to 80% of the body width 5390 at, near or below the horizontal midplane 5520. Further, the recessed portion 4810 allows the golf club head 4700 to generally have a greater mass below the horizontal midplane 5520 than above the horizontal midplane 5520. In other words, the mass that is removed from the golf club head 4700 to define the recessed portion 4810 may be moved to aft or back portions of the body portion 4710 that are around and below the horizontal midplane 5520.

To generally maintain a cavity width 5240 that may be around 20%-80% of the body width 5390, the cavity width 5240 may be greater near the sole portion 4790 or below the horizontal midplane 5520 than near the top portion 4780 or above the horizontal midplane 5520. According to one example, the cavity width 5240 may generally vary according to a variation in the body width 5390 at certain regions of the body portion 4710 between the top portion 4780 and the sole portion 4790 and between the toe portion 4740 and the heel portion 4750. For example, as shown in FIG. 54, the cavity width 5240 may generally vary according to the body width 5390 in certain regions of the body portion 4710 between the top portion 4780 and the sole portion 4790. The apparatus, methods, and articles of manufacture described herein are not limited in this regard.

In one example, the interior cavity 5200 may be unfilled (i.e., empty space). The body portion 4710 with the interior cavity 5200 may weight about 100 grams less than the body portion 4710 without the interior cavity 5200. Alternatively, the interior cavity 5200 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 5200 may be filled with a TPE material to absorb shock, isolate vibration, and/or dampen noise when the golf club head 4700 strikes a golf ball via the face portion 4762.

In another example, the interior cavity 5200 may be partially or entirely filled with a polymer material such as an ethylene copolymer material to absorb shock, isolate vibration, and/or dampen noise when the golf club head 4700 strikes a golf ball via the face portion 4762. In particular, at least 50% of the interior cavity 5200 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

As described herein, the cavity width 5240 may vary between about 20%-80% of a body width 5390 at or below the horizontal midplane 5520. According to one example, at least 50% of the elastic polymer or elastomer material partially or filling the interior cavity 5200 may be located below the horizontal midplane 5520 of the golf club head 4700. Accordingly, the center of gravity of the golf club head 4700 may be further lowered and moved farther back as compared to a golf club head with a cavity width of less than about 20% of the body width and that is partially or fully filled with an elastic polymer or elastomer material. Further, the golf club head 4700 may produce relatively more consistent feel, sound, and/or result when the golf club head 4700 strikes a golf ball via the face portion 4762 as compared to a golf club head with a cavity width of less than about 20% of the body width that is partially or fully filled with an elastic polymer material. In one example as illustrated in FIGS. 47-56, the elastic polymer material or the elastomer material in the interior cavity 5200 may have a first portion located above the horizontal midplane 5520, a second portion located below the horizontal midplane 5520, and a third portion located between the first portion and the second portion. The first portion may have a first width, the second portion may have a second width greater than the first width, and the third portion may have a third width greater than the first width and greater than the second width. In one example, the third portion may be located between at least one weight portion (e.g., one generally shown as 4731, 4732, 4733, 4734, and/or 4735) and the top portion 4780 of the body portion 4710. In another example, the third portion may be located between at least one weight portion (e.g., one generally shown as 4731, 4732, 4733, 4734, and/or 4735) and the horizontal midplane 5520. In yet another example, at least a portion of at least one weight portion (e.g., one generally shown as 4731, 4732, 4733, 4734, and/or 4735) may be closer to the face portion 4762 than at least a portion of the elastic polymer material or the elastomer material in the interior cavity 5200.

The thickness of the face portion 4762 may vary between the top portion 4780 and the sole portion and between the toe portion 4740 and the heel portion as discussed in detail herein and shown in the examples of FIGS. 29 and 30. Accordingly, a detailed description of the variation in the thickness of the face portion 4762 is not provided. The apparatus, methods, and articles of manufacture described herein are not limited in this regard.

Different from other golf club head designs, the interior cavity 5200 of the body portion 4710 and the location of the first and second sets of weight portions 4720 and 4730, respectively, along the perimeter of the golf club head 4700 may result in a golf ball traveling away from the face portion 4762 at a relatively higher ball launch angle and a relatively lower spin rate. As a result, the golf ball may travel farther (i.e., greater total distance, which includes carry and roll distances).

The golf club head 4700 may be manufactured by any of the methods described herein and illustrated in FIG. 31. Accordingly, a detailed description of the method of manufacturing the golf club head 4700 is not provided.

As illustrated in FIGS. 51 and 55, for example, the golf club head 4700 may include one or more weight ports (e.g., one shown as weight ports 4921 and 4931) that may open to the to the cavity 5200. The weight port 4931 may include a first opening 5330 and a second opening 5335. As shown in FIG. 55, the weight port 4931 may include a first port wall 5331 that extends from the first opening 5330 to the second opening 5335 and a second port wall 5332 that extends from the second opening to the interior cavity 5200. As shown in FIG. 55, the first port wall 5331 includes a threaded portion to complementarily engage a threaded outer surface of the weight portion 4731 as described herein. The second opening 5335 may be used to access the interior cavity 5200. The first opening 5330 and the second opening 5335 may be same or different in size and/or shape. In one example, as shown in FIG. 55, the inner diameter of the weight port 4931 at the first port wall 5331 may be greater than the inner diameter of the weight port 4931 at the second port wall 5332. Accordingly, as shown in FIG. 55, the second opening 5335 may be smaller in diameter than the first opening 5330 to define a shoulder 5333 in the weight port 4931. As shown in FIG. 55, the weight portion 4731 abuts the shoulder 5333 and is prevented by the shoulder 5333 from further insertion into the weight port 4931 past the second opening 5335. As is further shown in FIG. 55, the height of the weight portion 4731 may be similar or substantially similar to a distance between the first opening 5330 and the second opening 5335. Accordingly, as shown in FIG. 55, when the weight portion 4731 is fully secured in the weight port 4931 (i.e., weight portion 4731 abutting the shoulder 5333) such that a threaded portion of the weight portion 4731 is complementarily engaged with a threaded portion of the first port wall 5331 as shown in FIG. 55, the weight portion 4731 extends from the second opening 5335 to a location at or proximate to the first opening 5330, and as further shown in FIGS. 48 and 49, the weight portion 4731 may partially define an outer surface of the lower wall 4816 of the back portion 4770. The weight port 4921 may include a first opening 5430 and a second opening 5435. The second opening 5435 may be used to access the interior cavity 5200. As shown in FIG. 51, the configuration of the weight port 4921 may be similar in many respects to the configuration and function of the weight port 4931 (i.e., having a first port wall, a second port wall, and a shoulder) as described herein. In one example, the process 3000 (FIG. 30) may fill the interior cavity 5200 with an elastic polymer material by injecting the elastic polymer material into the interior cavity 5200 from the first opening 5330 via the second opening 5335 of the weight port 4931. As the elastic polymer fills the interior cavity 5200, the air inside the interior cavity 5200 that is displaced by the elastic polymer material may exit the interior cavity from the weight port 4921 through the second opening 5435 and then the first opening 5430. After the cavity is partially or fully filled with the elastic polymer material, the weight ports 4931 and 4921 may be closed by inserting and securing weight portions therein as described in detail herein. Alternatively, the elastic polymer material may be injected into the interior cavity 5200 from the weight port 4921. Accordingly, the weight port 4931 may function as an exit port for the displaced air inside the interior cavity 5200. While the above example may describe and depict particular weight ports with second openings, any other weight ports of the golf club head 5600 may include a second opening (e.g., the weight port 4932). The apparatus, methods, and articles of manufacture described herein are not limited in this regard.

The body portion and/or any other portion of a golf club head according to any of the examples described herein may be constructed from stainless steel so as to resist corrosion or to be corrosion resistant. In some embodiments, all or portions of the body portion and/or any other portion of the golf club head may be constructed by a forging process. Accordingly, in some embodiments, the stainless steel from which all or portions of the body portion and/or any other portion of the golf club head are constructed may be a forgeable stainless steel. However, the apparatus, methods, and articles of manufacture described herein are not limited in this regard.

In embodiments in which stainless steel is used, various ranges of material properties, such as density, tensile strength, yield strength, hardness, elongation, etc., may be used. For any given embodiment, certain material properties may produce more desirable results in certain application or conditions. It should be understood, however, that the disclosed golf club heads and method for manufacturing may not be limited to the exemplary ranges.

In some embodiments, the density of the stainless steel may be between and including 7.0 g/cm3 and 8.3 g/cm3. In one example, the density of the stainless steel may be between and including 7.2 g/cm3 and 7.8 g/cm3. In another example, the density of the stainless steel may be between and including 7.3 g/cm3 and 7.7 g/cm3. In one example, the density of the stainless steel may be between and including 7.1 g/cm3 and 7.6 g/cm3. In another example, the density of the stainless steel may be between and including 7.4 g/cm3 and 8.3 g/cm3. The apparatus, methods, and articles of manufacture described herein are not limited in this regard.

In some embodiments, the tensile strength of the stainless steel from which all of portions of the body portion may be constructed may be between and including 600 MPa and 800 MPa (106 Pascal=106 N/m2). In one example, the tensile strength of the stainless steel from which all of portions of the body portion may be constructed may be between and including 620 MPa and 780 MPa. In another example, the tensile strength of the stainless steel from which all of portions of the body portion may be constructed may be between and including 660 MPa and 720 MPa. In one example, the tensile strength of the stainless steel from which all of portions of the body portion may be constructed may be between and including 680 MPa and 790 MPa. In another example, the tensile strength of the stainless steel from which all of portions of the body portion may be constructed may be between and including 640 MPa and 760 MPa. In one example, the tensile strength of the stainless steel from which all of portions of the body portion may be constructed may be between and including 670 MPa and 770 MPa. In some embodiments, the yield strength of the stainless steel from which all of portions of the body portion may be constructed may be between and including 500 MPa and 700 MPa. In one example, the yield strength of the stainless steel from which all of portions of the body portion may be constructed may be between and including 520 MPa and 680 MPa. In another example, the yield strength of the stainless steel from which all of portions of the body portion may be constructed may be between and including 560 MPa and 620 MPa. In one example, the yield strength of the stainless steel from which all of portions of the body portion may be constructed may be between and including 580 MPa and 690 MPa. In one example, the yield strength of the stainless steel from which all of portions of the body portion may be constructed may be between and including 540 MPa and 660 MPa. In one example, the yield strength of the stainless steel from which all of portions of the body portion may be constructed may be between and including 570 MPa and 670 MPa. The apparatus, methods, and articles of manufacture described herein are not limited in this regard.

In some embodiments, the hardness of the stainless steel from which all of portions of the body portion may be constructed may be between and including 10 and 40 HRC (Rockwell Hardness in the C scale). In one example, the hardness of the stainless steel from which all of portions of the body portion may be constructed may be between and including 15 and 35 HRC. In one example, the hardness of the stainless steel from which all of portions of the body portion may be constructed may be between and including 22 and 28 HRC. In one example, the hardness of the stainless steel from which all of portions of the body portion may be constructed may be between and including 12 and 38 HRC. In one example, the hardness of the stainless steel from which all of portions of the body portion may be constructed may be between and including 17 and 33 HRC. In one example, the hardness of the stainless steel from which all of portions of the body portion may be constructed may be between and including 11 and 31 HRC. The apparatus, methods, and articles of manufacture described herein are not limited in this regard.

In some embodiments, the elongation of the stainless steel from which all of portions of the body portion may be constructed may be between and including 5% and 40%. In one example, the elongation of the stainless steel from which all of portions of the body portion may be constructed may be between and including 10% and 32%. In one example, the elongation of the stainless steel from which all of portions of the body portion may be constructed may be between and including 13% and 28%. In one example, the elongation of the stainless steel from which all of portions of the body portion may be constructed may be between and including 18% and 37%. In one example, the elongation of the stainless steel from which all of portions of the body portion may be constructed may be between and including 14% and 33%. In one example, the elongation of the stainless steel from which all of portions of the body portion may be constructed may be between and including 7% and 36%. The apparatus, methods, and articles of manufacture described herein are not limited in this regard.

Figure 57:
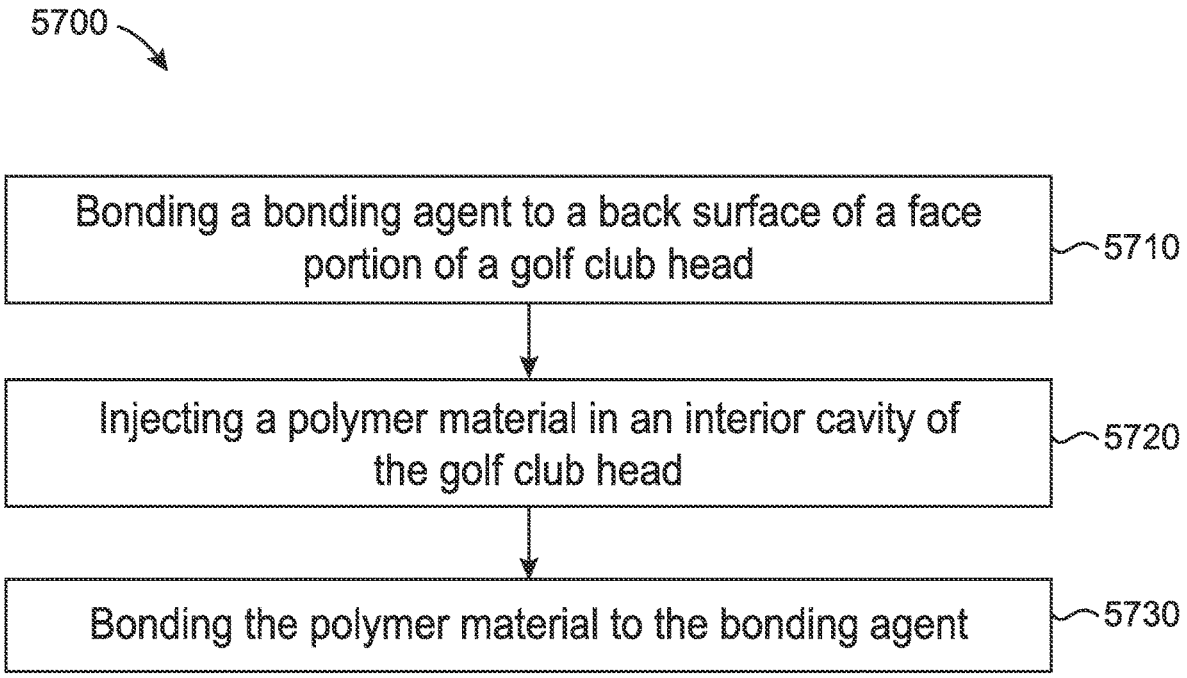
FIGS. 57 and 58 depict manners in which an example golf club head described herein may be manufactured.

FIG. 57 depicts one manner by which the interior cavity 2100 of the golf club head 1500 or any of the golf club heads described herein may be partially or entirely filled with an elastic polymer material or an elastomer material (e.g., an elastic polymer material 4220 of FIG. 42 such as a TPE material). The process 5700 may begin with bonding a bonding agent (e.g., the bonding portion 4210 of FIG. 42) to the back surface 1566 of the face portion 1562 of the golf club head 1500 (block 5710). The bonding agent may have an initial bonding state, which may be a temporary bonding state, and a final bonding state, which may be a permanent bonding state. The initial bonding state and the final bonding states may be activated when the bonding agent is exposed to heat, radiation, and/or other chemical compounds. For example, as described in detail herein, the bonding agent may be an epoxy having an initial cure state and a final cure state that are activated by the epoxy being heated to different temperatures for a period of time, respectively, by conduction, convention and/or radiation. In another example, the bonding agent may be a bonding material that is activated to an initial bonding state and a final bonding state by being exposed to different doses and/or duration of ultraviolet radiation, respectively. In another example, the bonding agent may be a bonding material that is activated to an initial bonding state and a final bonding state by being exposed to different compounds or different amounts of the same compound, respectively. According to the process 5700, the bonding agent may be bonded to the back surface of the face portion by being activated to the initial bonding state. Elastic polymer material is then injected in the interior cavity 2100 of the golf club head 1500 (block 5720). The process 5700 then includes bonding the elastic polymer material to the bonding agent (block 5730). Bonding the elastic polymer material to the bonding agent includes activating the bonding agent to the final bonding state to permanently bond the elastic polymer material to the bonding agent and to permanently bond the bonding agent to the back surface 1566 of the face portion 1562. The example process 5700 is merely provided and described in conjunction with other figures as an example of one way to manufacture the golf club head 1500. While a particular order of actions is illustrated in FIG. 57, these actions may be performed in other temporal sequences. Further, two or more actions depicted in FIG. 57 may be performed sequentially, concurrently, or simultaneously.

Figure 58:
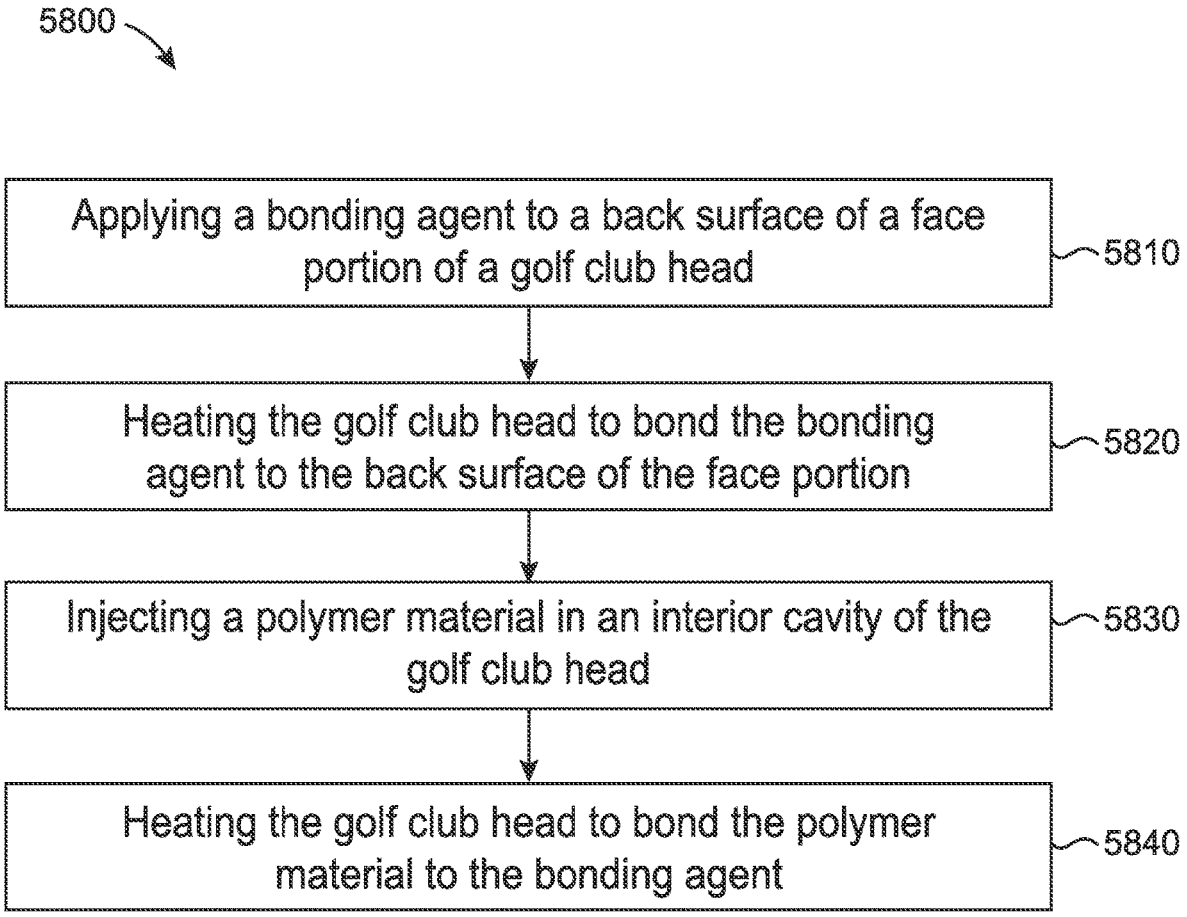

FIG. 58 depicts one manner by which the interior cavity 2100 of the golf club head 1500 or any of the golf club heads described herein may be partially or entirely filled with an elastic polymer material or an elastomer material (e.g., an elastic polymer material 4220 of FIG. 42 such as a TPE material). The process 5800 may begin with applying a bonding agent (e.g., a bonding portion 4210 of FIG. 42) to the back surface 1566 of the face portion 1562 of the golf club head 1500 (block 5810). The bonding agent may be any type of adhesive and/or other suitable materials. In one example, the bonding agent may be an epoxy. Prior to applying the bonding agent, the golf club head 1500 may be cleaned to remove any oils, other chemicals, debris, or other unintended materials from the golf club head 1500 (not shown). The bonding agent may be applied on the back surface 1566 as described herein depending on the properties of the bonding agent. The bonding agent may be applied to the back surface 1566 of the face portion 1562 through one or more of the first set of weight ports 1620 and/or the second set of weight ports 1630. For example, the bonding agent may be in liquid form and injected on the back surface 1566 through several or all of the first set of weight ports 1620 and the second set of weight ports 1630. An injection instrument (not shown) such as a nozzle or a needle may be inserted into each weight port until the tip or outlet of the injection instrument is near the back surface 1566. The bonding agent may then be injected on the back surface 1566 from the outlet of the injection instrument. Additionally, the injection instrument may be moved, rotated and/or swiveled while inside the interior cavity 2100 so that the bonding agent may be injected onto an area of the back surface 1566 surrounding the injection instrument. For example, the outlet of the injection instrument may be moved in a circular pattern while inside a weight port to inject the bonding agent in a corresponding circular pattern on the back surface 1566. Each of the first set of weight ports 1620 and the second set of weight ports 1630 may be utilized to inject a bonding agent on the back surface 1566. However, utilizing all of first weight ports 1620 and/or the second set of weight ports 1630 may not be necessary. For example, using every other adjacent weight port may be sufficient to inject a bonding agent on the entire back surface 1566. In another example, weight ports 1621, 1622, 1631, 1633 and 1636 may be used to inject the bonding agent on the back surface 1566. The apparatus, methods, and articles of manufacture are not limited in this regard.

The process 5800 may also include spreading or overlaying the bonding agent on the back surface 1566 (not shown) after injecting the bonding agent onto the back surface 1566 so that a generally uniform coating of the bonding agent is provided on the back surface 1566. According to one example, the bonding agent may be spread on the back surface 1566 by injecting air into the interior cavity 2100 through one or more of the first set of weight ports 1620 and/or the second set of weight ports 1630. The air may be injected into the interior cavity 2100 and on the back surface 1566 by inserting an air nozzle into one or more of the first set of weight ports 1620 and/or the second set of weight ports 1630. According to one example, the air nozzle may be moved, rotated and/or swiveled at a certain distance from the back surface 1566 so as to uniformly blow air onto the bonding agent to spread the bonding agent on the back surface 1566 for a uniform coating or a substantially uniform coating of the bonding agent on the back surface 1566. In one example, the golf club head 1500 may be pivoted back and forth in one or several directions so that the bonding agent is spread along a portion or substantially the entire area of the back surface 1566 of the face portion 1562. In one example, the golf club head 1500 may be vibrated with the back surface 1566 of the face portion 1562 in a generally horizontal orientation so that the bonding agent may spread or overlay on the back surface 1566 in a uniform coating manner or a substantially uniform coating manner. The apparatus, methods, and articles of manufacture are not limited in this regard.

The example process 5800 is merely provided and described in conjunction with other figures as an example of one way to manufacture the golf club head 1500. While a particular order of actions is illustrated in FIG. 58, these actions may be performed in other temporal sequences. Further, two or more actions depicted in FIG. 58 may be performed sequentially, concurrently, or simultaneously. The process 5800 may include a single action (not shown) of injecting and uniformly or substantially uniformly coating the back surface 1566 with the bonding agent. In one example, the bonding agent may be injected on the back surface 1566 by being converted into fine particles or droplets (i.e., atomized) and sprayed on the back surface 1566. Accordingly, the back surface 1566 may be uniformly or substantially uniformly coated with the bonding agent in one action. A substantially uniform coating of the bonding agent on the back surface 1566 may be defined as a coating having slight non-uniformities due to the injection process or the manufacturing process. However, such slight non-uniformities may not affect the bonding of the elastic polymer material or elastomer material to the back surface 1566 with the bonding agent as described herein. For example, spraying the bonding agent on the back surface 1566 may result in overlapping regions of the bonding agent having a slightly greater coating thickness than other regions of the bonding agent on the back surface 1566. The apparatus, methods, and articles of manufacture are not limited in this regard.

Figure 59:
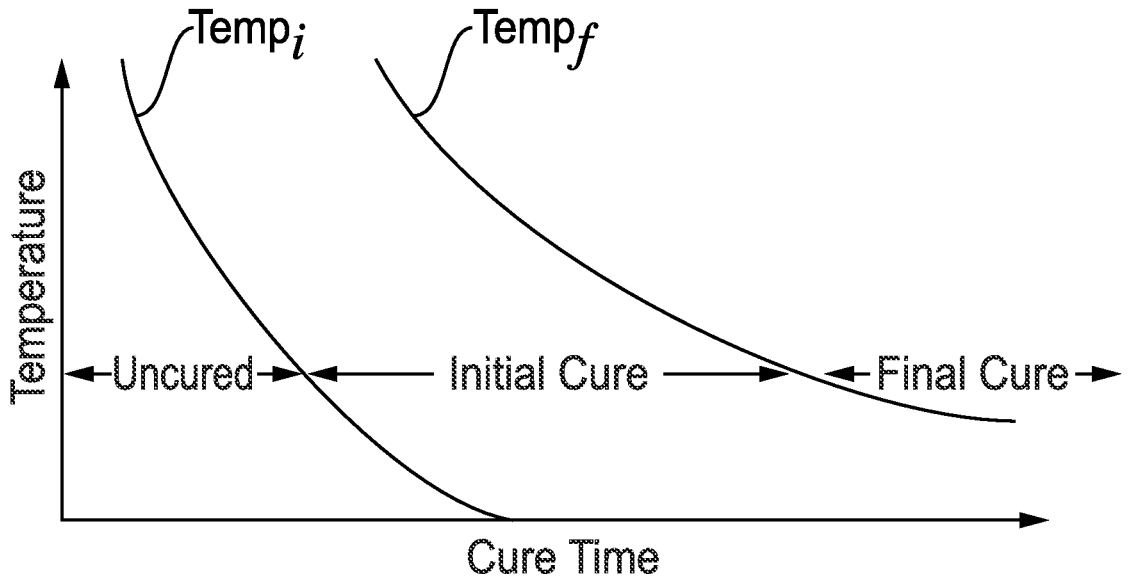
FIG. 59 depicts an example of curing a bonding agent.

In one example as shown in FIG. 58, the bonding agent may be an epoxy having different curing states based on the temperature and the amount of time to which the epoxy may be exposed. The bonding agent may have an uncured state, an initial cure state, and a final cure state. In one example, the uncured state may be a liquid state, the initial cure state may be gel or a semi-solid/semi-liquid state, and the final cure state may be a solid state. The bonding agent may transition from the uncured state to the initial cure state when the bonding agent is heated to a temperature between an initial cure state temperature ($Temp_i$) and a final cure state temperature ($Temp_f$) for a period of time. Accordingly, an initial cure state temperature range may be defined by temperatures that are greater than or equal to the initial cure state temperature $Temp_i$ and less than the final cure state temperature $Temp_f$. The bonding agent may transition from the initial cure state to the final cure state when the bonding agent may be heated to a temperature greater than or equal to the final cure state temperature $Temp_f$ for a period of time. Accordingly, a final cure state temperature range may be defined by temperatures that are greater than or equal to the final cure state temperature $Temp_f$. As shown in FIG. 59, the initial cure state temperature $Temp_i$, and the final cure state temperature $Temp_f$ may vary based on the amount of time that the bonding agent may be heated. In particular, a transition from the uncured state to the initial cure state and a transition from the initial cure state to the final cure state may be dictated by certain temperature and time profiles based on the properties of the bonding agent. At a temperature below the initial cure temperature $Temp_i$, the bonding agent may be in the uncured state (e.g., a liquid state). In the initial cure state, the bonding agent may form an initial bond with an object and become pliable to be manipulated (e.g., moved, spread, overlay, etc.) without obtaining full cross linking or forming a permanent bond. In other words, the bonding agent may form an initial bond with an object and be manipulated without forming a permanent bond. In the final cure state, the bond of the bonding agent (e.g., cross linking for a bonding agent that includes epoxy) may be complete or become permanently set.

The bonding agent may be applied to the back surface 1566 of the face portion 1562 when the bonding agent is in the uncured state, which may be a liquid state. Subsequently, the golf club head 1500 and/or the bonding agent may be heated to a first temperature $Temp_i$ that is greater than or equal to the initial cure state temperature $Temp_i$ and less than the final cure state temperature $Temp_f$ to change the bonding agent from an uncured state to an initial cure state (i.e., an initial cure state temperature range) (block 5820). Accordingly, the bonding agent may form an initial bond with the back surface 1566 of the face portion 1562. After bonding the bonding agent to the back surface 1566, the golf club head may be cooled for a period of time at ambient or room temperature (not shown). Accordingly, the bonding agent may be in an initial cured state and bonded to the back surface 1566 of the face portion 1562 so that the bonding agent may be bonded to the back surface 1566 during the injection molding of an elastic polymer material in the interior cavity 2100. Ambient or room temperature may be defined as a room temperature ranging between 5° C. (41° F.) to 40° C. (104° F.). The first temperature $Temp_i$ and duration by which the golf club head and/or the bonding agent heated to the first temperature $Temp_i$ may depend on the curing or bonding properties of the bonding agent. The apparatus, methods, and articles of manufacture are not limited in this regard.

After the bonding agent is bonded to the back surface 1566 of the face portion 1562, the golf club head 1500 may be heated (i.e., pre-heating the golf club head 1500) prior to receiving the elastic polymer material (not shown). The golf club head 1500 may be heated so that when the elastic polymer material is injected in the golf club head 1500, the elastic polymer material is not cooled by contact with the golf club head and remains in a flowing liquid form to fill the interior cavity 2100. The temperature to which the golf club head is heated, which may be referred to herein as a third temperature, may be similar to the temperature of the elastic polymer material when being injected into the interior cavity 2100. However, the temperature to which the golf club head is heated may be less than the final cure temperature $Temp_f$ of the bonding agent. Accordingly, the bonding agent may not transition from the initial cure state to the final cured state during the injection molding process. Further, the pre-heating temperature of the golf club head 1500 may be determined so that excessive cooling of the golf club head 1500 may not be necessary after injection molding the elastic polymer material in the interior cavity 2100. Prior to being injected into the interior cavity 2100, the elastic polymer material may also be heated to a liquid state (not shown). The temperature to which the elastic polymer material may be heated may depend on the type of elastic polymer material used to partially or fully fill the interior cavity 2100. Further, the temperature to which the elastic polymer material is heated may be determined so that shrinkage of the elastic polymer material is reduced during the injection molding process. However, as described herein, the elastic polymer material may be heated to a temperature that is less than the final cure temperature $Temp_f$ of the bonding agent. The apparatus, methods, and articles of manufacture are not limited in this regard.

As described herein, the interior cavity 2100 may be partially or fully filled with the elastic polymer material by injecting the elastic polymer material in the interior cavity 2100 (block 5830). The injection speed of the elastic polymer material may be determined so that the interior cavity 2100 may be slowly filled to provide a better fill while allowing air to escape the interior cavity 2100 and allowing the injected elastic polymer material to rapidly cool. For example, the elastic polymer material may be a non-foaming and injection-moldable thermoplastic elastomer (TPE) material. The elastic polymer material may be injected into the interior cavity 2100 from one or more of the weight ports described herein (e.g., one or more weight ports of the first and second sets of weight ports 1620 and 1630, respectively, shown in FIG. 28). One or more other weight ports may allow the air inside the interior cavity 2100 displaced by the elastic polymer material to vent from the interior cavity 2100. In one example, the golf club head 1500 may be oriented horizontally as shown in FIG. 28 during the injection molding process. The elastic polymer material may be injected into the interior cavity 2100 from weight ports 1631 and 1632. The weight ports 1621, 1622 and/or 1623 may serve as air ports for venting the displaced air from the interior cavity 2100. Thus, regardless of the orientation of the golf club head 1500 during the injection molding process, the elastic polymer material may be injected into the interior cavity 2100 from one or more lower positioned weight ports while one or more upper positioned weight ports may serve as air vents.

According to one example, any one of the weight ports or any air vent on the golf club head 1500 that may be used as air ports for venting the displaced air may be connected to a vacuum source (not shown) during the injection molding process. Accordingly, air inside the interior cavity 2100 and displaced by the elastic polymer material may be removed from the interior cavity 2100 by the vacuum source. Thus, a possibility of having trapped air pockets in the interior cavity 2100 and/or a non-uniform filling of the interior cavity 2100 with the elastic polymer material may be reduced After the elastic polymer material is injected in the interior cavity 2100, the golf club head 1500 may be heated to a second temperature $Temp_2$ that is greater than or equal to the final cure temperature $Temp_f$ of the bonding agent to reactivate the bonding agent to bond the elastic polymer material to the bonding agent (i.e., a final cure state temperature range) (block 5840). The second temperature $Temp_2$ and the duration by which the golf club head 1500 is heated to the second temperature $Temp_2$ may depend on the properties of the bonding agent as shown in FIG. 59 to form a permanent bond between the golf club head 1500 and the bonding agent and between the elastic polymer material and the bonding agent. The golf club head 1500 may be then cooled at ambient or room temperature (not shown). According to one example, the characteristic time (CT) of the golf club head may be measured (not shown) after manufacturing the golf club head as discussed herein. CT measurements may determine if the golf club head conforms to CT rules established by one or more golf governing bodies.

The heating and cooling processes described herein may be performed by conduction, convention, and/or radiation. For example, all of the heating and cooling processes may be performed by using heating or cooling systems that employ conveyor belts that move the golf club head 1500 through a heating or cooling environment for a period of time as discussed herein. The apparatus, methods, and articles of manufacture described herein are not limited in this regard.

An elastic polymer material with a low modulus of elasticity, such as a foaming elastic polymer material, may provide vibration and noise dampening for the face portion 1562 when the face portion 1562 impacts a golf ball. An elastic polymer material with a higher modulus of elasticity, such as a non-foaming elastic polymer material, may provide structural support to the face portion 1562 in addition to providing vibration and noise dampening. Accordingly, a thin face portion 1562 may be provided when the interior cavity 2100 is filled with a non-foaming elastic polymer material since the elastic polymer material may provide structural support to the thin face portion 1562 In one example, the elastic polymer material that is injection molded in the interior cavity 2100 may have a relatively high modulus of elasticity to provide structural support to the face portion 1562 and yet elastically deflect to absorb the impact forces experienced by the face portion 1562 when striking a golf ball. Thus, a non-foaming and injection moldable elastic polymer material with a relatively high modulus of elasticity may be used for partially or fully filling the interior cavity 2100 to provide structural support and reinforcement for the face portion 1562 in addition to providing vibration and noise dampening That is, the non-foaming and injection moldable elastic polymer material may be a structural support portion for the face portion 1562. The apparatus, methods, and articles of manufacture are not limited in this regard.

While the above examples may describe an iron-type or a wedge-type golf club head, the apparatus, methods, and articles of manufacture described herein may be applicable to other types of golf club heads.

The terms "and" and "or" may have both conjunctive and disjunctive meanings The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion being hollow to define an interior cavity and comprising a first material having a first density, the body portion including a toe portion with a toe portion edge, a heel portion with heel portion edge and a hosel portion, a front portion, a top portion with a top portion edge, a sole portion with a sole portion edge, and a back portion with a back wall portion, the back wall portion comprising:

an upper back wall portion extending from the top portion edge toward the sole portion edge, a lower back wall portion extending from the sole portion edge toward the top portion edge, and a ledge portion extending outward from the upper back wall portion to the lower back wall portion, a mass portion comprising a second material having a second density greater than the first density;

a port on the body portion at or below a horizontal midplane of the body portion and configured to receive the mass portion;

a first width of the interior cavity above the ledge portion;

a second width of the interior cavity below the ledge portion and above the port; and a third width of the interior cavity below the second width, wherein the third width is greater than the first width and the second width is greater than the third width at a first cross section of the body portion defined by a first plane intersecting the horizontal midplane, wherein the third width is greater than the first width and the second width is greater than the third width at a second cross section of the body portion defined by a second plane intersecting the horizontal midplane, wherein the third width is greater than the first width and the second width is greater than the third width at a third cross section of the body portion defined by a third plane intersecting the horizontal midplane, wherein a distance between the third plane and the toe portion edge is greater than a distance between the first plane and the toe portion edge, wherein the second plane is between the first plane and the third plane, and wherein a distance between the mass portion and the toe portion edge is substantially less than a distance between the mass portion and the heel portion edge.

2. A golf club head as defined in claim 1 further comprising a second mass portion in the hosel portion, the second mass portion made from a third material having a third density greater than the first density.

3. A golf club head as defined in claim 1, wherein the port includes an at least partially threaded portion, and wherein the mass portion includes an at least partially threaded portion configured to engage the at least partially threaded portion of the port to secure the mass portion in the port.

4. A golf club head as defined in claim 1 further comprising a face portion having a back surface, wherein at least a portion the interior cavity includes a polymer material attached to the back surface of the face portion.

5. A golf club head as defined in claim 1 further comprising a face portion having a back surface, wherein the port is connected to the interior cavity, and wherein a polymer material is injected onto the back surface of the face portion from the port.

6. A golf club head as defined in claim 1, wherein a width of the ledge portion is greater than a width of the body portion above the horizontal midplane.

7. A golf club head comprising:

a body portion being hollow to define an interior cavity and comprising a first material having a first density, the body portion including a toe portion with a toe portion edge, a heel portion with heel portion edge and a hosel portion, a front portion, a top portion with a top portion edge, a sole portion with a sole portion edge, and a back portion with a back wall portion, the back wall portion comprising:

an upper back wall portion extending from the top portion edge toward the sole portion edge, a lower back wall portion extending from the sole portion edge toward the top portion edge, and a ledge portion extending outward from the upper back wall portion to the lower back wall portion, a face portion coupled to the front portion to enclose the interior cavity, the face portion having a front surface and a back surface;

a first mass portion comprising a second material having a second density greater than the first density;

a second mass portion comprising a third material having a third density different from the first density;

a port on the body portion at or below a horizontal midplane of the body portion and configured to receive the first mass portion or the second mass portion;

a polymer material injected onto the back surface of the face portion from the port;

a first width of the interior cavity above the ledge portion;

a second width of the interior cavity below the ledge portion and above the port; and a third width of the interior cavity below the second width, wherein the third width is greater than the first width and the second width is greater than the third width at a first cross section of the body portion defined by a first plane intersecting the horizontal midplane, wherein the third width is greater than the first width and the second width is greater than the third width at a second cross section of the body portion defined by a second plane intersecting the horizontal midplane, wherein the third width is greater than the first width and the second width is greater than the third width at a third cross section of the body portion defined by a third plane intersecting the horizontal midplane, wherein a distance between the second plane and the toe portion edge is greater than a distance between the first plane and the toe portion edge, wherein a distance between the third plane and the toe portion edge is greater than a distance between the second plane and the toe portion edge, and wherein the first plane, the second plane, and the third plane are located between the first mass portion and the second mass portion.

8. A golf club head as defined in claim 7, wherein third density is greater than the first density.

9. A golf club head as defined in claim 7, wherein the first mass portion comprises a tungsten-based material.

10. A golf club head as defined in claim 7, wherein the second mass portion is located in the hosel portion.

11. A golf club head as defined in claim 7, wherein the second mass portion is located in the hosel portion at or proximate to an end portion of a golf club shaft.

12. A golf club head as defined in claim 7, wherein the polymer material comprises an adhesive configured to adhere to the back surface of the face portion.

13. A golf club head as defined in claim 7, wherein the first mass portion and the second mass portion have at least one different dimension.

14. A golf club head comprising:

a body portion being hollow to define an interior cavity, the body portion including a toe portion with a toe portion edge, a heel portion with heel portion edge and a hosel portion, a front portion, a top portion with a top portion edge, a sole portion with a sole portion edge, and a back portion with a back wall portion, the back wall portion comprising an upper back wall portion extending from the top portion edge toward the sole portion edge, a lower back wall portion extending from the sole portion edge toward the top portion edge, and a ledge portion extending outward from the upper back wall portion to the lower back wall portion;

a first mass portion below the ledge portion, the first mass portion comprising a threaded portion configured to engage a threaded portion of the body portion;

a second mass portion above the ledge portion, the second mass portion comprising a threaded portion configured to engage a threaded portion of the body portion;

a port below the ledge portion and between the first mass portion and the second mass portion, the port having a threaded bore configured to interchangeably receive the threaded portion of the first mass portion or the threaded portion of the second mass portion;

a polymer material in the interior cavity;

a first width of the interior cavity above the ledge portion;

a second width of the interior cavity below the ledge portion and above the port; and a third width of the interior cavity below the second width, wherein the third width is greater than the first width and the second width is greater than the third width at a first cross section of the body portion defined by a first plane intersecting a horizontal midplane of the body portion, wherein the third width is greater than the first width and the second width is greater than the third width at a second cross section of the body portion defined by a second plane intersecting the horizontal midplane, wherein the third width is greater than the first width and the second width is greater than the third width at a third cross section of the body portion defined by a third plane intersecting the horizontal midplane, wherein the first plane, the second plane, and the third plane are spaced apart in a direction between the toe portion edge and the heel portion edge, wherein a distance between the first mass portion and first plane is less than a distance between the first mass portion and the second plane, and wherein a distance between the second mass portion and the third plane is less than a distance between the second mass portion and the second plane.

15. A golf club head as defined in claim 14, wherein the first mass portion comprises a tungsten-based material.

16. A golf club head as defined in claim 14, wherein the second mass portion is located in the hosel portion.

17. A golf club head as defined in claim 14, wherein the port is connected to the interior cavity, and wherein the polymer material is injected into the interior cavity from the port.

18. A golf club head as defined in claim 14 further comprising a face portion having a back surface, wherein the port is connected to the interior cavity, and wherein the polymer material is injected onto the back surface of the face portion from the port.

19. A golf club head as defined in claim 14, wherein the first mass portion and the second mass portion have at least one different physical property.

20. A golf club head as defined in claim 14, wherein the first mass portion is at or below the horizontal midplane.

* * * * *